US007684740B2

(12) United States Patent
Matsuda et al.

(10) Patent No.: US 7,684,740 B2
(45) Date of Patent: Mar. 23, 2010

(54) BELT DRIVING CONTROLLER, BELT ROTATING DEVICE, AND IMAGE FORMING APPARATUS

(75) Inventors: Hiromichi Matsuda, Kanagawa (JP); Hiroshi Koide, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 958 days.

(21) Appl. No.: 11/441,358

(22) Filed: May 26, 2006

(65) Prior Publication Data

US 2006/0275056 A1 Dec. 7, 2006

(30) Foreign Application Priority Data

May 30, 2005 (JP) ..... 2005-157976
Nov. 24, 2005 (JP) ..... 2005-338736

(51) Int. Cl.
*G03G 15/01* (2006.01)

(52) U.S. Cl. ..... 399/301

(58) Field of Classification Search ..... 399/162, 399/163, 165, 303, 312, 313, 301
See application file for complete search history.

(56) References Cited

U.S. PATENT DOCUMENTS 5,200,782 A * 4/1993 Castelli et al. ..... 399/165
5,387,962 A * 2/1995 Castelli et al. ..... 399/165
5,790,930 A * 8/1998 Fuchiwaki ..... 399/162
6,125,994 A * 10/2000 Todome ..... 399/303
7,327,972 B2 * 2/2008 Matsuda et al. ..... 399/162
7,343,119 B2 * 3/2008 Matsuda et al. ..... 399/303
2002/0085086 A1 7/2002 Koide
2004/0086299 A1 * 5/2004 Matsuda et al.
2004/0164691 A1 8/2004 Andoh
2005/0220491 A1 10/2005 Koide

FOREIGN PATENT DOCUMENTS

JP 10-078734 3/1998
JP 2000-310897 11/2000
JP 2000-330353 11/2000
JP 2004-123383 4/2004

* cited by examiner

*Primary Examiner*—Susan S Lee
(74) *Attorney, Agent, or Firm*—Harness, Dickey & Pierce, P.L.C.

(57) ABSTRACT

A belt driving controller is disclosed. The belt driving controller executes driving control of a belt that is wound around plural sustaining rollers by controlling a driving sustaining roller that transmits driving force to the belt. The belt driving controller executes the driving control of the belt by controlling the driving sustaining roller so that a moving velocity fluctuation of the belt caused by a PLD (pitch line distance) fluctuation in the belt circumference direction becomes small, based on rotation information of rotation angle displacement or rotation angle velocities of two sustaining rollers in the plural sustaining rollers, in which two sustaining rollers, the diameters thereof are different from each other and/or the degrees to which the PLDs of parts of the belt which wind around the two sustaining rollers influence the belt moving velocity and the rotation angle velocities of the two sustaining rollers are different from each other.

4 Claims, 15 Drawing Sheets

FIR FILTER

BELT DRIVING CONTROLLER, BELT ROTATING DEVICE, AND IMAGE FORMING APPARATUS

BACKGROUND OF THE INVENTION

1. Field of the Invention

The present invention generally relates to a belt driving controller which controls driving of a belt wound around plural sustaining rollers, a belt rotating device which uses the belt driving controller, and an image forming apparatus which uses the belt rotating device.

2. Description of the Related Art

As an apparatus which uses belts, there is an image forming apparatus which uses a photoconductor belt, an intermediate transfer belt, a paper carrying belt, and so on. In the image forming apparatus, belt driving control at high accuracy is essential to obtain a high quality image. Especially, in a tandem type image forming apparatus having an image direct transfer system, which has a high image forming velocity and is suitable to be small sized, highly accurate driving control of a paper carrying belt which carries a recording paper being a recording medium is required. In a color image forming apparatus, a recording paper is carried by a carrying belt and is passed through plural image forming units each of which forms a different single color image along a paper carrying direction in order. Then, a color image in which single different color images are superposed can be obtained on the recording paper.

Referring to FIG. 13, an example of the tandem type image forming apparatus having an image direct transfer system using an electro-photographic technology is described. FIG. 13 is a diagram showing a part of the tandem type image forming apparatus which uses a direct image transfer system. As shown in FIG. 13, in the tandem type image forming apparatus, for example, image forming units 18K, 18C, 18M, and 18Y which form single color images of black, cyan, magenta, and yellow, respectively, are sequentially disposed in the paper carrying direction. Electrostatic latent images formed by laser exposure units (not shown) on the surfaces of photo-conductor drums 40K, 40C, 40M, and 40Y are developed by the image forming units 18K, 18C, 18M, and 18Y, respectively, and toner images are formed. The toner images are transferred on a recording paper (not shown) which is carried by being adhered to a carrying belt 210 by electrostatic force so that the toner images are superposed in order. Then toners are fused by a fuser (fixing unit) 25 and a color image is formed on the recording paper. The carrying belt 210 is wound around a driving roller 215 and a driven roller 214 both of which are disposed in parallel with suitable tension. The driving roller 215 is rotated with a predetermined rotation velocity by a driving motor (not shown) and then the carrying belt 210 is moved endlessly with a predetermined velocity. The recording paper is fed to the image forming units 18K, 18C, 18M, and 18Y with predetermined timing by a paper feeding mechanism (not shown) and is carried by the same velocity of the moving velocity of the carrying belt 210, and is passed through the image forming units 18K, 18C, 18M, and 18Y in order.

In the tandem type image forming apparatus, when the moving velocity of the recording paper, that is, the moving velocity of the carrying belt 210 is not sustained at a constant velocity, color registration errors occur. The color registration errors occur when the transferring position of a color image which is superposed on the recording paper is relatively shifted. When the color registration errors occur, for example, fine-line images formed by superposing plural color images are blurred, and a white part occurs at a position near a contour of a black letter image formed in a background image formed by superposing plural color images. In FIG. 13, the description of the reference number 62 and the sign S is omitted.

FIG. 14 is a diagram showing a part of a tandem type image forming apparatus which uses an intermediate transfer system. In the tandem type image forming apparatus shown in FIG. 14, a single color image formed on the surface of each of the photoconductor drums 40K, 40C, 40M, and 40Y in the corresponding image forming units 18K, 18C, 18M, and 18Y is temporarily transferred onto an intermediate transfer belt 10 so that the single color images are sequentially superposed, and the transferred image is recorded on a recording paper. That is, the tandem type image forming apparatus shown in FIG. 14 uses the intermediate transfer system. In this apparatus, when the moving velocity of the intermediate transfer belt 10 is not maintained at a constant velocity, the color registration errors also occur.

In addition to the tandem type image forming apparatuses, in an image forming apparatus which uses belts as a recording medium carrying member which carries a recording medium, a photoconductor body which carries an image to be transferred to a recording medium, and an image carrier such as an intermediate transfer body, when the moving velocity of the belt is not maintained at a constant value, banding occurs. The banding is image density errors caused by a fluctuation of belt moving velocity while an image is being transferred. That is, when the belt moving velocity is relatively fast, a part of a transferred image is enlarged in the belt moving direction from the original image; on the contrary, when the belt moving velocity is relatively slow, a part of the transferred image is reduced in the belt moving direction from the original image. Therefore, the density of the enlarged part of the image becomes thin and the density of the reduced part of the image becomes thick. As a result, the image density errors occur in the orthogonal direction to the belt moving direction, that is, the banding occurs. When a light single color image is formed, the banding is especially noticeable.

The moving velocity of the belt fluctuates, which is caused by various reasons; as one of them, there is thickness non-uniformity of a belt in the belt moving direction in the case of a single layer belt. The thickness non-uniformity of the belt is caused by a thickness bias along the belt moving direction (belt circumference direction) when a belt is formed by a centrifugal burning method using a cylinder die. In a case where the thickness non-uniformity exists in the belt, when the thick part of the belt is wound around the driving roller which drives the belt, the belt moving velocity becomes slow; on the contrary, when the thin part of the belt is wound around the driving roller, the belt moving velocity becomes fast. That is, the moving velocity of the belt fluctuates. The reasons are described below in detail. In FIG. 14, the description of the reference numbers 9, 14, 15, 24, 25, 49, and 62 is omitted.

FIG. 15 is a graph showing an example of the belt thickness fluctuation in the moving direction of the intermediate transfer belt 10 shown in FIG. 14. In FIG. 15, the horizontal line shows a value in which the length of one circumference of the belt (belt circumference length) is transformed into the angle of $2\pi$ (rad). The vertical line shows a deviation (fluctuation) of the belt thickness from a reference (=0 in FIG. 15). In this, the reference value is the belt thickness average value (100 μm) in the belt circumference direction.

In the description of the present invention, in a belt which has the belt thickness non-uniformity, the belt thickness deviation distribution of the one round in the belt circumference direction is called the belt thickness fluctuation. Therefore, the belt thickness non-uniformity and the belt thickness fluctuation are explained in detail. The belt thickness non-uniformity shows a belt thickness deviation distribution measured by a film thickness measuring instrument and exists in the belt circumference direction (belt moving direction) and the belt width direction (driving roller axle direction). The belt thickness fluctuation shows a belt thickness deviation distribution caused by the fluctuations of a belt rotation cycle which affects a belt moving velocity for the rotation angle velocity of the driving roller and the rotation angle velocity of the driven roller for the belt moving velocity where the belt is installed with a belt driving controller.

FIG. 16 is an enlarged view where a part of a belt is wound around a driving roller viewed from the axle direction of the driving roller.

In FIG. 16, the moving velocity of a belt 103 is determined by a PLD (pitch line distance) which distance is from the surface of the driving roller 105 to the belt pitch line. When the belt 103 is a single layer belt whose material is uniform and the absolute values of the stretches of the inner and outer circumferences of the belt 103 are almost equal, the PLD corresponds to the distance from the center of the thickness of the belt 103 to the surface of the driving roller 105 (the inner circumference surface of the belt 103) (Bt). Therefore, in a case of the single layer belt, the relationship between the PLD and the belt thickness approximately becomes constant; consequently, the moving velocity of the belt 103 can be determined by the belt thickness fluctuation. However, in a plural-layer belt, since the stretches of the hard layer and the soft layer are different from each other, the PLD becomes a distance between a position deviated from the center of the thickness of the belt 103 and the surface of the driving roller 105. Further, in some cases, the PLD changes by a belt winding angle onto the driving roller 105.

$$PLD=PLD_{ave}+f(d) \quad \text{[Equation 1]}$$

where the $PLD_{ave}$ is an average value of the PLDs in one round of the belt. For example, in a case of a single layer belt whose average thickness is 100 μm, the $PLD_{ave}$ is 50 μm. The f(d) is a function showing a fluctuation of the PLD in one round of the belt. Further, "d" is a position from a reference on the belt circumference (phase when one round of the belt is defined as 2π). The f(d) has a high correlation with the belt thickness fluctuation shown in FIG. 15, and a periodic function in which one round of the belt is a period. When the PLD fluctuates in the belt circumference direction, the belt moving velocity or the belt moving distance for the rotation angle velocity or the rotation angle displacement of the driving roller fluctuates, or the rotation angle velocity or the rotation angle displacement of the driven roller for the belt moving velocity or the belt moving distance fluctuates.

A relationship between the belt moving velocity V and the rotation angle velocity ω of the driving roller 105 is shown in Equation 2.

$$V=\{r+PLD_{ave}+\kappa f(d)\}\omega \quad \text{[Equation 2]}$$

where "r" is the radius of the driving roller 105. The degree that the f(d) showing the fluctuation of the PLD influences the relationship between the belt moving velocity or the belt moving distance and the rotation angle velocity or the rotation angle displacement of the driving roller 105 may change depending on a belt contacting state and a belt winding amount onto the driving roller 105. The influencing degree is shown by a fluctuation effective coefficient "κ".

In the description of the present invention, the range surrounded by { } in Equation 2 is called a roller effective radius. Especially, the constant part ($r+PLD_{ave}$) is called a roller effective radius R. The f(d) is called a PLD fluctuation.

Since the PLD fluctuation f(d) exists in Equation 2, it is understandable that the relationship between belt moving velocity V and the rotation angle velocity ω of the driving roller 105 changes. That is, even when the driving roller 105 rotates at a constant rotation angle velocity ω (=constant), the belt moving velocity V is changed by the PLD fluctuation f(d). For example, in a case of a single layer belt, when a part of the belt whose thickness is greater than the average belt thickness is wound around the driving roller 105, the PLD fluctuation f(d) which has a high correlation with the thickness deviation of the belt 103 is a positive value and the roller effective radius increases. Consequently, even when the driving roller 105 rotates at a constant rotation angle velocity ω (=constant), the belt moving velocity V increases. On the contrary, when a part of the belt whose thickness is less than the average belt thickness is wound around the driving roller 105, the PLD fluctuation f(d) is a negative value and the roller effective radius decreases. Consequently, even when the driving roller 105 rotates at a constant rotation angle velocity ω (=constant), the belt moving velocity V decreases.

As described above, even when the rotation angle velocity ω of the driving roller 105 is constant, the belt moving velocity V does not become constant due to the PLD fluctuation f(d). Therefore, if it is attempted to control the driving of the belt 103 by only the rotation angle velocity ω of the driving roller 105, the belt 103 cannot be driven at a desired constant moving velocity.

Further, the relationship between the belt moving velocity V and the rotation angle velocity of the driven roller is the same as that between the belt moving velocity V and the rotation angle velocity ω of the driving roller 105. That is, when the rotation angle velocity of the driven roller is detected by a rotary encoder and the belt moving velocity V is obtained by the detected rotation angle velocity, Equation 2 can be used. For example, a case of a single layer belt, when a part of the belt whose thickness is greater than the average belt thickness is wound around the driven roller, similar to the case of the driving roller 105, the PLD fluctuation f(d) which has a high correlation with the thickness deviation of the belt 103 is a positive value and the roller effective radius increases. Consequently, even when the belt 103 moves in a constant moving velocity V (=constant), the rotation angle velocity of the driven roller decreases. On the contrary, when a part of the belt whose thickness is less than the average belt thickness is wound around the driven roller, the PLD fluctuation f(d) is a negative value and the roller effective radius decreases. Consequently, even when the belt 103 moves at a constant moving velocity, the rotation angle velocity of the driven roller increases.

As described above, even when the moving velocity of the belt 103 is constant, the rotation angle velocity of the driven roller does not become constant due to the PLD fluctuation f(d). Therefore, even if it is attempted to control the driving of the belt 103 by the rotation angle velocity of the driven roller, the belt 103 cannot be driven at a desired moving velocity.

As a belt driving control technology which considers the PLD fluctuation f(d), in Patent Documents 1 and 2 an image forming apparatus is disclosed.

In the image forming apparatus of Patent Document 1, before a belt, which is formed by a centrifugal forming method in which the PLD fluctuation is likely to occur in a sine wave in one round of a belt, is installed in the image forming apparatus, a thickness profile (belt thickness non-uniformity) of all the circumference of the belt is measured beforehand in the manufacturing process, and the measured data are stored in a flash ROM. In the image forming apparatus, a reference mark is attached to a home position that is a reference position to match the phase of the profile data of the circumference thickness with the phase of actual belt thickness non-uniformity. The belt driving control is executed so as to cancel the fluctuation of the belt moving velocity caused by the belt thickness non-uniformity by detecting the belt thickness non-uniformity at the reference mark.

In the image forming apparatus of Patent Document 2, a pattern for detection is formed on a belt, the pattern is detected by a detection sensor, and the fluctuation of a periodic belt moving velocity is detected by the pattern detection. The rotation velocity of the driving roller is controlled to cancel the fluctuation of the detected periodic belt moving velocity.

[Patent Document 1] Japanese Laid-Open Patent Application No. 2000-310897

[Patent Document 2] Japanese Patent No. 3186610

However, in the image forming apparatus described in Patent Document 1, it is required to have a process which measures the belt thickness non-uniformity in the manufacturing process of the belt and a highly accurate thickness measuring instrument is required in the measuring process. Consequently, the manufacturing cost largely increases. In addition, when the belt is changed to a new one, it is required to input the thickness profile data of the new belt in the apparatus. Further, in the image forming apparatus, since the belt thickness non-uniformity is used without using the PLD fluctuation f(d), in a case of the single layer belt, the belt driving control can be accurately performed, but the belt driving control cannot be performed accurately in a case of the plural-layer belt.

In the image forming apparatus described in Patent Document 2, in order to detect the fluctuation of the belt moving velocity, it is required to form the pattern for detection in at least one round of the belt. Therefore, a large amount of toner is consumed to form the pattern for detection. Especially, in order to detect the fluctuation of the belt moving velocity at high accuracy, when an average value of fluctuation data of the belt moving velocity by measuring plural times of the belt circumference is used as the fluctuation of the belt moving velocity, the plural times of the measurement of the belt circumference consumes the toner greatly.

Further, the applicant of the present invention disclosed a belt driving controller which can solve the above problems in Japanese Laid-Open Patent Application No. 2004-123383 (Japanese Priority Application No. 2002-230537) (hereinafter, referred to as a precedent application). In the belt driving controller, the rotation angle displacement or the rotation angle velocity of a driven sustaining rotation body is detected, and an alternating current component of the rotation angle velocity of the driven sustaining rotation body having a frequency corresponding to the periodic thickness fluctuation in the belt circumference direction is extracted form the detected data. The amplitude and the phase of the extracted alternating current component correspond to the amplitude and the phase of the periodic thickness fluctuation in the circumference direction of the belt. Therefore, based on the amplitude and the phase of the extracted alternating current component, it is controlled so that the rotation angle velocity of a driving sustaining rotation body is made low at the timing when a thick part of the belt contacts the driving sustaining rotation body and the rotation angle velocity of the driving sustaining rotation body is made high at the timing when a thin part of the belt contacts the driving sustaining rotation body. According to this technology, the belt can be driven at a desired moving velocity without suffering any influence of the thickness fluctuation in the circumference direction of the belt. Further, it is not necessary to have a process for measuring the belt thickness non-uniformity in the belt manufacturing process; therefore, the manufacturing cost does not increase while it increases in Patent Document 1. In addition, it is not necessary to have a process for inputting thickness profile data in the apparatus when the belt is changed to a new one. Further, it is not necessary to form a pattern for detection while it is needed in Patent Document 2. Therefore, toner is not consumed for the belt driving control.

However, in the belt driving controller of the precedent application, since the belt thickness fluctuation is approximated by a periodic function of a sine function (cosine function), it is necessary to know the belt thickness fluctuation that occurs in one round of the belt (the belt is driven completely around the belt path) beforehand. That is, it is necessary to know beforehand whether the frequency component including in the belt thickness fluctuation is only a basic frequency component having a period equal to that of one round of the belt, or includes a high-frequency component. In addition, in a case of a belt having a seam, the thickness of the seam part may thicker than the other parts; then, the belt thickness fluctuation may occur at the seam part. Since this kind of belt thickness fluctuation is difficult to be approximated by the periodic function, control errors may be included in the seam part.

SUMMARY OF THE INVENTION

In a preferred embodiment of the present invention, there is provided a belt driving controller, a belt rotating device using the controller, and an image forming apparatus using the device.

Features and advantages of the present invention are set forth in the description that follows, and in part will become apparent from the description and the accompanying drawings, or may be learned by practice of the present invention according to the teachings provided in the description. Features and advantages of the present invention will be realized and attained by a belt driving controller, a belt rotating device using the controller, and an image forming apparatus using the device particularly pointed out in the specification in such full, clear, concise, and exact terms as to enable a person having ordinary skill in the art to practice the invention.

To achieve these and other advantages in accordance with the purpose of the present invention, according to a first aspect of the present invention, there is provided a belt driving controller, which executes driving control of a belt that is wound around a plurality of sustaining rotation bodies including a driven sustaining rotation body that is rotated together with a movement of the belt and a driving sustaining rotation body that transmits driving force to the belt. The belt driving controller includes a control unit, which executes the driving control of the belt so that a moving velocity fluctuation of the belt caused by a PLD (pitch line distance) fluctuation in the belt circumference direction becomes small, based on rotation information of rotation angle displacement or rotation angle velocities in two of the sustaining rotation bodies in the plural sustaining rotation bodies, in which two sustaining rotation bodies the diameters thereof are different from each other and/or the degrees to which the PLDs of parts of the belt which wind around the two sustaining rotation bodies influence the belt moving velocity and the rotation angle velocities of the two sustaining rotation bodies are different from each other.

According to a second aspect of the present invention, there is provided a belt driving controller, which executes driving control of a belt that is wound around a plurality of sustaining rotation bodies including a driven sustaining rotation body that is rotated together with a movement of the belt and a driving sustaining rotation body that transmits driving force to the belt. The belt driving controller includes a control unit, which executes the driving control of the belt so that a moving velocity fluctuation of the belt caused by a belt thickness fluctuation in the belt circumference direction becomes small, based on rotation information of rotation angle displacement or rotation angle velocities in two of the sustaining rotation bodies in the plural sustaining rotation bodies, in which two sustaining rotation bodies the diameters thereof are different from each other and/or the degrees to which the belt thicknesses of parts of the belt which wind around the two sustaining rotation bodies influence the belt moving velocity and the rotation angle velocities of the two sustaining rotation bodies are different from each other.

According to a third aspect of the present invention, in the first and the second aspects, the control unit executes the driving control of the belt, by using approximation rotation fluctuation information obtained by causing rotation fluctuation information of the two sustaining rotation bodies obtained from rotation information of the two sustaining rotation bodies detected at the same time to be the same phase.

According to a fourth aspect of the present invention, in the first and the second aspects, the control unit executes the driving control of the belt, by using a process result in which one of two rotation fluctuation information items whose phases are different included in the rotation information of the two sustaining rotation bodies is processed to be small.

According to a fifth aspect of the present invention, in the fourth aspect, in the process, an adding process is applied to the two rotation fluctuation information items whose phases are different included in the rotation information of the two sustaining rotation bodies, and in the adding process, rotation fluctuation information to which a delay time which is a time that the belt needs to pass through a distance between the two sustaining rotation bodies on a belt moving route is given and also to which a gain is given based on the degrees of the two sustaining rotation bodies are added to the rotation fluctuation information, and the adding process is repeated by n times ($n \geqq 1$), and in the adding process, as the gain at the $n^{th}$ adding process, the $2^{n-1}$ power of the gain G of the first adding process is used, and as the delay time of the $n^{th}$ adding process, the $2^{n-1}$ times of the delay time of the first adding process is used.

According to a sixth aspect of the present invention, in the fourth aspect, the two sustaining rotation bodies are disposed so that a ratio of a belt moving route length between the two sustaining rotation bodies to a belt total circumference length becomes 1 to 2Nb (Nb is an integer), and in the process, an adding process is applied to the two rotation fluctuation information items whose phases are different included in the rotation information of the two sustaining rotation bodies, and in the adding process, rotation fluctuation information to which a delay time which is a time that the belt needs to pass through a distance between the two sustaining rotation bodies on a belt moving route is given and also to which a gain is given based on the degrees of the two sustaining rotation bodies are added to the rotation fluctuation information, and the adding process is repeated by Nb times, and in the adding process, as the gain at the $n^{th}$ adding process, the $2^{n-1}$ power of the gain G of the first adding process is used, and as the delay time of the $n^{th}$ adding process, the $2^{n-1}$ times of the delay time of the first adding process is used.

According to a seventh aspect of the present invention, in the fourth aspect, the two sustaining rotation bodies are disposed so that a ratio of a belt moving route length between the two sustaining rotation bodies to a belt total circumference length becomes 1 to 2Nb+1 (Nb is an integer), in the process, an adding process is applied to the two rotation fluctuation information, and in the adding process, rotation fluctuation information to which a delay time which is a time that the belt needs to pass through a distance between the two sustaining rotation bodies on a belt moving route is given and also to which a gain is given based on the degrees of the two sustaining rotation bodies are added to the rotation fluctuation information, and the adding process is repeated from the first time to the (2Nb+1) time, further, in the adding process, as the gain at the $n^{th}$ adding process, the (n−1) power of the gain G of the first adding process is used, and as the delay time of the $n^{th}$ adding process, the (n−1) times of the delay time of the first adding process is used.

According to an eighth aspect of the present invention, in the fourth aspect, in the process, an adding process is applied to the two rotation fluctuation information items whose phases are different included in the rotation information of the two sustaining rotation bodies, and in the adding process, rotation fluctuation information to which a delay time which is a time that the belt needs to pass through a distance between the two sustaining rotation bodies on a belt moving route is given and also to which a gain is given based on the degrees of the two sustaining rotation bodies are added to the rotation fluctuation information, and the added information is output and the output information is fed back.

According to a ninth aspect of the present invention, in the first and the second aspects, the belt driving controller further includes a fluctuation information storing unit which stores the rotation fluctuation information in a period corresponding to a time in which the belt needs to move one round.

According to a tenth aspect of the present invention, in the ninth aspect, the control unit obtains again rotation fluctuation information at timing when the difference between the rotation fluctuation information stored in the fluctuation information storing unit and newly obtained rotation fluctuation information exceeds a tolerance.

According to an eleventh aspect of the present invention, in the third aspect, the control unit obtains the rotation fluctuation information again at predetermined timing.

According to a twelfth aspect of the present invention, in the third aspect, the control unit executes the driving control of the belt while obtaining the rotation fluctuation information.

According to a thirteenth aspect of the present invention, in the third aspect, the belt driving controller further includes a past information storing unit which stores past rotation fluctuation information of at least one round of the belt, and the control unit executes the driving control of the belt by using the past rotation fluctuation information stored in the past information storing unit and newly obtained rotation fluctuation information.

According to a fourteenth aspect of the present invention, there is provided a belt rotating device, which includes a belt that is wound around a plurality of sustaining rotation bodies including a driven sustaining rotation body that is rotated together with a movement of the belt and a driving sustaining rotation body that transmits driving force to the belt, a driving force source that generates the driving force to drive the belt, and a belt driving controller. The belt rotating device includes a detecting unit which detects at least one of rotation angle displacement or rotation angle velocities in two of the sustaining rotation bodies in the plural sustaining rotation bodies, in which two sustaining rotation bodies the diameters thereof are different from each other and/or the degrees to which PLDs (pitch line distances) of parts of the belt which wind around the two sustaining rotation bodies influence a belt moving velocity and the rotation angle velocities of the two sustaining rotation bodies are different from each other, and the belt driving controller is the belt driving controller as described in the first aspect.

According to a fifteenth aspect of the present invention, there is provided a belt rotating device, which includes a belt that is wound around a plurality of sustaining rotation bodies including a driven sustaining rotation body that is rotated together with a movement of the belt and a driving sustaining rotation body that transmits driving force to the belt, a driving force source that generates the driving force to drive the belt, and a belt driving controller. The belt rotating device includes a detecting unit which detects at least one of rotation angle displacement or rotation angle velocities in two of the sustaining rotation bodies in the plural sustaining rotation bodies, in which two sustaining rotation bodies the diameters thereof are different from each other and/or the degrees to which belt thicknesses of parts of the belt which wind around the two sustaining rotation bodies influence a belt moving velocity and the rotation angle velocities of the two sustaining rotation bodies are different from each other, and the belt driving controller is the belt driving controller as described in the second aspect.

According to sixteenth aspect of the present invention, in the fourteenth and the fifteenth aspects, the two sustaining rotation bodies are driven sustaining rotation bodies that are rotated together with the movement of the belt.

According to a seventeenth aspect of the present invention, in the sixteenth aspect, the driving force source includes a feedback control unit that feeds back the rotation angle displacement or the rotation angle velocity by detecting its own rotation angle displacement or rotation angle velocity.

According to an eighteenth aspect of the present invention, in the fourteenth and the fifteenth aspects, the driving sustaining rotation body is included in the two sustaining rotation bodies.

According to a nineteenth aspect of the present invention, in the fourteenth and the fifteenth aspects, the belt rotating device further includes a mark detecting unit which detects a mark showing a reference position on the belt so as to obtain a moved position of the belt from the reference position, and the control unit of the belt driving controller obtains the rotation fluctuation information at detecting timing by the mark detecting unit and executes the driving control of the belt.

According to a twentieth aspect of the present invention, in the fourteenth and the fifteenth aspects, the control unit of the belt driving controller obtains relationship information between a PLD fluctuation and the belt moved position based on an average time which the belt needs to move one round or a belt circumference length obtained beforehand and executes the driving control of the belt.

According to a twenty-first aspect of the present invention, in the fourteenth and the fifteenth aspects, a belt circumference direction distance between the two sustaining rotation bodies is set so that a difference caused by the approximation becomes within a predetermined tolerance.

According to a twenty-second aspect of the present invention, in the fourteenth and the fifteenth aspects, the belt has a seam at least at one position in the belt circumference direction.

According to a twenty-third aspect of the present invention, in the fourteenth and the fifteenth aspects, the belt has a plurality of layers in the belt thickness direction.

According to a twenty-fourth aspect of the present invention, in the fourteenth and the fifteenth aspects, at least one of the plural sustaining rotation bodies has a plurality of cogs in the rotating direction, and the belt has an engaging section which engages with the plural cogs.

According to a twenty-fifth aspect of the present invention, there is provided an image forming apparatus which provides a latent image carrier formed by a belt that is wound around a plurality of sustaining rotation bodies, a latent image forming unit that forms a latent image on the latent image carrier, a developing unit that develops the latent image on the latent image carrier, and a transferring unit that transfers an image developed by the developing unit to a recording medium. The image forming apparatus uses the belt rotating device described in the fourteenth or the fifteenth aspect as a belt rotating device that rotates the latent image carrier.

According to a twenty-sixth aspect of the present invention, there is provided an image forming apparatus which provides a latent image carrier, a latent image forming unit that forms a latent image on the latent image carrier, a developing unit that develops the latent image on the latent image carrier, an intermediate transfer body that is wound around a plurality of sustaining rotation bodies, a first transfer unit that transfers an image developed by the developing unit to the intermediate transfer body, and a second transfer unit that transfers the image on the intermediate transfer body on a recording medium. The image forming apparatus uses the belt rotating device described in the fourteenth or the fifteenth aspect as a belt rotating device that rotates the intermediate transfer body.

According to a twenty-seventh aspect of the present invention, there is provided an image forming apparatus, which provides a latent image carrier, a latent image forming unit that forms a latent image on the latent image carrier, a developing unit that develops the latent image on the latent image carrier, a recording medium carrying member formed by a belt that is wound around a plurality of sustaining rotation bodies, and a transfer unit that transfers an image developed by the developing unit on a recording medium carried by the recording medium carrying member via an intermediate transfer body or not via the intermediate transfer body. The image forming apparatus uses the belt rotating device described in the fourteenth or the fifteenth aspect as a belt rotating device that rotates the recording medium carrying member.

The inventors of the present invention found that the occupying ratio of PLD fluctuation components generated in the rotation angle velocities of the sustaining rotation bodies is different by differences of the sizes of the diameters of the sustaining rotation bodies, a winding angle of a belt to the sustaining rotation bodies, the belt layer structure, and so on, when the belt is moved endlessly. That is, when two sustaining rotation bodies are rotated on the same belt, the sizes of the PLD fluctuation components that are detected as rotation angle velocity fluctuations of the sustaining rotation bodies are different from each other. When the above differences are utilized, the PLD fluctuation can be specified from the rotation angle displacement or the rotation angle velocities of the two sustaining rotation bodies. Therefore, rotation control of a driving sustaining rotation body can be executed so that the fluctuation of the belt moving velocity caused by the fluctuation of the belt in the belt circumference direction becomes small, based on the detected results of the rotation angle displacement or the rotation angle velocities of the two sustaining rotation bodies. As the two sustaining rotation bodies, for example, there are two sustaining rotation bodies whose diameters are different and whose PLD fluctuation effective coefficients $\kappa$ are different. Strictly, as described below, there are two sustaining rotation bodies in which $\beta$ in Equation 8 is not 0 and G in Equation 29 is not 1 and the ratios between the roller effective radius R and the PLD fluctuation coefficient κ are different from each other.

According to the first aspect of the present invention, the PLD fluctuation can be specified by the detected results of the rotation angle displacement or the rotation angle velocities of the two sustaining rotation bodies. In addition, according to the second aspect of the present invention, the belt thickness fluctuation which has a high correlation with the PLD fluctuation in a case of a single layer belt can be specified by the detected results of the rotation angle displacement or the rotation angle velocities of the two sustaining rotation bodies. With this, a process which measures belt thickness non-uniformity in a belt manufacturing process is not needed, and the manufacturing cost is not increased. In addition, when the belt is changed to a new belt, it is not necessary to input belt thickness non-uniformity data in the apparatus. Further, since a pattern for detecting the fluctuation of the belt moving velocity is not needed, toner for belt driving control is not consumed. In addition, it is not necessary to know a state in which the PLD fluctuation or the belt thickness fluctuation is generated in one round of the belt beforehand. Further, for a belt having a partially large PLD fluctuation or belt thickness fluctuation which is difficult to be approximated in the precedent application, as described above, the PLD fluctuation or the belt thickness fluctuation can be specified at high accuracy.

In addition, according to the present invention, in the PLD fluctuation or the belt thickness fluctuation that is specified by the rotation angle displacement or the rotation angle velocities of the two sustaining rotation bodies, when the two sustaining rotation bodies are driven sustaining rotation bodies, the influence of a contacting state (degree) between the two sustaining rotation bodies and the belt is taken in consideration. On the other hand, the belt thickness non-uniformity measured by a belt thickness measuring instrument described in Patent Document 1 does not consider the influence of the contacting state between the sustaining rotation body and the belt at all. The belt thickness non-uniformity actually exists not only in the belt circumference direction but also in the belt width direction. When a belt in which the belt thickness non-uniformity also exists in the belt thickness direction is wound around the sustaining rotation bodies, a relationship between a moving velocity of a part of the belt which part winds around the sustaining body and the rotation angle velocity of the sustaining rotation body largely depends on the thickest part of the belt in the width direction. That is, the relationship between the moving velocity of the belt at the part and the rotation angle velocity of the sustaining rotation body is changed by the belt thickness non-uniformity at the part of the belt which part winds around the sustaining body in the belt width direction. That is because the thickest part of the belt in the width direction contacts the sustaining rotation body in a state in which friction with the sustaining rotation body is largest. Therefore, when the belt driving control is executed based on the belt thickness non-uniformity measured by the belt thickness measuring instrument which does not consider the contacting state between the sustaining rotation body and the belt, control errors caused by the belt thickness non-uniformity in the belt width direction are generated. On the contrary, according to the present invention, the belt driving control is executed based on the PLD fluctuation or the belt thickness fluctuation in which the contacting state between the sustaining rotation body and the belt is taken into consideration. Therefore, the control errors caused by the belt thickness non-uniformity in the belt width direction are not generated. Consequently, according to the present invention, the belt driving control can be executed at higher accuracy.

Especially, according to the first aspect of the present invention, since the PLD fluctuation which is the direct cause of the fluctuation of the belt moving velocity, accurate belt driving control can be executed in a belt such as a single layer belt, a plural-layer belt, and a belt having a special structure such as a belt having cogs or holes which is rotated in a state in which the cogs engage with cogs on a sustaining rotation body.

EFFECT OF THE INVENTION

According to embodiments of the present invention, the PLD fluctuation can be specified by the detected results of the rotation angle displacement or the rotation angle velocities of the two sustaining rotation bodies. In addition, according to the second aspect of the present invention, the belt thickness fluctuation which has a high correlation with the PLD fluctuation in a case of a single layer belt can be specified by the detected results of the rotation angle displacement or the rotation angle velocities of the two sustaining rotation bodies. With this, a process which measures belt thickness non-uniformity in a belt manufacturing process is not needed, and the manufacturing cost is not increased. In addition, when the belt is changed to a new belt, it is not necessary to input belt thickness non-uniformity data in the apparatus. Further, since a pattern for detecting the fluctuation of the belt moving velocity does not need, toner for belt driving control is not consumed. In addition, it is not necessary to know a state in which the PLD fluctuation or the belt thickness fluctuation is generated in one round of the belt beforehand. Further, for a belt having a partially large PLD fluctuation or belt thickness fluctuation which is difficult to be approximated in the precedent application, as described below, the PLD fluctuation or the belt thickness fluctuation can be specified at high accuracy.

In addition, according to the embodiments of the present invention, in the PLD fluctuation or the belt thickness fluctuation that is specified by the rotation angle displacement or the rotation angle velocities of the two sustaining rotation bodies, when the two sustaining rotation bodies are driven sustaining rotation bodies, the influence of a contacting state (degree) between the two sustaining rotation bodies and the belt is taken in consideration. On the other hand, the belt thickness non-uniformity measured by a belt thickness measuring instrument described in Patent Document 1 does not consider the influence of the contacting state between the sustaining rotation body and the belt at all. The belt thickness non-uniformity actually exists not only in the belt circumference direction but also in the belt width direction. When a belt in which the belt thickness non-uniformity also exists in the belt thickness direction is wound around the sustaining rotation bodies, a relationship between a moving velocity of a part of the belt which part winds around the sustaining body and the rotation angle velocity of the sustaining rotation body largely depends on the thickest part of the belt in the width direction. That is, the relationship between the moving velocity of the belt at the part and the rotation angle velocity of the sustaining rotation body is changed by the belt thickness non-uniformity at the part of the belt which part winds around the sustaining body in the belt width direction. This is because the thickest part of the belt in the width direction contacts the sustaining rotation body in a state in which friction with the sustaining rotation body is largest. Therefore, when the belt driving control is executed based on the belt thickness non-uniformity measured by the belt thickness measuring instrument which does not consider the contacting state between the sustaining rotation body and the belt, control errors caused by the belt thickness non-uniformity in the belt width direction are generated. On the contrary, according to the present invention, the belt driving control is executed based on the PLD fluctuation or the belt thickness fluctuation in which the contacting state between the sustaining rotation body and the belt is taken into consideration. Therefore, the control errors caused by the belt thickness non-uniformity in the belt width direction are not generated. Consequently, according to the present invention, the belt driving control can be executed at higher accuracy.

Especially, according to the embodiments of the present invention, since the PLD fluctuation which is the direct cause of the fluctuation of the belt moving velocity, accurate belt driving control can be executed in a belt such as a single layer belt, a plural-layer belt, and a belt having a special structure such as a belt having cogs or holes which is rotated in a state in which the cogs engage with cogs on a sustaining rotation body.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENTS

Best Mode of Carrying Out the Invention

A best mode of carrying out the present invention is described with reference to the accompanying drawings.

Figure 1:
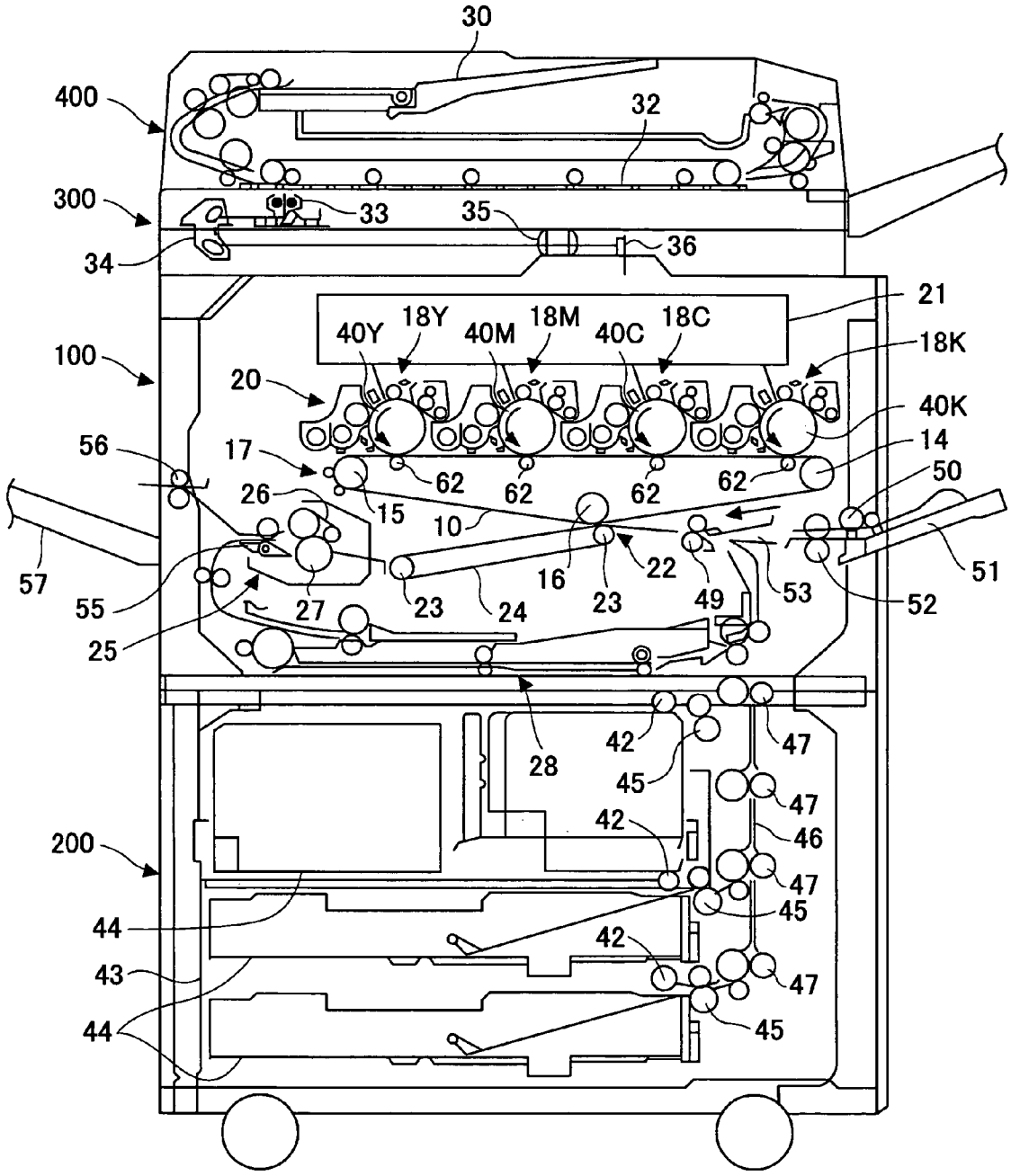
FIG. 1 is a diagram showing an outline of a structure of an image forming apparatus according to an embodiment of the present invention.

FIG. 1 is a diagram showing an outline of a structure of an image forming apparatus according to an embodiment of the present invention. Referring to FIG. 1, the structure of the image forming apparatus is explained. In FIG. 1, as the image forming apparatus, a copying machine is used, and the reference number 100 is a copying machine main body, the reference number 200 is a paper feeding table on which the copying machine main body 100 is installed, the reference number 300 is a scanner which is attached to the copying machine main body 100, and the reference number 400 is an ADF (automatic draft feeder) which is disposed on the scanner 300. The copying machine is an electro-photographic type copying machine of a tandem type which uses an intermediate transfer system (indirect transfer system).

An intermediate transfer belt 10 which is an intermediate transfer body as an image carrier is disposed in the center of the copying machine main body 100. The intermediate transfer belt 10 is wound around first through third sustaining rollers 14, 15, and 16, and is rotated in the clockwise direction in FIG. 1. An intermediate transfer belt cleaning mechanism 17, which removes remaining toner on the intermediate transfer belt 10 after transferring an image, is disposed at the left side of the second sustaining roller 15. A tandem type image forming section 20 in which a yellow image forming section 18Y, a magenta image forming section 18M, a cyan image forming section 18C, and a black image forming section 18K are arrayed is disposed so as to face a part of the intermediate transfer belt 10 which part is stretched between the first sustaining roller 14 and the second sustaining roller 15. In the present embodiment, the third sustaining roller 16 is a driving roller. In addition, an exposure 21, which is a latent image forming unit, is disposed above the tandem type image forming section 20.

Further, a secondary image transfer mechanism 22 is disposed under the intermediate transfer belt 10, that is, at the opposite side of the tandem type image forming section 20 viewed from the intermediate transfer belt 10. In the secondary image transfer mechanism 22, a secondary transfer belt 24, which carries a recording medium, is wound around two rollers 23. The secondary transfer belt 24 is pushed to the third sustaining roller 16 via the intermediate transfer belt 10. An image on the intermediate transfer belt 10 is transferred to a sheet which is a recording medium by the secondary image transfer mechanism 22. A fixing unit 25, which fixes the image transferred on the sheet, is disposed at the left side of the secondary image transfer mechanism 22. In the fixing unit 25, a pressure applying roller 27 is pushed to a fixing belt 26. The secondary image transfer mechanism 22 includes a sheet carrying mechanism for carrying the sheet on which the image is transferred to the fixing unit 25. The secondary image transfer mechanism 22 can include a transfer roller and a charger; however, in this case, it is difficult to include the sheet carrying mechanism. In addition, a sheet reversing mechanism 28, which reverses the sheet so as to record information on both sides of the sheet, is disposed under the secondary image transfer mechanism 22 and the fixing unit 25 and at a position parallel to the tandem type image forming section 20.

When a draft (manuscript) is copied by using the copying machine, the draft is put on a tray 30 of the ADF 400, or the draft is put on a contact glass 32 of the scanner 300 by opening the ADF 400 and is contacted by the contact glass 32 by closing the ADF 400. When a start switch (not shown) is pushed, the draft is carried to the contact glass 32 in a case where the draft is put on the tray 30 and the scanner 300 is driven. When the draft is put on the contact glass 32, the scanner 300 is immediately driven. Next, a first moving body 33 and a second moving body 34 are driven. The first moving body 33 emits light from a light source to the draft and reflects light reflected from the draft to the second moving body 34. The second moving body 34 inputs the light reflected from a mirror to a reading sensor 36 via a lens 35 and the contents of the draft are read at the reading sensor 36.

In parallel to the draft reading, the driving roller 16 (third sustaining roller) is driven to rotate by a driving motor (not shown). With this, the intermediate transfer belt 10 is rotated in the clockwise direction, and the first and second sustaining rollers 14 and 15 (driven rollers) are also rotated. At the same time, in the image forming section 18, photoconductor drums 40Y, 40M, 40C, and 40K which are latent image carriers are rotated, and on each of the photoconductor drums 40Y, 40M, 40C, and 40K, a single color toner image of corresponding color is formed by exposing and developing corresponding yellow, magenta, cyan, and black information. Toner images on the photoconductor drums 40Y, 40M, 40C, and 40K are sequentially superposed on the intermediate transfer belt 10, and then a color image is formed on the intermediate transfer belt 10.

In parallel to the image forming, one of paper feeding rollers 42 in the paper feeding table 200 is selectively rotated, and many sheets of paper are fed from one of paper feeding cassettes 44 disposed in plural in a paper bank 43. Each paper is separated by a separation roller 45 and is input in a paper feeding route 46 and is stopped at registration rollers 49. Alternatively, many sheets of paper are fed from a manually paper inputting tray 51 by rotating a paper feeding roller 50, and each paper is separated by a separation roller 52 and is input in a manually paper feeding route 53 and is stopped at the registration rollers 49. The registration rollers 49 are rotated by meeting the timing of the color image on the intermediate transfer belt 10, the paper is fed between the intermediate transfer belt 10 and the secondary image transfer mechanism 22, and the color image is transferred on the paper by the secondary image transfer mechanism 22. The paper on which the color image is transferred is carried to the fixing unit 25 by the secondary transfer belt 24, and the fixing unit 25 applies heat and pressure to the paper. When the color image is fixed on the paper, the direction of the paper is changed by a direction changing claw 55 and the paper is output by paper outputting rollers 56 and is stacked on a paper outputting tray 57. Alternatively, the direction of the paper is changed by the direction changing claw 55, the paper is reversed by inputting to the sheet reversing mechanism 28, and the paper is input to the transfer position again. After this, another image is recorded on the reverse side of the paper, and the paper is output on the paper outputting tray 57 by the paper outputting rollers 56.

After the image is transferred on the paper, the intermediate transfer belt cleaning mechanism 17 removes remaining toner on the intermediate transfer belt 10, and the intermediate transfer belt 10 is prepared for the next image forming by the tandem type image forming section 20. In this, the registration rollers 49 are generally grounded; however, a bias voltage can be applied to the registration rollers 49 so as to remove paper powders on the paper.

A black monochromatic copy can be obtained by using the copying machine. At this time, the intermediate transfer belt 10 is separated from the photoconductor drums 40Y, 40M, and 40C by a moving mechanism (not shown). The photoconductor drums 40Y, 40M, and 40C are temporarily stopped and only the photoconductor drum 40K for black is driven and is contacted by the intermediate transfer belt 10 so that a black image is formed.

Next, a structure of the intermediate transfer belt 10 according to the present embodiment is explained. In this, the following explanations are not limited to the intermediate transfer belt 10 and can be applied to various belts to which driving control is applied.

As the intermediate transfer belt 10, a single layer belt whose main material is fluorine contained resin, polycarbonate resin, polyimide resin, and so on; or a plural-layer elastic belt in which all layers or a part of the layers is made of an elastic material, is used. In addition to the intermediate transfer belt 10, a belt using in the image forming apparatus needs to perform plural functions. Recently, in order to perform the plural functions at the same time, a plural-layer belt having plural layers in the thickness direction of the belt is greatly used. For example, the intermediate transfer belt 10 needs to have plural properties such as, toner releasing ability, photoconductor nipping ability, durability, anti-tensile ability, high friction ability for a driving roller, low friction ability for a photoconductor body, and so on.

The toner releasing ability is necessary so as to increase transferring ability of a toner image from the intermediate transfer belt 10 to a recording medium and to increase cleaning ability for removing remaining toner on the intermediate transfer belt 10 after transferring the toner image to the recording medium.

The photoconductor nipping ability is necessary so as to increase transferring ability of a toner image to the intermediate transfer belt 10 by tightly fitting the photoconductor drums 40Y, 40M, 40C, and 40K thereto.

The durability is necessary because it makes the service life long by decreasing cracks and wearing in the passage of time and makes the running cost low.

The anti-tensile ability is necessary because it prevents the stretch of the intermediate transfer belt 10 in its circumference direction and accurately maintains the belt moving velocity and the belt moving position.

The high friction ability for a driving roller is necessary because it realizes the stable and high accurate movement of the intermediate transfer belt 10 by preventing the intermediate transfer belt 10 from being slid on the driving roller 16.

The low friction ability for a photoconductor body is necessary because it makes load fluctuation low due to generating sliding contact between the photoconductor drums 40Y, 40M, 40C, and 40K and the intermediate transfer belt 10 even when a velocity difference is generated therebetween.

In order to realize the above properties with a high level at the same time, an intermediate transfer belt of plural layers which is explained below is used.

Figure 17:
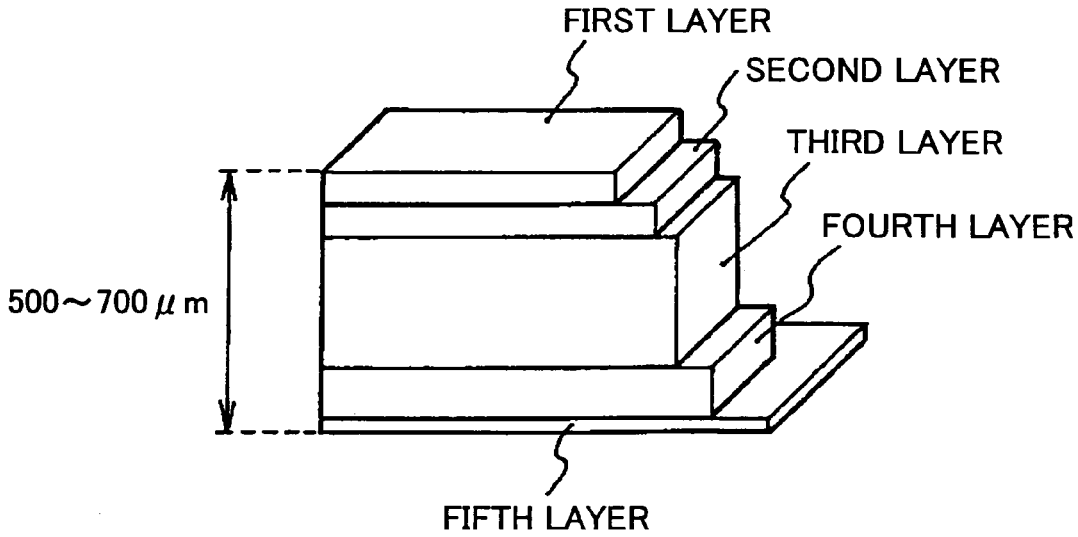
FIG. 17 is a diagram showing an example of a layer structure of the intermediate transfer belt.

FIG. 17 is a diagram showing an example of a layer structure of the intermediate transfer belt 10. In FIG. 17, the intermediate transfer belt 10 is an endless belt having a five-layer structure each layer of which is made of a different material, and the thickness of the belt is 500 to 700 μm or less. The intermediate transfer belt 10 is formed by a first layer, a second layer, a third layer, a fourth layer, and a fifth layer in the order from the belt surface which contacts the photoconductor drums.

The first layer is a coated layer to which polyurethane resin contained fluorine is applies. The low friction ability between the photoconductor drums 40Y, 40M, 40C, and 40K, and the intermediate transfer belt 10 and the toner releasing ability are realized by the first layer.

The second layer is a coated layer to which silicon-acrylic copolymer is applied and works to increase the durability of the first layer and to prevent the degradation of the third layer in the passage of time.

The third layer is a rubber layer (elastic layer) made of chloroprene of 400 to 500 μm thickness and the Young's modulus is 1 to 20 Mpa. Since the secondary transfer belt 24 is deformed by a partial rugged surface caused by toner image and recording medium lacking smoothness, the third layer works to restrain a drop of a letter without making transfer pressure excessively high for the toner image. In addition, since excellent tight fitting to the recording medium lacking smoothness can be obtained by the third layer, a transfer image having excellent homogeneity can be obtained.

The fourth layer is a polyvinylidene fluoride layer of approximately 100 μm thickness and prevents the stretching of the belt in the circumference direction. The Young's modulus is 500 to 1000 Mpa.

The fifth layer is a polyurethane coated layer and realizes a high friction coefficient with the driving roller 16.

In addition to the above materials for the layers, the following materials can be used. In the first and second layers, contamination to the photoconductor body caused by the elastic material must be prevented, toner adhering strength must be lowered by reducing surface friction resistance to the surface of the intermediate transfer belt 10 (for increasing cleaning property), and a toner image must be excellently transferred to a secondary transfer body. Therefore, one or more of polyurethane resin, polyester resin, and epoxy resin can be used for the first and second layers. Further, lubrication must be high by reducing the surface energy. Therefore, one or more of powders or particles of fluorine resin, fluorine compound, carbon fluoride, titanium dioxide, and silicon carbide can be dispersed in the layer; or the same kinds of the above material whose particle diameter is different can be dispersed in the layer. In addition, the surface energy can be reduced by forming a fluorine-rich layer on the surface by applying heat treatment which is used in a fluorine based rubber material.

For the third layer (elastic layer), one or more of the following materials can be used. The materials are butyl rubber, fluorine based rubber, acrylic rubber, EPDM, NBR, acrylonitrile-butadiene-styrene rubber natural rubber, isoprene rubber, styrene-butadiene rubber, butadiene rubber, ethylene-propylene rubber, ethylene-propylene-terpolymer, chloroprene rubber, chlorosulfonated polyethylene, chlorine polyethylene, polyurethane rubber, syndiotactic 1,2-polybutadiene, epichlorohydrine based rubber, silicone rubber, fluorine contained rubber, polysulfide rubber, polynorbornene rubber, hydrogen nitride rubber, thermoplastic elastomer (for example, polystyrene based, polyolefine based, polyvinyl chloride based, polyurethane based, polyamide based, polyurea based, polyester based, and fluorine resin based one).

For the fourth layer, one or more of the following materials can be used. The materials are polycarbonate, fluorine based resin (ETFE, PVDF), polystyrene, chloropolystyrene, poly-α-methylstyrene, styrene-butadiene copolymer, styrene-vinyl chrolide copolymer, styrene-vinyl acetate copolymer, styrene-maleic acid copolymer, styrene-acrylic ester copolymer (styrene-acrylic methyl copolymer, styrene-acrylic ethyl copolymer, styrene-acrylic butyl copolymer, styrene-acrylic octyl copolymer, and styrene-acrylic phenyl copolymer), styrene-methacrylic acid ester copolymer (styrene-methacrylic acid methyl copolymer, styrene-methacrylic acid ethyl copolymer, styrene-methacrylic acid phenyl copolymer), styrene based resin such as styrene-α-chloracryl acid methyl copolymer, styrene-acrylonitrile-acrylic ester copolymer (homopolymer or copolymer including styrene substitute), methacrylic acid methyl resin, methacrylic acid butyl resin, acrylic acid ethyl resin, acrylic acid butyl resin, modified acrylic resin (silicone modified acrylic resin, vinyl chloride resin modified acrylic resin, acrylic urethane resin), vinyl chloride resin, styrene-vinyl acetate copolymer, vinyl chloride-vinyl acetate copolymer, rosin modified maleic acid resin, phenol resin, epoxy resin, polyester resin, polyester-polyurethane resin, polyethylene, polypropylene, polybutadiene, polyvinylidene chloride, ionomer resin, polyurethane resin, silicone resin, ketone resin, ethylene-ethylacrylate copolymer, xylene resin, polyvinyl butyral resin, polyamide resin, and modified polyphenylene oxide resin.

As a method which prevents the stretching of the elastic belt, the fourth layer is formed by a material whose stretching is small, or a stretch preventing material is contained in the core layer of the fourth layer. However, the manufacturing method is not limited to a specific method.

As the material for the fourth layer, one or two or more of the following stretch preventing materials can be used. As the stretch preventing materials, there are natural fiber, synthetic fiber, inorganic fiber, and metal fiber. As the natural fiber, there are cotton, silk, and so on. As the synthetic fiber, there are polyester fiber, nylon fiber, acrylic fiber, polyolefine fiber, ppolyvinylalcohol fiber, polyvinyl chloride fiber, polyvinylidene chloride fiber, polyurethane fiber, polyacetal fiber, polyfluoroethylene fiber, phenol fiber, and so on. As the inorganic fiber, there are carbon fiber, glass fiber, boron fiber, and so on. As the metal fiber, there are iron fiber, cupper fiber, and so on. One or two or more of the above materials are fabricated to form cloth or yarn and the cloth or the yarn can be used for the fourth layer. However, the material is not limited to the above. In addition, as a method for twisting filaments of the fiber to form the yarn, there are a single twisting method, a double twisting method, plural-filaments twisting method, and so on; however, any of the methods can be used. Further, two or more of the above fibers can be mixed. Moreover, a conductive process can be applied to the yarn or the cloth. As a method for weaving the cloth by using the yarns, there are a knitting method and so on; however, any of the methods can be used.

When the core layer is formed in the fourth layer, the manufacturing method of the core layer is not limited to a specific method. For example, cloth which is woven in a cylindrical shape is set to a cylindrical die and a coat layer is formed on the cloth, or the cloth of the cylindrical shape is dipped in liquid rubber and so on and one side or both sides of the cloth are coated with coat layers, or a piece of yarn is spirally wound around a die with an arbitrary pitch and a coat layer is formed on the yarn.

A conductive material for adjusting a resistance value is contained in some layers. As the conductive materials, there are carbon black, graphite, metal powders made of, for example, aluminum, and nickel, and conductive metal oxides. As the conductive metal oxides, there are tin oxide, titanium oxide, antimony oxide, indium oxide, potassium titanate, composite oxide of antimony oxide-tin oxide (ATO), and composite oxide of indium oxide-tin oxide (ITO). The conductive metal oxides can be coated by insulation particles such as barium sulfate, magnesium silicate, calcium carbonate, and so on. The conductive materials are not limited to the above.

Figure 16:
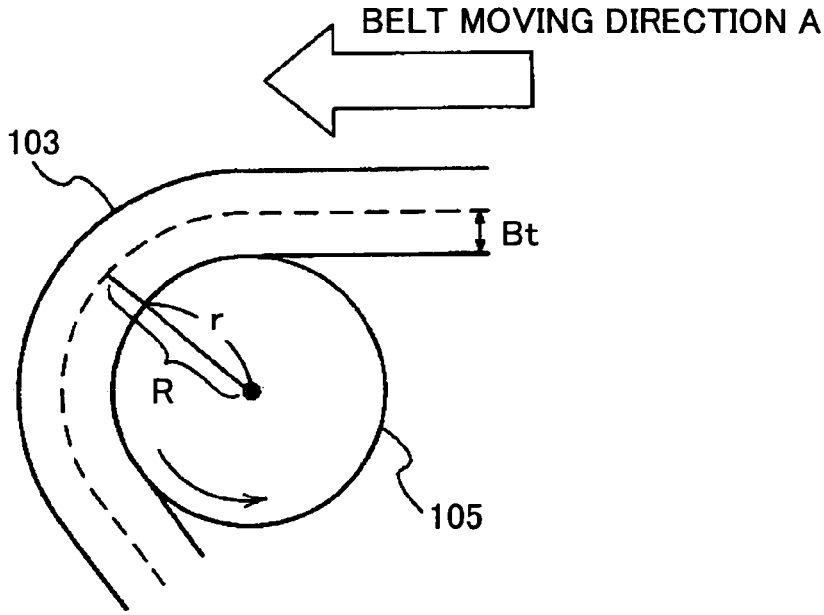
FIG. 16 is an enlarged view of a part where a part of a belt is wound around a driving roller viewed from the axle direction of the driving roller.

When the belt is a single layer belt whose material is uniform, since the stretching degrees of the inner and outer circumference surfaces of the belt are the same, as shown in FIG. 16, the belt pitch line which determines the belt moving velocity becomes the center in the belt thickness direction. However, when the belt is a plural-layer belt, the belt pitch line does not become the center in the belt thickness direction. In the plural-layer belt, when a layer whose Young's modulus is remarkably large exists in the plural layers, the belt pitch line exists at an approximately center part of the layer having the large Young's modulus. That is, in order to prevent the stretching of the belt in the belt circumference direction, the belt winds around the sustaining rollers so that the layer having the large Young's modulus becomes the core layer and other layers are stretched or contracted. In this, the layer having the large Young's modulus is called an anti-tensile layer. In the above intermediate transfer belt 10, since the fourth layer (anti-tensile layer) has an extremely large Young's modulus, the belt pitch line exists in the fourth layer. When such an anti-tensile layer whose Young's modulus is extremely high exists in the belt, the thickness non-uniformity of the anti-tensile layer in the belt circumference direction largely influences the fluctuation of the PLD (pitch line distance). That is, in the plural-layer belt, the PLD is determined while being influenced by a layer having a large Young's modulus in the plural layers.

In addition, when the position of the fourth layer (anti-tensile layer) is displaced in the belt thickness direction around the belt one round, the PLD fluctuates. For example, when the fifth layer which exists between the fourth layer and the sustaining rollers has thickness non-uniformity, the position of the fourth layer in the thickness direction changes corresponding to the thickness non-uniformity of the fifth layer, and the PLD fluctuates.

Further, in a case of an endless belt having a seam (seam belt), in many cases, the endless belt is manufactured by the following processes. That is, first, a sheet of polyvinylidene fluoride for the fourth layer is formed, and the ends of the sheet are overlapped by approximately 2 mm and the ends are bonded by fusing the sheet. Then, the endless sheet is formed and other layers are formed on the endless sheet sequentially. In this case, since the material property of the bonded part is changed by fusing and the stretching degree of the bonded part becomes different from the other parts, even if the thickness of the bonded part is the same as that of the other parts, the PLD of the bonded part is largely different from that of the other parts. Even when the belt thickness non-uniformity does not exist at such a part, the PLD fluctuation occurs and when the part is wound around the driving roller, the belt velocity fluctuation occurs. In this, in manufacturing a seamless belt, a proper die is required depending on its circumference distance; however, since the seam belt does not need a die and the belt circumference length can be easily adjusted without having a die, manufacturing cost can be lowered.

Next, driving control of the intermediate transfer belt 10, which is a major feature of the present invention, is explained.

In the copying machine according to the embodiment of the present invention, the intermediate transfer belt 10 must be moved at a constant velocity. However, actually, the belt moving velocity fluctuates caused by component specification differences, environment changes, and a change in the passage of time. When the belt moving velocity of the intermediate transfer belt 10 fluctuates, an actual belt moving position shifts from a target belt moving position, and the tip position of a toner image on each of the photoconductor drams 40Y, 40M, 40C, and 40K shifts on the intermediate transfer belt 10; consequently, color registration errors are generated. In addition, in a case where a toner image is transferred on the intermediate transfer belt 10 when the belt moving velocity is relatively fast, the toner image transferred on the intermediate transfer belt 10 is enlarged from the original image in the belt circumference direction; on the contrary, in a case where a toner image is transferred on the intermediate transfer belt 10 when the belt moving velocity is relatively slow, the toner image transferred on the intermediate transfer belt 10 is reduced from the original image in the belt circumference direction. In this case, in an image formed on a recording medium, periodic banding (image density errors) appears in the direction orthogonal to the belt circumference direction.

In order to solve this problem, operations and a structure in which the intermediate transfer belt 10 is maintained at a constant velocity at high accuracy is explained. In this, the following explanations are not limited to the intermediate transfer belt 10 and can be applied to various belts to which driving control is applied.

In the present embodiment, in two rollers whose diameters are different from each other, or/and in two rollers in which the influencing degrees of the PLDs of belt parts wound around the two rollers on a relationship between the belt moving velocity and the two rollers rotation angle velocities are different from each other, two rotation angle velocities $\omega_1$ and $\omega_2$ of the two rollers are continuously detected. Then, the PLD fluctuation f(t) is obtained form the two rotation angle velocities $\omega_1$ and $\omega_2$. In this, in a case of a single layer belt, the PLD has a constant relationship with the belt thickness and the PLD fluctuation has a constant relationship with the belt thickness fluctuation. Therefore, in two rollers whose diameters are different from each other, or/and in two rollers in which the influencing degrees of the belt parts wound around the two rollers to a relationship between the belt moving velocity and the rotation angle velocities are different from each other, two rotation angle velocities of the two rollers are continuously detected. Then, the belt thickness fluctuation can be obtained from the two rotation angle velocities. The PLD fluctuation f(t) is a periodic function which shows a time change of the PLD at a belt part which passes through a specific point on a belt moving route while the belt moves around. As described above, since the PLD fluctuation f(t) largely influences the belt moving velocity V, the PLD fluctuation f(t) is obtained from the two rotation angle velocities $\omega_1$ and $\omega_2$ of the two sustaining rollers at high accuracy. When belt driving control is executed based on the obtained PLD fluctuation f(t), the belt moving velocity V can be controlled at high accuracy.

As the method for obtaining the PLD fluctuation f(t) at high accuracy, three methods are explained in the present embodiment. The first method is a recognition method 1 of the PLD fluctuation in which the two rollers are disposed closely in the belt moving direction. The second method is a recognition method 2 of the PLD fluctuation in which a filter process is executed which process does not influence the disposing relationship of the two rollers. The third method is a recognition method 3 of the PLD fluctuation in which a filter process is executed by setting so that the disposing relationship of the two rollers (belt carrying distance between the two rollers) is 1/an integer of one round of the belt.

[Recognition Method 1 of PLD Fluctuation]

Figure 2:
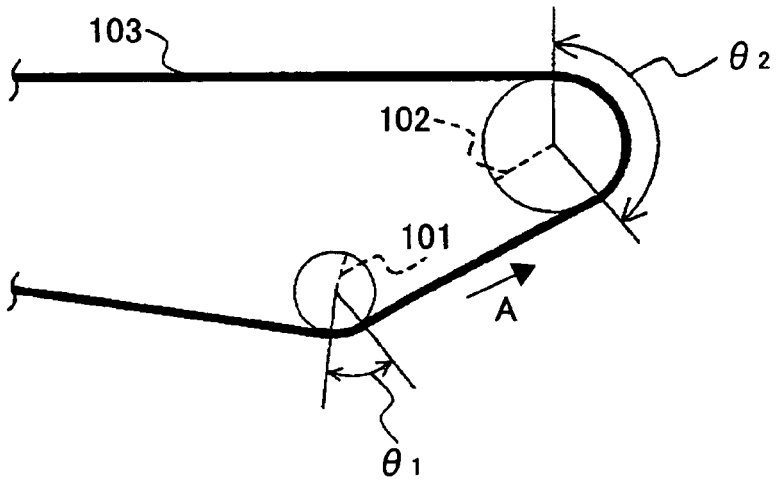
FIG. 2 is a schematic diagram showing a main part of a belt rotating device according to the embodiment of the present invention.

FIG. 2 is a schematic diagram showing a main part of a belt rotating device according to the embodiment of the present invention. The belt rotating device includes a belt 103 and a first roller 101 and a second roller 102 around which the belt 103 is wound and rotated. The belt 103 is wound around the first roller 101 with a belt winding angle $\theta_1$ and is wound around the second roller 102 with a belt winding angle $\theta_2$. The belt 103 endlessly moves in the arrow direction A shown in FIG. 2. A rotary encoder (not shown) which is a detecting unit is disposed in each of the first roller 101 and the second roller 102. The rotary encoders detect the rotation angle displacement or the rotation angle velocity of the corresponding first roller 101 and the corresponding second roller 102. In the present embodiment, the rotary encoders detect the rotation angle velocity $\omega_1$ of the first roller 101 and the rotation angle velocity $\omega_2$ of the second roller 101 and $\omega_2$, respectively.

As the rotary encoder, an existing optical encoder or an existing magnetic encoder can be used. In the optical encoder, for example, timing marks are formed with a constant interval on a concentric circle of a disk made of a transparent material such as transparent glass or transparent plastic, and disks are coaxially secured to the first roller 101 and the second roller 102 and the timing marks are optically detected. In the magnetic encoder, for example, timing marks are recorded magnetically on a concentric circle of a magnetic disk, and disks are coaxially secured to the first roller 101 and the second roller 102 and the timing marks are detected by magnetic heads. In addition, as the rotary encoder, a tachometer generator can be used. In the present embodiment, for example, a time interval of pluses output continuously from the rotary encoder is measured and the rotation angle velocity is obtained from a reciprocal of the measured time interval. In this, the rotation angle displacement can be obtained by counting the number of pulses continuously output from the rotary encoder.

The relationship between the rotation angle velocity $\omega_1$ of the first roller 101 and the belt moving velocity V is shown in Equation 3. The relationship between the rotation angle velocity $\omega_2$ of the second roller 102 and the belt moving velocity V is shown in Equation 4.

$$V=\{R_1+\kappa_1 f(t)\}\omega_1 \quad \text{[Equation 3]}$$

$$V=\{R_2+\kappa_2 f(t-\tau)\}\omega_2 \quad \text{[Equation 4]}$$

Where, $R_1$ is the roller effective radius of the first roller 101 and $R_2$ is the roller effective radius of the second roller 102.

In addition, "$\kappa_1$" is a PLD fluctuation effective coefficient of the first roller 101 which is determined by the belt winding angle $\theta_1$, the belt material, the belt layer structure, and so on of the first roller 101, and is a parameter which determines the influencing degree of the PLD on the belt moving velocity V. Similarly, "$\kappa_2$" is a PLD fluctuation effective coefficient of the second roller 102. In Equation 3 and Equation 4, different PLD fluctuation effective coefficients "$\kappa_1$" and "$\kappa_2$" are used. The reason is as follows. Since the belt winding state (deformation curvature) is different and the belt winding amount is different between the first roller 101 and the second roller 102, in some cases, the influencing degree of the PLD fluctuation to the relationship between the belt moving velocity (belt moving amount) and the rotation angle velocity (rotation angle displacement) of the roller is different between the first roller 101 and the second roller 102. In this, when a single layer belt whose material is uniform is used and the belt winding angles $\theta_1$ and $\theta_2$ are sufficiently large, the PLD fluctuation effective coefficients "$\kappa_1$" and "$\kappa_2$" become the same value.

The PLD fluctuation f(t) is a periodic function which shows a fluctuation in time of the PLD of a part of a belt which passes through a specific point on the belt moving route and has the same period of the belt which moves around one round, and shows a deviation from the average $PLD_{ave}$ of the PLDs in the belt circumference direction around the belt one round. In this, the specific point is a position where the belt 103 winds around the first roller 101.

Therefore, when the time t=0, the PLD fluctuation amount of the part of the belt where the belt 103 winds around the first roller 101 becomes f(0). In this, as the function of the PLD fluctuation, instead of the time function f(t), the above described function f(d) can be used. The functions f(t) and f(d) can be mutually converted.

Further, "$\tau$" is the average time that the belt 103 moves from the first roller 101 to the second roller 102, and is called "delay time". The delay time "$\tau$" means a phase difference between the PLD fluctuation f(t) at a part where the belt 103 winds around the first roller 101 and the PLD fluctuation $f(t-\tau)$ at a part where the belt 103 winds around the second roller 102.

It is difficult to obtain the average value of the PLDs ($PLD_{ave}$) from only the belt layer structure and the material and property of each layer. However, for example, the $PLD_{ave}$ can be obtained from an average value of the belt moving velocities by executing a simple test which drives the belt. That is, when a driving roller is driven by a constant rotation angle velocity, the average value of the belt moving velocities is {(driving roller radius $r+PLD_{ave}$)×constant rotation angle velocity of driving roller $\omega_{01}$}. Further, when the driving roller is driven by a constant rotation angle velocity, the average value of the belt moving velocities can be obtained from "belt circumference length"/"belt moving time of one round". The belt circumference length and the belt moving time of one round can be accurately measured. Therefore, when the driving roller is driven by a constant rotation angle velocity, the average value of the belt moving velocities can be also calculated accurately. In addition, since the driving roller radius r and the constant rotation angle velocity of driving roller $\omega_{01}$ can be accurately obtained, the $PLD_{ave}$ can be also calculated accurately. In this, the calculating method of the $PLD_{ave}$ is not limited to the above method.

Since the belt moving velocity V of a part where the belt winds around the second roller 102 at the time "t" is the same as the belt moving velocity V of a part where the belt winds around the second roller 102 at the time "t", Equation 5 can be obtained from Equation 3 and Equation 4.

$$\omega_2 = \frac{\{R_1 + \kappa_1 f(t)\}}{\{R_2 + \kappa_2 f(t-\tau)\}}\omega_1 \quad \text{[Equation 5]}$$

Since the PLD fluctuation f(t) is small enough for the roller effective radiuses $R_1$ and $R_2$, Equation 5 can be approximated to Equation 6.

$$\omega_2 \cong \frac{R_1}{R_2}\omega_1 + \frac{R_1}{R_2}\omega_1\left\{\frac{\kappa_1}{R_1}f(t) - \frac{\kappa_2}{R_2}f(t-\tau)\right\} \quad \text{[Equation 6]}$$

In the recognition method 1, the first roller 101 and the second roller 102 are disposed closely in the belt moving direction. That is, when the first roller 101 and the second roller 102 are disposed closely so that the delay time "τ" becomes small enough, the f(t) can be approximated as f(t−τ). The condition (tolerance) of the delay time "τ" in the approximation is described below. When the approximation f(t)=f(t−τ) is established, Equation 6 becomes Equation 7.

$$\omega_2 \cong \frac{R_1}{R_2}\omega_1 + \frac{R_1}{R_2}\omega_1\left(\frac{\kappa_1}{R_1} - \frac{\kappa_2}{R_2}\right)f(t) \quad \text{[Equation 7]}$$

As shown in Equation 7, the PLD fluctuation f(t) can be obtained from the rotation angle velocity $\omega_1$ of the first roller 101 and the rotation angle velocity $\omega_2$ of the second roller 102 at the time "t". Especially, when the driving control for the belt 103 is executed so that the rotation angle velocity $\omega_1$ of the first roller 101 becomes constant, since the $\omega_1$ is constant, the PLD fluctuation f(t) can be obtained by detecting only the rotation angle velocity $\omega_2$ of the second roller 102. In addition, it is possible that correction control is applied to all fluctuation frequency components including in the PLD fluctuation f(t), obtained from passing through a noise removing filter by assuming that noise exists. However, the correction control can be accurately executed within an error tolerance in frequency components in which the delay time "τ" is ignored, from the relationship between a period of a fluctuation frequency component and the delay time "τ".

From Equation 7, recognition sensitivity β of the PLD fluctuation f(t) is shown by Equation 8.

$$\beta = \frac{\kappa_1}{R_1} - \frac{\kappa_2}{R_2} \quad \text{[Equation 8]}$$

As shown in Equation 8, the recognition sensitivity β of the PLD fluctuation f(t) is a difference value between a value in which the PLD fluctuation effective coefficient $\kappa_1$ is divided by the $R_1$ which is the roller effective radius ($r+PLD_{ave}$) of the first roller 101 and the PLD fluctuation effective coefficient $\kappa_2$ is divided by the $R_2$ which is the roller effective radius ($r+PLD_{ave}$) of the second roller 102. Therefore, the larger the difference value is, the higher the recognition sensitivity β is. Actually, since the roller radius r is relatively much larger than the $PLD_{ave}$, the recognition sensitivity β becomes a difference value between a value in which the PLD fluctuation effective coefficient $\kappa_1$ is divided by the roller radius $r_1$ of the first roller 101 and the PLD fluctuation effective coefficient κ2 is divided by the roller radius $r_2$ of the second roller 102. Since the recognition sensitivity β does not relates to a plus or a minus sign of the value but to the absolute value, when the above ratio is different, any one of the diameters of the first roller 101 and the second roller 102 can be made relatively large, or any one of the PLD fluctuation effective coefficients can be made relatively large.

In order to adjust the PLD fluctuation effective coefficients $\kappa_1$ and $\kappa_2$, when the belt winding angles $\theta_1$ and $\theta_2$ are made small, the belt 103 is likely to slide on the roller. In this case, the relationship between the belt moving velocity and the roller rotation angles becomes unstable. In order to solve this, it is preferable that the belt winding angles $\theta_1$ and $\theta_2$ be sufficiently large. Therefore, when the recognition sensitivity β of the PLD fluctuation f(t) is attempted to be made sufficiently large, it is preferable to adjust the roller radius "r" instead of adjusting the PLD fluctuation effective coefficients $\kappa_2$ and $\kappa_2$. Therefore, it is preferable that the roller radiuses "r" of the first roller 101 and the second roller 102 be determined so that the recognition sensitivity β becomes sufficiently large by making the belt winding angles $\theta_1$ and $\theta_2$ of the first roller 101 and the second roller 102 sufficiently large, and making the PLD fluctuation effective coefficients $\kappa_2$ and $\kappa_2$, equal to each other.

In the present embodiment, in order to obtain the PLD fluctuation f(t) at high accuracy, the diameters of the first roller 101 and the second roller 102 are selected to be sufficiently large and different from each other. Then, the rotation angle velocities $\omega_1$ and $\omega_2$ around one round, obtained from the output results of the rotary encoders disposed in the first roller 101 and the second roller 102, are input in Equation 7, and then the PLD fluctuation F(t) is obtained. When the PLD fluctuations f(t) around plural rounds are obtained and the obtained results are averaged, a more accurate PLD fluctuation f(t) can be obtained.

Especially, when the rotation angle velocity $\omega_1$ of the first roller 101 is a constant $\omega_{o1}$, since the $\omega_1$ in Equation 7 becomes a constant, Equation 9 can be obtained. In this case, operations to obtain the PLD fluctuation f(t) become simple. That is, based on rotation information in which the rotation angle velocity of the first roller 101 is a constant, the PLD fluctuation f(t) is obtained from rotation information detected from the second roller 102. Specifically, by using an output from the rotary encoder of the first roller 101, driving control for the belt 103 is executed so that the rotation angle velocity $\omega_1$ becomes a constant $\omega_{o1}$. Next, by using an output from the rotary encoder of the second roller 102, the rotation angle velocity $\omega_2$ of the second roller 102 is input in Equation 9 and the PLD fluctuation f(t) is obtained. In this, by making the rotation angle velocity $\omega_2$ of the second roller 102 a constant $\omega_{o2}$, and the PLD fluctuation f(t) is obtained from an output of the rotary encoder of the first roller 101. This is also possible.

$$\omega_2 \cong \frac{R_1}{R_2}\omega_{01} + \frac{R_1}{R_2}\omega_{01}\left(\frac{\kappa_1}{R_1} - \frac{\kappa_2}{R_2}\right)f(t) \quad \text{[Equation 9]}$$

When one of the rollers 101 and 102 is selected as a roller whose rotation angle velocity is a constant and selected one is made to be a driving roller whose driving source is a stepping motor or a DC servo motor, the rotary encoder is installed only in the other roller. That is, in this case, there is an advantage in that only one rotary encoder is required. However, the driving roller is likely to slide on the belt 103; in addition, when a gear exists in a driving force transmission route, the rotation angle velocity of the driving roller may fluctuate caused by driving force transmission errors. Consequently, the recognition accuracy for the PLD fluctuation f(t) may decrease. Therefore, when the PLD fluctuation f(t) is attempted to be obtained at high accuracy, it is preferable that the first roller 101 and the second roller 102 be driven rollers.

Next, the condition (tolerance) of the delay time "τ" is described. The delay time "τ" is determined by a distance in the belt circumference direction between the first roller 101 and the second roller 102 (distance between rollers) and an average value of the belt moving velocities. In many cases, the average value of the belt moving velocities cannot be easily changed depending on the feature of an apparatus to which the present belt rotating device is installed and a relationship with other devices which are installed in the apparatus. Therefore, in the present embodiment, a method to determine the distance between rollers is described.

When the f(t) is approximated to the f(t−τ) as described in the recognition method 1, a difference occurs between the PLD fluctuation f(t) by the recognition method 1 and an actual PLD fluctuation; however, when the fluctuation of the belt moving velocity of the belt 103 and the shift of the belt moving position caused by the difference are within the tolerance, this is not a problem in actual usage.

The $n^{th}$ harmonic component $f_n(t)$ of the PLD fluctuation f(t) can be expressed by Equation 10. In Equation 10, "ΔBn" is amplitude of the $n^{th}$ harmonic component, "$\omega_n$" is an angular frequency of the $n^{th}$ harmonic component, and "$\alpha_n$" is a phase of the $n^{th}$ harmonic component.

$$f_n(t)=\Delta Bn\sin(\omega_n t+\alpha_n) \quad \text{[Equation 10]}$$

In a case where the $n^{th}$ harmonic component $f_n(t)$ exists in the PLD fluctuation f(t), when the belt driving control is executed so that the first roller 101 is rotated by the constant rotation angle velocity $\omega_{01}$, the rotation angle velocity $\omega_2$ of the second roller 102 is expressed by Equation 11 changed from Equation 6.

$$\omega_2 \cong \frac{R_1}{R_2}\omega_{01} + \frac{R_1}{R_2}\omega_{01}\left[\frac{\kappa_1}{R_1}\Delta Bn\sin(\omega_n t+\alpha_n) - \frac{\kappa_2}{R_2}\Delta Bn\sin\{\omega_n(t-\tau)+\alpha_n\}\right] \quad \text{[Equation 11]}$$

When the fluctuation component of the rotation angle velocity $\omega_2$ of the second roller 102 (the right side second term of Equation 11) is set to $\Delta\omega_2$, the fluctuation component $\Delta\omega_2$ is expressed by Equation 12 by calculating the inside of the bracket of the right side second term.

$$\Delta\omega_2 = \frac{R_1}{R_2}\omega_{01}\Delta BnK\sin(\omega_n t+\alpha_n+P) \quad \text{[Equation 12]}$$

where "K" shows in Equation 13 and "P" shows in Equation 14.

$$K = \sqrt{\left(\frac{\kappa_1}{R_1}\right)^2 + \left(\frac{\kappa_2}{R_2}\right)^2 - 2\frac{\kappa_1\kappa_2}{R_1R_2}\cos(\omega_n\tau)} \quad \text{[Equation 13]}$$

$$P = \tan^{-1}\left\{\frac{\kappa_2/R_2\sin(\omega_n\tau)}{\kappa_1/R_1-\kappa_2/R_2\cos(\omega_n\tau)}\right\} \quad \text{[Equation 14]}$$

In the recognition method 1, since the approximation f(t) =f(t−τ) is used, the $n^{th}$ harmonic component $f_n(t)$ is also approximated to $f_n(t-\tau)$. When the approximation of the $f_n(t)$ is determined as $f_n'(t)$, the fluctuation component $\Delta\omega_2$ is obtained in Equation 15 by using Equation 9.

$$\Delta\omega_2 = \frac{R_1}{R_2}\omega_{01}\left(\frac{\kappa_1}{R_1}-\frac{\kappa_2}{R_2}\right)f_n'(t) \quad \text{[Equation 15]}$$

That is, the approximated $n^{th}$ harmonic component $f_n'(t)$ is obtained in Equation 16 by using Equations 12 and 15.

$$f_n'(t) = \Delta BnK\sin(\omega_n t+\alpha_n+P)\Big/\left(\frac{\kappa_1}{R_1}-\frac{\kappa_2}{R_2}\right) \quad \text{[Equation 16]}$$

In a case where a target rotation angle velocity $\omega_{1c}$, when the rotation angle velocity $\omega_1$ of the first roller 101 is controlled so that the belt moving velocity is a constant, is obtained by using the PLD fluctuation f(t) obtained in the recognition method 1, the target rotation angle velocity $\omega_{1c}$ is shown in Equation 17.

$$\omega_{1c} = \frac{\omega_{1a}R_1}{\{R_1+\kappa_1 f(t)\}} \quad \text{[Equation 17]}$$

where "$\omega_{1a}$" is a target rotation angle velocity of the first roller 101. When the PLD fluctuation does not exist and the belt moving velocity is a constant $V_0$, $V_0=R_1\times\omega_{1a}$.

When a component which corrects the PLD fluctuation f(t) of the target rotation angle velocity $\omega_{1c}$ of the first roller 101 is set as $\Delta\omega_{1c}$, and Equation 17 is changed, and Equation 18 is obtained.

$$\Delta\omega_{1c} = -\frac{\kappa_1\omega_{1a}}{R_1}f(t) \quad \text{[Equation 18]}$$

In this, the $n^{th}$ harmonic component $f_n(t)$ of the PLD fluctuation f(t) shown in Equation 18 is the one originally shown in Equation 10; however, in the recognition method 1, the approximated $n^{th}$ harmonic component $f_n'(t)$ obtained from Equation 16 is used. At this time, an error component of a control target value $\Delta\omega_{1c_err}$ is shown in Equation 19.

$$\Delta\omega_{1c_err} = -\frac{\kappa_1\omega_{1a}}{R_1}\{f_n'(t)-f_n(t)\} \quad \text{[Equation 19]}$$

When Equation 19 is changed by inputting the $n^{th}$ harmonic component $f_n(t)$ shown in Equation 10 and the approximated $n^{th}$ harmonic component $f_n'(t)$ shown in Equation 16, Equation 20 is obtained.

$$\Delta\omega_{1c_err} = -\frac{\kappa_1\omega_{1a}\Delta Bn}{R_1}\{E\sin(\omega_n t+C)\} \quad \text{[Equation 20]}$$

where "E" is shown in Equation 21 and "C" is shown in Equation 23 and is a constant showing an initial phase, and "A" in Equation 21 is shown in Equation 22.

$$E = \sqrt{A^2 - 2A\cos P + 1} \quad \text{[Equation 21]}$$

$$A = K \Big/ \left(\frac{\kappa_1}{R_1} - \frac{\kappa_2}{R_2}\right) \quad \text{[Equation 22]}$$

$$C = \tan^{-1}\frac{\sin P}{1/A - \cos P} \quad \text{[Equation 23]}$$

When Equation 20 is converted into the error $V_{1C_err}$ of the belt moving velocity, Equation 24 is obtained.

$$\Delta V_{1c_err} = \kappa_1 \omega_{1a} \Delta Bn\{E\sin(\omega_n t + C)\} \quad \text{[Equation 24]}$$

As described above, in the recognition method 1, the error $V_{1c_err}$ of the belt moving velocity is generated by the delay time $\tau$ determined by the distance between rollers. Therefore, even if the belt moving velocity fluctuation caused by the PLD fluctuation is attempted to be restrained by the recognition method 1, a slight belt moving velocity fluctuation remains. Generally, the belt moving velocity fluctuation is caused not only by the PLD fluctuation but also eccentricity and accumulated pitch errors of gears in the driving force transmission route. Consequently, the tolerance of the belt moving velocity fluctuation caused by the PLD fluctuation is a tolerance of the pLD fluctuation in designing. As described above, in the driving control of the intermediate transfer belt 10 of the copying machine in the present embodiment, the color registration errors and the banding occur caused by the belt moving velocity fluctuation. When an actual belt moving position is shifted from a target belt moving position, the belt moving velocity fluctuation occurs. When the shifting amount of the belt moving position becomes large, the belt moving velocity fluctuation becomes large. The color registration errors and the banding of the image on the recording medium are noticed by a user. For example, in the case of the banding, the tolerance of an actual unnoticeable level can be defined as a spatial frequency "fs" which shows a changing interval (distance) of the image density. The spatial frequency "fs" has a relationship with a time frequency "f"; f=F×fs (F is a constant). Therefore, when the tolerance of the banding is determined by the tolerance of the spatial frequency, the tolerance of the shifting amount of the belt moving position can be defined. Consequently, the tolerance of the belt moving velocity fluctuation can be defined.

The shifting amount $X_{errT}$ of the belt moving position obtained by an approximation in the recognition method 1, can be obtained by Equation 25. That is, an integration of Equation 24 showing the belt moving velocity error $V_{1c_err}$ caused by using the $n^{th}$ harmonic component $f_n'$ (t) is operated, and further, the integration results are added in the range from the $1^{st}$ to the $n^{th}$ frequency components.

$$X_{errT} = \sum_{1}^{i} \kappa_1 \frac{\omega_{1a}}{\omega_n} \Delta Bn\{E\cos(\omega_n t + C)\} \quad \text{[Equation 25]}$$

where "i" shows an ordinal number of a frequency component existing in the PLD fluctuation f(t).

In a case where the tolerance of the banding which is unnoticeable by a person is obtained, in each frequency component which the PLD fluctuation f(t) has, the shifting amount $X_{errT}$ of the belt moving position is set to a tolerable position shifting amount $X_{err}$ shown in Equation 26 or less, which is allotted to the belt moving velocity fluctuation by the PLF fluctuation. Therefore, the delay time $\tau$, the diameters of the first roller 101 and the second roller 102, and the winding angle relating to the PLD fluctuation effective coefficient $\kappa$ are determined so that the maximum value (amplitude) of each frequency component shown in Equation 25 becomes the tolerable position shifting amount $X_{err}$. In a case where each toner image formed in each photoconductor drum of plural drams is superposed, when the shifting amount $X_{errT}$ of the belt moving position shown in Equation 25 occurs, the color registration errors are generated. The tolerable position shifting amount $X_{err}$ of each frequency component is also determined by the restriction by the color registration errors.

$$X_{err} = \kappa_1 \frac{\omega_{1a}}{\omega_n} \Delta Bn \sqrt{A^2 - 2A\cos P + 1} \quad \text{[Equation 26]}$$

Specifically, the diameter ratio between the first roller 101 and the second roller 102 is determined as 2, that is, it is determined that the diameter of the first roller 101 is Φ 30 and the diameter of the second roller 102 is Φ 15 and the PLD fluctuation effective coefficients $\kappa_1$ and $\kappa_2$ of these rollers is 0.5. In addition, the circumference length of the belt 103 is determined as 100 mm which is generally used in the intermediate transfer belt 10 of the tandem type image forming apparatus. Then, an influence for only the first component in the PLD fluctuation frequency components is obtained.

Figure 3:
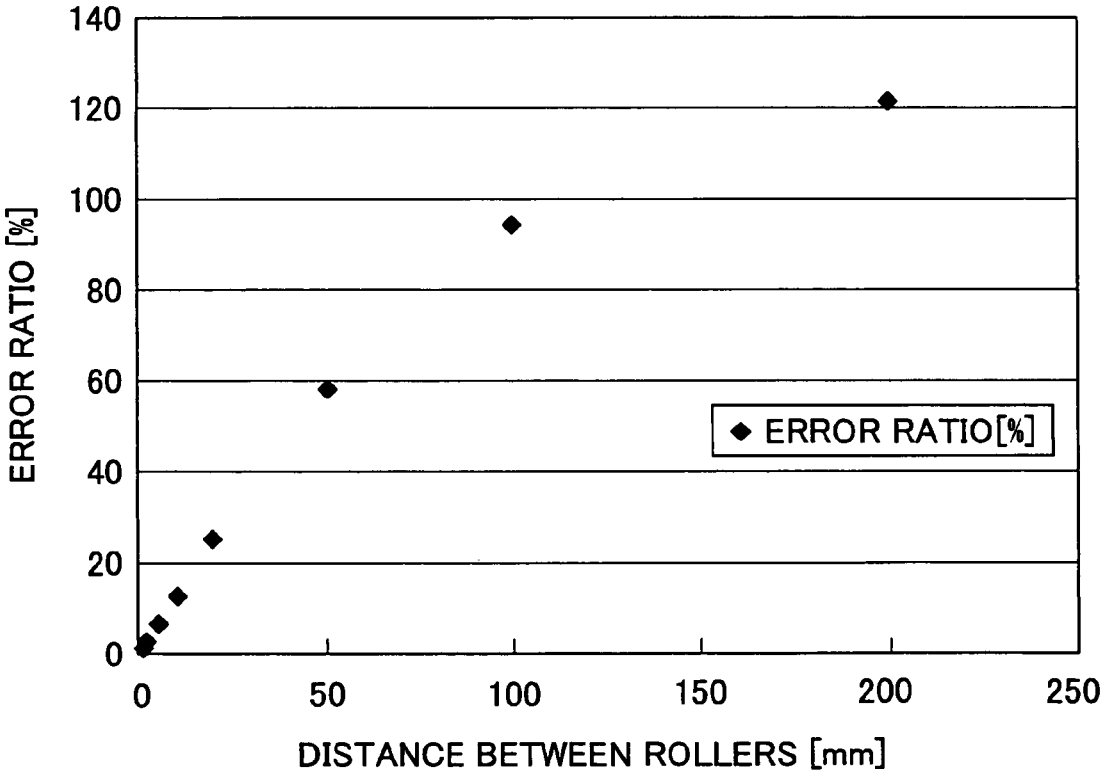
FIG. 3 is a graph showing an error ratio of a control value obtained by an approximation to an ideal value to which the approximation is not applied when a distance between rollers is changed.

FIG. 3 is a graph showing an error ratio of a control value obtained by an approximation by using Equation 25 to an ideal value to which the approximation is not applied while the distance between rollers corresponding to the delay time $\tau$ is changed. As shown in FIG. 3, ideal control is performed at the error ratio of 0%, and a control effect cannot be expected at the error ratio of 100% which is the same as no control. From the graph, when the distance between rollers is 50 mm or less, the error ratio is about 50% and the influence to the velocity fluctuation caused by the PLD fluctuation can be about a half.

[Recognition Method 2 of PLD Fluctuation]

As described above, in the recognition method 1, when the distance between rollers is relatively large, the control error becomes large; therefore, the distance between rollers must be relatively small. Consequently, the degree of freedom in the layout of the apparatus becomes small. In the recognition method 2, a method in which the PLF fluctuation f(t) is obtained at high accuracy from the rotation angle velocities $\omega_1$ and $\omega_2$ of the first and second rollers 101 and 102 independent of the distance between rollers, is described. In an example below, a case in which the diameter of the second roller 102 is larger than that of the first roller 101 is described. However, the same principle can be obtained when the relation is inverted. Strictly, when a value in which the roller effective radius R is divided by the PLD fluctuation effective coefficient $\kappa$ is compared, the value of the second roller 102 is larger than that of the first roller 101.

The relationship between the rotation angle velocity $\omega_1$ of the first roller 101 and the rotation angle velocity $\omega_2$ of the second roller 102 is shown in Equation 6; when Equation 6 is changed, Equation 27 is obtained.

$$\left(\omega_2 - \frac{R_1}{R_2}\omega_1\right)\frac{R_2}{\omega_1 \kappa_1} = \left\{f(t) - \frac{\kappa_2 R_1}{\kappa_1 R_2} f(t-\tau)\right\} \quad \text{[Equation 27]}$$

When the right side of Equation 27 in which the coefficient of f(t) is normalized as 1 is defined as gf(t), Equation 28 is obtained.

$$gf(t)=\{f(t)-Gf(t-\tau)\} \quad \text{[Equation 28]}$$

where "G" in Equation 28 is shown in Equation 29.

$$G=\frac{\kappa_2 R_1}{\kappa_1 R_2}=\frac{R_1}{\kappa_1}\Big/\frac{R_2}{\kappa_2} \quad \text{[Equation 29]}$$

From the relationship between the roller effective radius R and the PLD fluctuation effective coefficient κ in each of the first roller 101 and the second roller 102, "G" is a value smaller than 1. In addition, from Equation 27, the gf(t) is obtained from the rotation angle velocities $\omega_1$ and $\omega_2$ of the first roller 101 and the second roller 102 by using the roller effective radiuses $R_1$ and $R_2$ and the PLD fluctuation effective coefficients $\kappa_1$ and $\kappa_2$. The PLD fluctuation f(t) is obtained form the gt(t).

Figure 4:
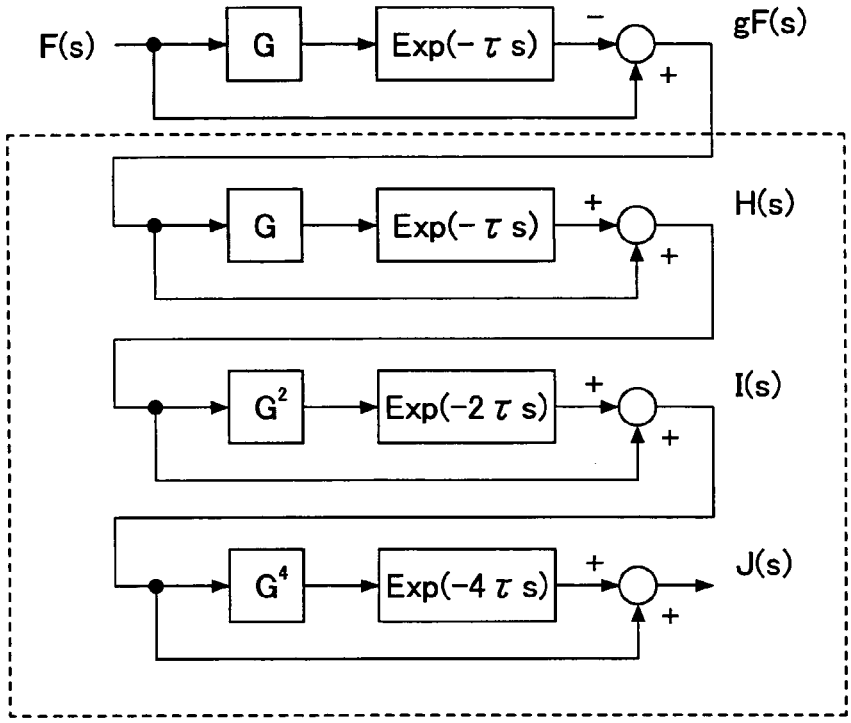
FIG. 4 is a control block diagram for explaining a recognition method 2 according to the embodiment of the present invention.

FIG. 4 is a control block diagram for explaining the recognition method 2. In FIG. 4, a function F(s), in which Laplace transformation is applied to a time function f(t), is used, and "s" is a Laplace operator. That is, F(s)=L {f(t)}; L{x} is Laplace transformation of "x". Further, in FIG. 4, the $0^{th}$ stage shown at the uppermost position expresses Equation 28, and a part surrounded by a dashed line is a filter in which the first stage and stages after the first stage are disposed.

When the gF(s), that is, the left side of Equation 27 (data obtained from the detected rotation angle velocities $\omega_1$ and $\omega_2$), is input, a time function h(t) of an output H(s) of the first stage, that is, $L^{-1}\{H(s)\}$ is shown in Equation 30. Where, $L^{-1}\{y\}$ shows inverse Laplace transformation and when "y" is I(s) or J(s), the meaning is the same.

$$\begin{aligned} h(t) &= [gf(t)+Ggf(t-\tau)] \quad \text{[Equation 30]} \\ &= [f(t)-Gf(t-\tau)]+G[f(t-\tau)-Gf(t-2\tau)] \\ &= f(t)-G^2 f(t-2\tau) \end{aligned}$$

At this time, since "$G^2$" is sufficiently smaller than "G" ($G \gg G^2$), the h(t) becomes a value close to the PLD fluctuation f(t) rather than the gf(t). An error $\epsilon_1$ at this time is shown in Equation 31.

$$\epsilon_1=-G^2 f(t-2\tau) \quad \text{[Equation 31]}$$

A time function i(t) of an output I(s) of the second stage is shown in Equation 32.

$$i(t)=f(t)-G^4 f(t-4\tau) \quad \text{[Equation 32]}$$

At this time, since "$G^4$" is sufficiently smaller than "$G^2$" ($G^2 \gg G^4$), the i(t) becomes a value further close to the PLD fluctuation f(t) than the h(t). An error $\epsilon_2$ at this time is shown in Equation 33.

$$\epsilon_2=-G^4 f(t-4\tau) \quad \text{[Equation 33]}$$

In addition, a time function j(t) of an output J(s) of the third stage is shown in Equation 34.

$$j(t)=f(t)-G^8 f(t-8\tau) \quad \text{[Equation 34]}$$

At this time, since "$G^8$" is sufficiently smaller than "$G^4$" ($G^4 \gg G^8$), the j(t) becomes a value further close to the PLD fluctuation f(t) than the i(t). An error $\epsilon_3$ at this time is shown in Equation 35.

$$\epsilon_3=-G^8 f(t-8\tau) \quad \text{[Equation 35]}$$

By following the sequence below in which the above result is generalized, the PLD fluctuation f(t) is obtained by using the left side data shown in Equation 27 which data are obtained from the detected rotation angle velocities $\omega_1$ and $\omega_2$. Then, the PLD fluctuation f(t) can be obtained at high accuracy from the detected rotation angle velocities $\omega_1$ and $\omega_2$ independent of the distance between rollers.

(First Step)

A value $g_1(t)$ is obtained by adding data in which the gf(t) is multiplied by G and the multiplied data are delayed by the delay time τ and the gf(t).

(Second Step)

A value $g_2(t)$ is obtained by adding data in which the $g_1(t)$ is multiplied by $G^2$ and the multiplied data are delayed by the delay time 2τ and the $g_1(t)$.

(Third Step)

A value $g_3(t)$ is obtained by adding data in which the $g_2(t)$ is multiplied by $G^4$ and the multiplied data are delayed by the delay time 4τ and the $g_2(t)$. Similarly, the following steps are continued.

($N^{th}$ Step)

A value $g_n(t)$ is obtained by adding data in which the $g_{n-1}(t)$ is multiplied by the $2^{n-1}$ power of G and the multiplied data are delayed by the delay time $2^{n-1}\times\tau$ and the $g_{n-1}(t)$.

That is, in the $n^{th}$ stage of the filter shown in FIG. 4, the delay element is determined as the delay time $2^{n-1}\times\tau$ and the gain element is determined as the $2^{n-1}$ power of G. Then, the $g_n(t)$ of the output data of the final stage is obtained as the PLD fluctuation f(t). In this, the larger the number of steps "n" is, the more accurate the recognition of the PLD fluctuation is.

Figure 5:
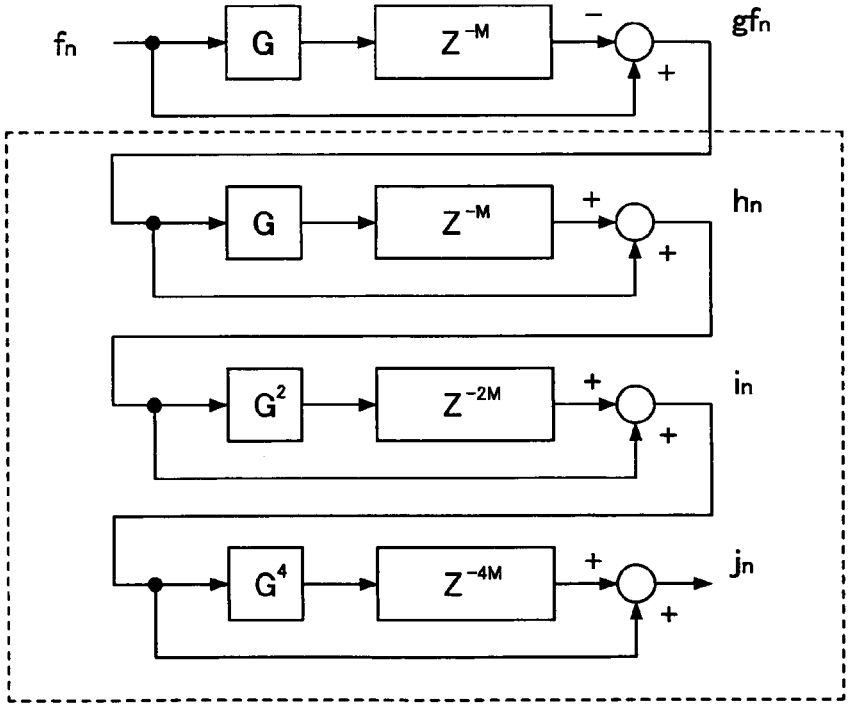
FIG. 5 is a control block diagram in which Z transformation is applied to the control block diagram shown in FIG. 4.

FIG. 5 is a control block diagram in which Z transformation is applied to the control block diagram shown in FIG. 4. In FIG. 5, the gf(n) is expressed as $gf_n$ and the f(n) is expressed as $f_n$.

In FIG. 5, the sampling time of data which are input to a filter section (FIR filter) is Ts, the delay time τ is M×Ts (M is an integer), and the time which the belt 103 needs to moves one round is Tb=N×Ts (N is an integer). In this case, the number of samplings while the belt 103 moves one round is N. The PLD fluctuation f(t) obtained from the control block diagram shown in FIG. 5 is composed of a data string of N pieces of the PLD fluctuation value f(n) obtained at each sampling time Ts. The process at the filter section is a digital process and the digital filter process is executed by using a DSP (digital signal processor), a μ CPU, and so on.

Figure 6:
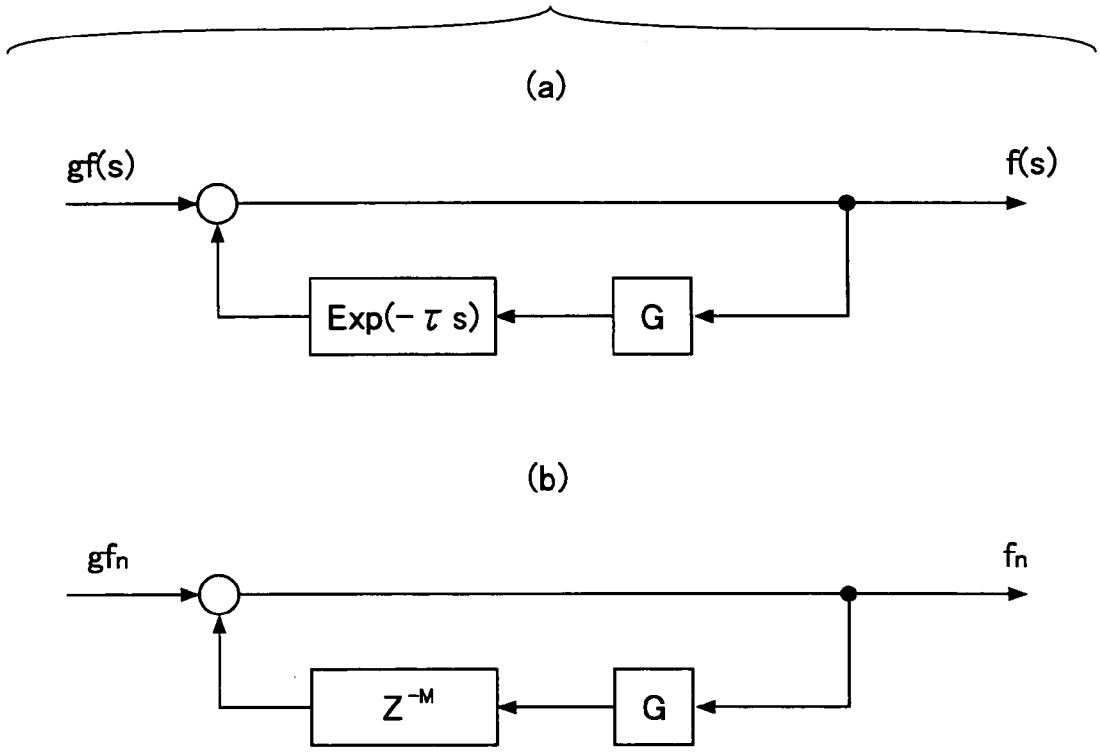
FIG. 6 is a control block diagram in which the control block diagram shown in FIG. 4 is expressed by other systems.

In addition, the FIR filter shown in FIG. 5 can be replaced by an IIR filter. When the control block diagram shown in FIG. 5 is expressed by a continuous system, it is shown in FIG. 6 (*a*), and when it is expressed by a discrete system in a digital process, it is shown in FIG. 6 (*b*).

As described above, the rotation angle velocity $\omega_1$ of the first roller 101 and the rotation angle velocity $\omega_2$ of the second roller 102 are influenced by the respective PLD fluctuation f(t) and PLD fluctuation f(t−τ) whose phases are different. However, the roller effective radius R and/or the PLD fluctuation effective coefficient κ are different from each other; therefore, a ratio in which the PLD fluctuation component occupies in the roller effective radius R is different. Consequently, the detecting size of the rotation angle velocity fluctuation caused by the PLD fluctuation is different therebetween. The inventors of the present invention found a method in which the PLD fluctuation f(t) can be obtained at high accuracy independent of the frequency characteristics by using an algorithm equivalent to a filter such as the FIR filter and the IIR filter by paying attention to the size difference. In this, the normalization is performed so that the coefficient of the f(t) becomes 1 so as to obtain the PLD fluctuation f(t). However, when G is larger than 1, the PLD fluctuation f(t−τ) can be obtained by an algorithm process by normalizing so that the coefficient of the PLD fluctuation $f(t-\tau)$ becomes 1. At this time, the coefficient of the PLD fluctuation f(t) becomes an inverse of G. That is, in a case where $t'=t-\tau$ and $\tau'=Tb-\tau$ (Tb is a belt one round time), when the left side of Equation 27 is multiplied by $(-1/G)$, the right side can be expressed as $f(t')-(1/G)\,f(t'-\tau')$. Therefore, the PLD fluctuation can be obtained by the FIR filter or the IIR filter similar to the algorithm.

[Recognition Method 3 of PLD Fluctuation]

As described above, in the recognition method 2, since there is no restriction on the disposition of the rollers, the degree of freedom in the layout of the apparatus becomes large. However, an operation process time for reaching the third step needs to run until the recognition error of the PLD fluctuation f(t) becomes $\epsilon_3$ shown in Equation 35. For example, at the process of the first step, since data which are delayed by delay time $\tau$, that is, $\tau$ time past data, are used, when the output time function of the first step becomes the h(t) shown in Equation 30, $\tau$ time is needed. In addition, when the output time function of the second step becomes the i(t) shown in Equation 32, further $2\tau$ time is needed (total $3\tau$ time is needed in the first and second steps). Further, when the output time function of the third step becomes the j(t) shown in Equation 34, further $4\tau$ time is needed (total $7\tau$ time is needed in the first through third steps). As described above, in the recognition method 2, when the recognition of the PLD fluctuation f(t) is obtained at high accuracy with low errors, many steps are needed and much processing time is required.

In the recognition method 3, in the disposition of the first roller 101 and the second roller 102, the ratio of the belt carrying distance between the first roller 101 and the second roller 102 to the belt total carrying distance (circumference length) is set to 1:2Nb (Nb is an integer), and the PLD fluctuation f(t) is obtained from the rotation angle velocity $\omega_1$ of the first roller 101 and the rotation angle velocity $\omega_2$ of the second roller 102 in a short time at high accuracy.

In the recognition method 3, when Nb=1, that is, the ratio between the above two distances is 1:2, in the roller disposition relationship between the two rollers, the two rollers are disposed at the farthest positions. For example, when the belt circumference length is 1000 mm, the belt carrying distance between the two rollers becomes 500 mm. When Nb=2, the belt carrying distance between the two rollers becomes 250 mm. As described above, when a condition is added to the layout on the roller disposition, by an operations process similar to the process shown in FIGS. 4 and 5 in the recognition method 2, the PLD fluctuation f(t) of the belt can be obtained in a short time at high accuracy.

Next, the process in the recognition method 3 is described. First, the case of Nb=1 is described. In this case, the first roller 101 and the second roller 102 are disposed at the farthest positions on the belt carrying route. Then, the gf(t) shown in Equation 28 is obtained from the rotation angle velocities $\omega_1$ and $\omega_2$. Next, the PLD fluctuation f(t) is calculated by applying the process described in the FIR filter process (non-feedback process) shown in FIGS. 4 and 5 in the recognition method 2 to the gf(t). In this, the number of requiring steps is Nb. That is, when Nb=1, since only the first step is required, the H(s) at the first stage shown in FIG. 4 is calculated and the $h_n$ at the first stage shown in FIG. 5 is calculated. As described in recognition method 2, the processed result is shown in Equation 30. When the belt one round is defined as the rotation angle $2\pi$ rad, the position relationship between the two rollers becomes $\pi$ rad. In addition, the delay time $\tau$ is a belt carrying time between the two rollers when the belt is carried by a predetermined normal velocity. Consequently, the delay time $2\tau$ becomes $2\pi$ rad when converted into the belt rotation angle. Since the PLD fluctuation f(t) is a periodic function which is repeated in each one rotation of the belt, in Equation 30, the $f(t-2\tau)$ including in the second term at the right side can be made the f(t). Therefore, in the recognition method 3, when Nb=1, Equation 30 can be modified to Equation 36.

$$h(t)=(1-G^2)f(t) \qquad \text{[Equation 36]}$$

Therefore, when the data h(t) (H(s)) which are output from the first stage of the FIR filter are divided by $(1-G^2)$, the PLD fluctuation f(t) can be obtained without errors. A requiring time for performing this process is the time $\tau$ since data of the past time $\tau$ is used.

As described above, according to the recognition method 3, when Nb=1, the PLD fluctuation f(t) can be obtained at high accuracy in the process time $\tau$ without recognition errors, similar to the recognition method 2.

Similarly, when Nb=2, since the processes up to the second stage are performed, the processes up to the calculation of I(s) in the second stage of the FIR filter shown in FIG. 4 or the processes up to the calculation of $i_n$ of the second stage of the FIR filter shown in FIG. 5 are performed. The processed result is shown in Equation 32 as described in the recognition method 2. In this, the time $4\tau$ becomes $2\pi$ rad when converted into the belt rotation angle. Therefore, in Equation 32, the $f(t-4\tau)$ including in the second term at the right side can be made the f(t), and Equation 32 can be modified to Equation 37.

$$h(t)=(1-G^4)f(t) \qquad \text{[Equation 37]}$$

Therefore, when the data i(t) (I(s)) which are output from the second stage of the FIR filter are divided by $(1-G^4)$, the PLD fluctuation f(t) can be obtained without errors. A time requiring for performing this process is the time $3\tau$. As described above, according to the recognition method 3, when Nb=2, the PLD fluctuation f(t) can be obtained at high accuracy without recognition errors in the process time $3\tau$, similar to the recognition method 2.

As described above, in the recognition method 3, since the ratio of the belt carrying distance between the two rollers to the belt total carrying distance (circumference length) is set to 1:2Nb (Nb is an integer) in the disposition of the two rollers, the PLD fluctuation f(t) can be obtained at high accuracy without the recognition errors from the data after the $Nb^{th}$ step in the FIR filter process in the recognition method 2. In addition, when the recognition method 3 is compared with the recognition method 2, since the FIR filter process is finished at the $Nb^{th}$ step, the PLD fluctuation f(t) can be obtained in a shorter time.

In addition to the recognition methods 1 through 3 described above, another recognition method of the PLD fluctuation is described below. In the present recognition method, the PLD fluctuation f(t) is obtained in a short time from the rotation angle velocities $\omega_1$ and $\omega_2$ of the first roller 101 and the second roller 102 so that the ratio of the belt moving distance between the two rollers 101 and 102 (distance between rollers) to the belt circumference length becomes 1:(2Nb+1). In this, Nb is an integer.

That is, in the present recognition method, as described above, first, the ratio of the belt moving distance between the two rollers 101 and 102 to the belt circumference length is determined as 1:(2Nb+1). That is, when Nb=1, the above ratio is 1:3. Therefore, when the belt circumference length is 1500 mm, the belt moving distance between the two rollers 101 and 102 becomes 500 mm. Similarly, when Nb=2, the belt moving distance between the two rollers 101 and 102 becomes 300 mm. As described above, when the disposing condition of the two rollers 101 and 102 is added, the PLD fluctuation f(t) of the belt can be obtained at high accuracy in the following operations.

Next, the operations of the present recognition method are described. First, the case of Nb=1 is described. In this case, the belt moving distance between the two rollers 101 and 102 (distance between rollers) is ⅓ of the belt circumference length. Then the gf(t) shown in Equation 28 is obtained from the rotation angle velocities $\omega_1$ and $\omega_2$ of the first roller 101 and the second roller 102.

Figure 21:
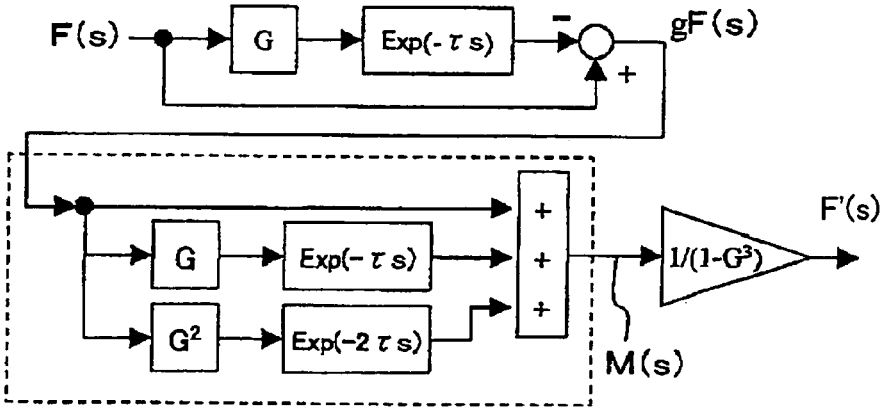
FIG. 21 is a control block diagram for explaining another recognition method according to the embodiment of the present invention.

FIG. 21 is a control block diagram for explaining the present recognition method. In FIG. 21, a function F(s), in which Laplace transformation is applied to a time function f(t), is used, and "s" is a Laplace operator. That is, F(s)=L{f(t)}; L{x} is Laplace transformation of "x". Further, in FIG. 21, the operations from the F(s) to the gF(s) at the uppermost position express Equation 28, and a part surrounded by a dashed line is a filter (FIR dilter).

In the filter, the coefficient G shown in Equation 29 and the delay time "τ" based on the distance between rollers are included. When the gF(s), that is, the left side of Equation 27 (data obtained from the detected rotation angle velocities $\omega_1$ and $\omega_2$), is input in the filter, a time function m(t) of an output M(s) of the filter (FIR filter), that is, $L^{-1}\{M(s)\}$ is shown in Equation 38. Where, $L^{-1}\{y\}$ shows inverse Laplace transformation of "y".

$$\begin{aligned} m(t) &= [gf(t) + Ggf(t-\tau) + G^2gf(t-2\tau)] \\ &= [f(t) - Gf(t-\tau)] + \\ &\quad G[f(t-\tau) - Gf(t-2\tau)] + \\ &\quad G^2[f(t-2\tau) - Gf(t-3\tau)] \\ &= f(t) - G^3 f(t-3\tau) \end{aligned} \quad \text{[Equation 38]}$$

As described above, in FIG. 21, the part surrounded by the dashed line is the filter, and the PLD fluctuation f(t) is calculated by a non-feedback process in the filter. In this, the necessary length of the filter is 2Nb+1. That is, when Nb=1, since the filter length is 3, as shown in FIG. 21, the M(S) in which three operation values are added is calculated. As described above, the operation result is shown in Equation 38. In this, when the belt one round is defined as a rotation angle 2p rad, the position relationship of the two rollers becomes 2p/3 rad. In addition, the delay time "1" is a belt carrying time between the two rollers 101 and 102 when the belt is carried by a predetermined normal velocity. Therefore, the time "3τ" becomes 2p rad when being converted into a belt rotation angle. Since the PLD fluctuation f(t) is a periodic function which repeats every one round of the belt, in Equation 38, the f(t−3τ) in the second term at the right side can be the f(t). Therefore, in the present recognition method, when Nb=1, Equation 38 can be modified into Equation 39.

$$m(t)=(1-G^3)f(t) \quad \text{[Equation 39]}$$

Therefore, when the data m(t) output from the filter (FIR filter) is divided by $(1-G^3)$, the PLD fluctuation f(t) can be obtained without errors. A time which is needed to execute this operation becomes a 2τ time, because data of the past 2τ time are used.

Figure 22:
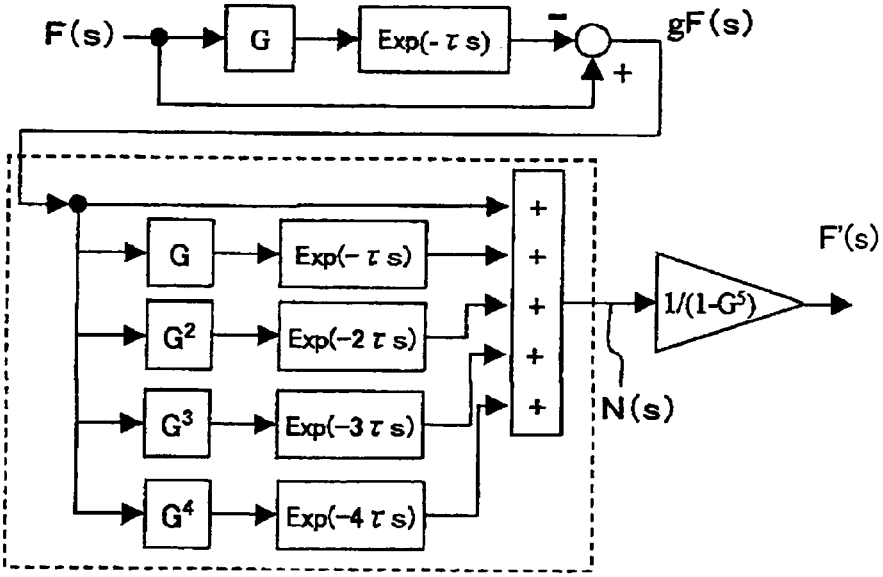
FIG. 22 is another control block diagram for explaining the recognition method shown in FIG. 21.

Similarly, when Nb=2, since a filter (FIR filter) process of the filter length 5 is executed, a filter process shown in FIG. 22 is executed. The result of the process is shown in Equation 40. In this, FIG. 22 is another control block diagram for explaining the present recognition method.

$$\begin{aligned} n(t) &= [gf(t) + Ggf(t-\tau) + G^2gf(t-2\tau) + \\ &\quad G^3gf(t-3\tau) + G^4gf(t-4\tau)] \\ &= f(t) - G^5 f(t-5\tau) \end{aligned} \quad \text{[Equation 40]}$$

In this, the time "5τ" becomes 2p rad when being converted into a belt rotation angle. Therefore, in Equation 40, the f(t−5τ) in the second term at the right side can be the f(t). Therefore, Equation 40 can be modified into Equation 41.

$$n(t)=(1-G^5)f(t) \quad \text{[Equation 41]}$$

Therefore, when the data n(t) output from the filter (FIR filter) is divided by $(1-G^5)$, the PLD fluctuation f(t) can be obtained without errors. A time which is needed to execute this operation becomes a 4τ time. As described above, according to the present recognition method, when Nb=2, the PLD fluctuation f(t) can be obtained without recognition errors at high accuracy in a 4τ time.

As described above, in the present recognition method, when it is determined that the ratio of the belt moving distance between the two rollers 101 and 102 (distance between rollers) to the belt circumference length is 1:(2Nb+1), the PLD fluctuation f(t) can be obtained at high accuracy from data of the FIR filter process whose filter length is (2Nb+1) without recognition errors.

Therefore, the PLD fluctuation f(t) is obtained by using data of the left side shown in Equation 27 which data are obtained by the detected rotation angle velocities $\omega_1$ and $\omega_2$ based on the following sequence in which the above results are generalized. With this, the PLD fluctuation f(t) can be obtained by the detected rotation angle velocities $\omega_1$ and $\omega_2$ at high accuracy.

(First Line)

Data gf(t) are obtained.

(Second Line)

Data in which the gf(t) is multiplied by G and the multiplied data are delayed by the delay time τ are obtained.

(Third Line)

Data in which the gf(t) is multiplied by $G^2$ and the multiplied data are delayed by the delay time 2τ are obtained.

Similarly, the following lines are continued.

($N^{th}$ Line)

Data in which the gf(t) is multiplied by $G^{n-1}$ and the multiplied data are delayed by the delay time (n−1)τ are obtained.

When data of each line are obtained, data from the first line to the $(2Nb+_1)^{th}$ line are added. When the added result n(t) is divided by $(1-G^{2Nb+1})$, the PLD fluctuation f(t) can be obtained without errors.

Figure 23:
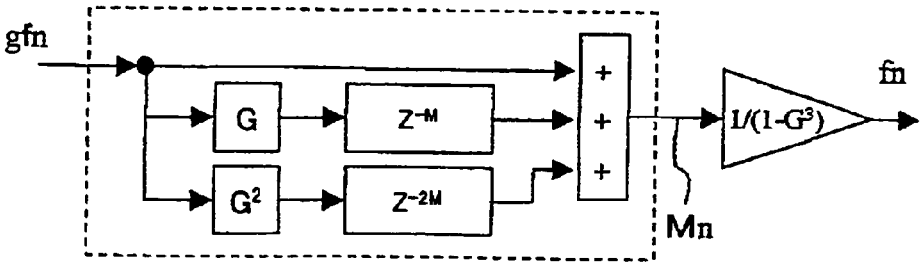
FIG. 23 is a control block diagram in which Z transformation is applied to the control block diagram shown in FIG. 21.

FIG. 23 is a control block diagram in which Z transformation is applied to the control block diagram shown in FIG. 21. In FIG. 23, the gf(n) is expressed as gfn and the f(n) is expressed as fn.

When the followings are determined, that is, the sampling time of data which are input to a filter (FIR filter) surrounded by the dashed line is Ts, the delay time τ is M×Ts (M is an integer), and the time which the belt 103 needs to moves one round is Tb=N×Ts (N is an integer). In this case, the number of samplings while the belt 103 moves one round is N. The PLD fluctuation f(t) obtained from the control block diagram shown in FIG. 23 is composed of a data string of N pieces of the PLD fluctuation value f(n) obtained at each sampling time Ts. The process at the filter is a digital process and the digital filter process is executed by using a DSP (digital signal processor), a μ CPU, and so on.

As described above, the rotation angle velocities $\omega_1$ and $\omega_2$ of the two rollers 101 and 102 are influenced by the corresponding PLD fluctuations f(t) and f(t−τ) whose phases are different from each other. However, in the two rollers 101 and 102, since the roller effective radius R and the PLD fluctuation effective coefficient κ are different from each other, the ratio of the PLD fluctuation elements which occupy in the roller effective radius is different from each other. Therefore, the sizes of the detected rotation angle fluctuations caused by the PLD fluctuations are different from each other. By focusing on the above, the inventors of the present invention found that the PLD fluctuation f(t) was able to be obtained at high accuracy by not depending on frequency characteristics by using the above filter or an algorithm similar to the above filter. In this, in order to obtain the PLD fluctuation f(t), normalization is applied so that the coefficient of the PLD fluctuation f(t) becomes 1. However, the normalization can be applied so that the coefficient of the PLD fluctuation f(t−τ) becomes 1 and the PLD fluctuation f(t−τ) can be obtained by the above algorithm. At this time, the coefficient of the PLD fluctuation f(t) becomes a reciprocal of G. That is, when it is determined that t'=t−τ and τ'=Tb−τ(Tb is a time of the one round of the belt), and the left side of Equation 27 is multiplied by (−1/G), the right side can be expressed by f(t')−(1/G)f(t'−τ'). Therefore, the PLD fluctuation f(t) can be obtained by using the filter.

In the present recognition method, in the Equation 38, since the PLD fluctuation f(t) is obtained by f(t−3τ)=f(t), when the 3τ is not just the belt one round time, controls errors occur in the belt moving velocity. Consequently, when the belt moving velocity fluctuation is attempted to restrain by the PLD fluctuation f(t) according to the present recognition method, a slight belt moving velocity fluctuation remains. The reasons in which the (2Nb+1)τ does not become the just belt one round time are considered as follows. First, the position relationship between the two rollers 101 and 102 is shifted from the relationship in which the ratio of the belt moving distance between the two rollers 101 and 102 to the belt circumference length becomes 1:(2Nb+1). Second, the belt circumference length is changed in the passage of time or in an environment change, or some errors are caused in the manufacturing the belt. Therefore, it is preferable that the errors in the position relationship between the two rollers be within 10% for the belt circumference length. The roller disposing position is allowed when the belt velocity fluctuation is within tolerance described below.

Generally, the belt moving velocity fluctuation which occurs in the belt 103 is caused not only by the PLD fluctuation but also eccentricity and accumulated pitch errors of gears in the driving force transmission route. Consequently, the tolerance of the belt moving velocity fluctuation caused by the PLD fluctuation is a tolerance of the pLD fluctuation in designing. As described above, in the driving control of the intermediate transfer belt 10 of the copying machine in the present embodiment, the color registration errors and the banding occur caused by the belt moving velocity fluctuation. When an actual belt moving position is shifted from a target belt moving position, the belt moving velocity fluctuation occurs and the color registration errors and the banding occur. When the shifting amount of the belt moving position becomes large, the belt moving velocity fluctuation becomes large. The color registration errors and the banding of the image on the recording medium are noticed by a user. For example, in the case of the banding, the tolerance of an actual unnoticeable level can be defined as a spatial frequency "fs" which shows a changing interval (distance) of the image density. The spatial frequency "fs" has a relationship with a time frequency "f"; f=F×fs (F is a constant). Therefore, when the tolerance of the banding is determined within the predetermined tolerance of the spatial frequency, the tolerance of the shifting amount of the belt moving position can be defined. Consequently, the tolerance of the belt moving velocity fluctuation can be defined.

Next, a specific belt driving control which restrains the fluctuation of the belt moving velocity caused by the PLD fluctuation is described by using the PLD fluctuation f(t) obtained by the recognition method 1, the recognition method 2, or the recognition method 3.

As the specific belt driving control by using the PLD fluctuation f(t), plural control methods are possible corresponding to the device structures. In this, two control methods are described. That is, a control method (belt driving control example 1) in a device in which a mechanism for detecting the home position of the belt 103 is provided, and anther control method (belt driving control example 2) in a device in which the mechanism for detecting the home position of the belt 103 is not provided are described.

[Belt Driving Control Example 1]

When suitable belt driving control corresponding to the PLD fluctuation is executed by using the PLD fluctuation f(t), a phase (when the belt one round is 2π) of the PLD fluctuation on the belt 103 must be obtained. As the phase obtaining method, a home position mark of the belt 103 is determined beforehand and the mark is detected. Then, the phase is obtained by using any one of time information measured by a timer, driving motor rotation angle information, and rotation angle information by an output from a rotary encoder.

Figure 7:
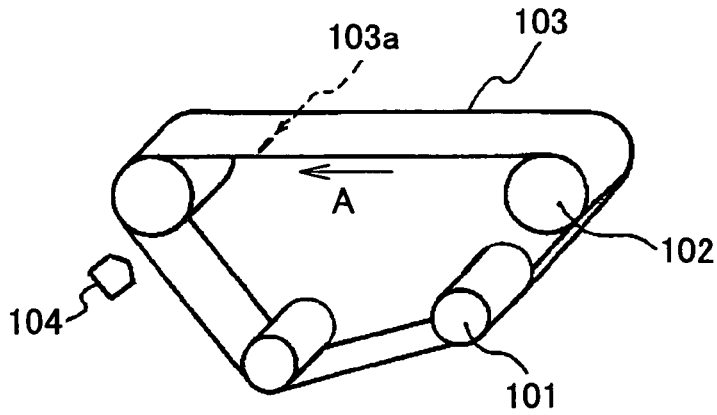
FIG. 7 is a schematic diagram showing a structure which detects a home position mark of a belt according to a belt driving control example 1.

FIG. 7 is a schematic diagram showing a structure which detects a home position mark of the belt 103 according to the belt driving control example 1. A home position mark 103*a* is formed on the belt 103 and the home position mark 103*a* is detected by a mark detecting sensor (mark detecting unit) 104, and a phase which becomes a reference in belt one round is obtained.

In the present example, as the home position mark 103*a*, a metal film which is stuck at a predetermined position on the belt 103 is used, and as the mark detecting sensor 104, a reflection type photo-sensor disposed on a fixed member is used. The mark detecting sensor 104 outputs a pulse when the home position mark 103*a* passes through a detection region of the mark detecting sensor 104. The position where the home position mark 103*a* is disposed is at an end part in the width direction on the inner circumference surface or the outer circumference surface of the belt 103 so that the home position mark 103*a* dose not affect a process forming an image. An image forming material such as ink and toner may be attached to the home position mark 103*a* and a sensor surface of the mark detecting sensor 104. In this case, there is a risk that the other position is recognized as the home position by mistake. In order to avoid such wrong recognition, it is desirable that a function of recognizing an accurate belt home position be added to the mark detecting sensor 104 while managing sensor output amplitude, a pulse width, and a pulse interval. In this, at least one home position mark is needed; however, plural marks can be provided by patterning so as to avoid the wrong recognition.

Figure 8:
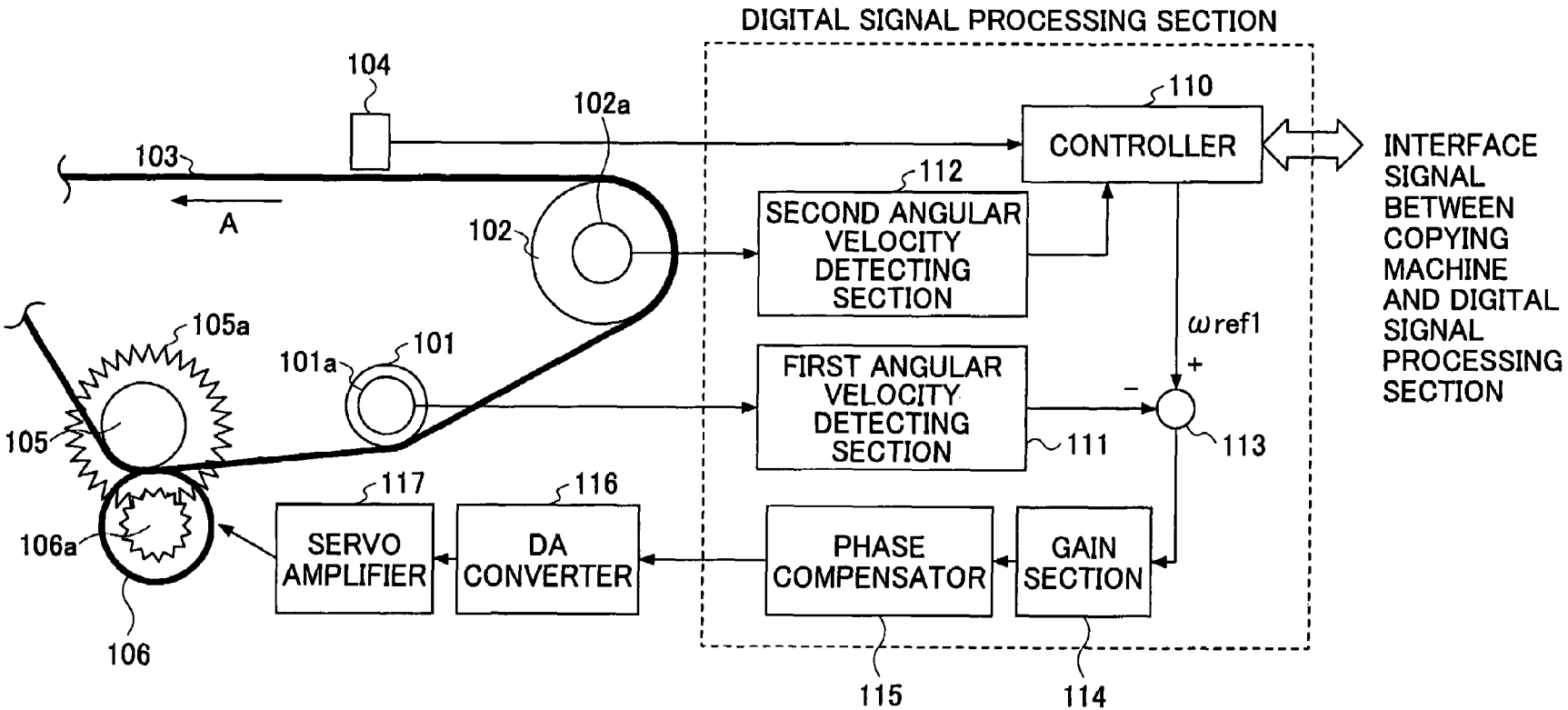
FIG. 8 is a diagram for explaining control operations in the belt driving control example 1.

FIG. 8 is a diagram for explaining control operations in the belt driving control example 1. In FIG. 8, the position of the mark detecting sensor 104 is different from that shown in FIG. 7 for the sake of convenience of the explanation.

Rotation driving force generated by a driving motor 106 is transmitted to a driving roller 105 via a deceleration mechanism composed of a driving gear 106*a* and a driven gear 105*a*. With this, the driving roller 105 is rotated and the belt 103 is moved in the arrow A direction. The first roller 101 and the second roller 102 are rotated together by the movement of the belt 103. A first rotary encoder 101*a* is disposed in the first roller 101 and a second rotary encoder 102*a* is disposed in the first roller 102, and an output signal from the first rotary encoder 101*a* is input to a first angular velocity detecting section 111 in a digital signal processing section and an output signal from the second rotary encoder 102*a* is input to a second angular velocity detecting section 112 in the digital signal processing section. The rotary encoders 101*a* and 102*a* can be connected to the corresponding rollers 101 and 102 via a deceleration mechanism composed of, for example, gears. In order to avoid sliding contact with the inner circumference surface of the belt 103, surface treatment is applied to the surfaces of the first roller 101 and the second roller 102, and further, a belt winding angle for the belt 103 is selected. In the present example, the diameter of the second roller 102 is larger than that of the first roller 101. A motor control signal calculated in the digital signal processing section is input to a servo amplifier 117 via a DA converter 116. The servo amplifier 117 drives the driving motor 106 based on a control signal.

In the digital signal processing section, the first angular velocity detecting section 111 detects the rotation angle velocity $\omega_1$ of the first roller 101 from a signal output from the first rotary encoder 101*a*. Similarly, the second angular velocity detecting section 112 detects the rotation angle velocity $\omega_2$ of the second roller 102 from a signal output from the second rotary encoder 102*a*. A controller 110 calculates a control target value $\omega_{ref1}$ corresponding to PLD fluctuation data of the belt 103 based on a target belt velocity instruction from the copying machine. Specifically, first, the belt 103 is driven so that the rotation angle velocity $\omega_1$ of the first roller 101 is maintained at the control target value $\omega_{ref1}$ based on the target belt velocity instruction from the copying machine. That is, the belt 103 is driven so that the rotation angle velocity $\omega_1$ of the first roller 101 becomes a constant. Therefore, at this time, the control target value $\omega_{ref1}$ becomes the above described constant rotation angle velocity $\omega_{01}$. When the rotation angle velocity $\omega_1$ of the first roller 101 becomes the constant, by making a pulse signal from the mark detecting sensor 104 a reference, in the recognition method 1, the recognition method 2, or the recognition method 3, data of the PLD fluctuation f(t) are obtained from the rotation angle velocity $\omega_2$ of the second roller 102. Then, a suitably corrected control target value $\omega_{ref1}$ corresponding to the data of the PLD fluctuation f(t) is calculated and output.

The suitably corrected control target value $\omega_{ref1}$ output from the controller 110 is compared with the rotation angle velocity $\omega_1$ at a comparator 113, and a deviation which is the compared result is output from the comparator 113. The deviation is input to a phase compensator 115 via a gain section 114 and a motor control signal is output from the phase compensator 115. The deviation which is input to the gain section 114 is a value between the control target value $\omega_{ref1}$ in which the PLD fluctuation of the belt 103 is corrected and the rotation angle velocity $\omega_1$ of the first roller 101. The deviation is generated by sliding contact between the driving roller 105 and the belt 103, driving force transmission errors caused by eccentricity of the driving gear 106*a* and the driven gear 105*a*, a belt moving velocity fluctuation caused by eccentricity of the driving roller 105, and so on. The motor control signal makes the deviation small and drives the driving motor 106 so that the belt 103 moves at a constant velocity. In order to realize this, an adjusted motor control signal is output so that the deviation from the target velocity is decreased and stabilization is obtained without overshooting and oscillating in the belt 103 by using, for example, a PID controller (not shown).

In order to maintain the belt moving velocity V at a constant velocity $V_0$, the rotation angle velocity $\omega_1$ of the first roller 101 is controlled to satisfy Equation 42. In this, when the rotation angle velocity $\omega_2$ of the second roller 102 is controlled, it is controlled to satisfy Equation 43.

$$V_0 = \{R_1 + \kappa_1 f(t)\}\omega_1 \quad \text{[Equation 42]}$$

$$\omega_1 = \frac{V_0}{\{R_1 + \kappa_1 f(t)\}} \cong \frac{V_0}{R_1}\left\{1 - \frac{\kappa_1}{R_1} f(t)\right\} = \omega_{ref1}$$

$$\omega_2 \cong \frac{V_0}{R_2}\left\{1 - \frac{\kappa_2}{R_2} f(t-\tau)\right\} = \omega_{ref2} \quad \text{[Equation 43]}$$

In the belt driving control example 1, even if the PLD fluctuation in the belt circumference direction exists in the belt 103, as described above, the rotation angle velocity $\omega_1$ of the first roller 101 is controlled to become the control target value $\omega_{ref1}$ which is corrected by the PLD fluctuation f(t). Therefore, the fluctuation of the belt moving velocity caused by the PLD fluctuation can be restrained.

[Belt Driving Control Example 2]

In the belt driving control example 1, the structure which detects the home position mark 103*a* is used. However, in order to reduce cost, in the belt driving control example 2, the above structure is not used.

The basic processes in the belt driving control example 2 are the same as those in the belt driving control example 1. However, the home position of the belt 103 is obtained by using a virtual home position signal which virtually specifies the home position of the belt 103, instead of using the pulse signal of the mark detecting sensor 104 in the belt driving control example 1 show in FIG. 7. For example, it is predicted that the belt 103 moves around from an arbitrary position, by using accumulated rotation angles of the rollers obtained from the first and second rotary encoders 101*a* and 102*a*, as the virtual home position signal. In this case, since the accumulated rotation angles of the rollers while the belt 103 moves around can be obtained beforehand, it is possible to predict that the belt 103 moves around from the accumulated rotation angles. At this time, the count starting time of the accumulated rotation angles is t=0 in the PLD fluctuation f(t). The count starting time corresponds to a receiving time of the pulse signal from the mark detecting sensor 104 in the belt driving control example 1.

The virtual home position signal is set to be generated every rotation cycle of the belt 103. In addition to the use of the accumulated rotation angles, various methods can be used as the method setting the generation of the virtual home position signal. For example, it is predicted that the belt 103 moves around from an arbitrary position by using an accumulated rotation angle of the driving motor 106, and when the accumulated rotation angle reaches an angle corresponding to the belt one round, the virtual home position signal is generated. Or, when the belt 103 moves at a predetermined average moving velocity, a time which the belt 103 needs to move around is predicted from the average moving velocity, when the time reaches a time in which the belt 103 moves around, the virtual home position signal is generated.

In the belt driving control example 2, in the prediction in which the belt 103 moves around, a difference from an actual movement occurs, caused by the $PLD_{ave}$ which is an average of PLDs of the belt, an accuracy difference among the roller diameters, a change of environment, a change in the passage of time, and so on.

When the difference exists between the belt one round by the prediction of the virtual home position signal and the actual belt one round, the phase of the PLD fluctuation f(t) is shifted in accumulation. Therefore, when the belt driving control is executed by the data of the PLD fluctuation f(t), the belt moving velocity fluctuates.

The above is described in detail. Even in a case that the PLD fluctuation f(t) is obtained based on the virtual home position signal, when the target rotation angle velocity of the first roller 101 is controlled by the control target value $\omega_{ref1}$ shown in Equation 42, the rotation angle velocity $\omega_2$ which is detected at the second roller 102 must be the $\omega_{ref2}$ shown in Equation 43. In this, when the virtual home position obtained from the virtual home position signal is shifted by a time "d" from the actual home position, the belt moving velocity $V_d$ at this time is shown in Equation 44.

$$V_d=\{R_1+\kappa_1 f(t-d)\}\overline{\omega}_{ref1} \quad \text{[Equation 44]}$$

When Equation 42 is substituted for Equation 44, Equation 45 is obtained.

$$V_d \cong V_0\left\{1+\frac{\kappa_1}{R_1}(f(t-d)-f(t))\right\} \quad \text{[Equation 45]}$$

The rotation angle velocity $\omega_{2d}$ of the second roller 102 at this time is shown in Equation 46.

$$\omega_{2d}=\frac{V_d}{\{R_2+\kappa_2 f(t-\tau-d)\}} \quad \text{[Equation 46]}$$

Further, when Equation 45 is substituted for Equation 46 and modified, Equation 47 is obtained.

$$\omega_{2d} \cong \frac{V_0}{R_2}\left\{1-\frac{\kappa_2}{R_2}f(t-\tau-d)+\frac{\kappa_1}{R_1}(f(t-d)-f(t))\right\} \quad \text{[Equation 47]}$$

Therefore, the shift amount $\omega_{2\delta}$ of the rotation angle velocity of the second roller 102, caused by that the virtual home position obtained from the virtual home position signal is shifted by the time "d" from the actual home position, is shown in Equation 48. That is, the shift amount $\omega_{2\delta}$ of the rotation angle velocity of the second roller 102 can be obtained as a difference between the rotation angle velocity detection data $\omega_{2d}$ of the second roller 102 and the reference data $\omega_{ref2}$ of the second roller 102.

$$\omega_{2\delta}=\omega_{2d}-\omega_{ref2} \quad \text{[Equation 48]}$$

When Equation 44 and Equation 47 are substituted for Equation 48 and modified, Equation 49 can be obtained.

$$\omega_{2\delta}=\frac{V_0}{R_2}\left[\begin{array}{l}\frac{\kappa_1}{R_1}\{f(t-d)-f(t)\}- \\ \frac{\kappa_2}{R_2}\{f(t-\tau-d)-f(t-\tau)\}\end{array}\right] \quad \text{[Equation 49]}$$

In Equation 49, the shift amount $\omega_{2\delta}$ is a result of the addition (subtraction) of the fluctuation component (first term) generated so that the virtual home position is shifted from the actual home position by the time "d" in the first roller 101 and the fluctuation component (second term) generated so that the virtual home position is shifted from the actual home position by the time "d" in the second roller 102.

When the absolute value of the shift amount $\omega_{2\delta}$ exceeds a predetermined value, or an average value, a mean-square value, or a root-mean-square value of the absolute values of the shift amounts $\omega_{2\delta}$ in one round of the belt exceeds a predetermined value, the currently recognized PLD fluctuation f(t) is corrected. In the correction, the rotation angle velocity $\omega_2$ of the second roller 102 is detected under a state in which the rotation angle velocity $\omega_1$ of the first roller 101 is controlled to a constant rotation angle velocity $\omega_{01}$, and with this, a new PLD fluctuation f(t) is obtained. After this, the rotation angle velocity $\omega_1$ of the first roller 101 is controlled to become the reference rotation angle velocity $\omega_{ref1}$ by using the data of the new PLD fluctuation f(t).

[Renewal of PLD Fluctuation]

Next, a process in which an obtained PLD fluctuation f(t) is renewed is described.

In some cases, the belt thickness is changed by a change in environment (temperature and humidity) or wearing in a long-time usage and the Young's modulus of the belt is changed in repetition of bending and stretching depending on the belt material. With this, the PLD of the belt 103 is changed in the passage of time and the PLD fluctuation of belt 103 is also changed. In addition, in some cases, when the belt 103 is changed, the new PLD fluctuation is changed from the previous PLD fluctuation. Further, as described in the belt driving control example 2, the virtual home position may be shifted from the actual home position. In these cases, the PLD fluctuation f(t) must be renewed.

As the renewal method of the PLD fluctuation f(t), two method are mainly assumed. That is, there are a first method in which the PLD fluctuation f(t) is intermittently renewed and a second method in which the PLD fluctuation f(t) is continuously renewed. In the first method, it is monitored whether belt driving control by the PLD fluctuation f(t) is properly executed, and when it is determined that the belt driving control is not being executed properly, the PLD fluctuation f(t) is renewed. In the second method, the PLD fluctuation f(t) is always obtained and the PLD fluctuation f(t) is continuously changed. In addition, there a method in which the PLD fluctuation f(t) is renewed periodically without monitoring the belt driving control.

First, the principle in which the obtained PLD fluctuation f(t) is renewed is described.

When the PLD fluctuation f(t) is once obtained accurately, the rotation angle velocity $\omega_1$ of the first roller 101 is maintained in $\omega_{ref1}$ shown in Equation 42. When the PLD fluctuation f(t) is changed to a PLD fluctuation g(t), the change (shift amount) $\omega_{2\epsilon}$ of the rotation angle velocity of the second roller 102 becomes a value shown in Equation 50.

$$\omega_{2\varepsilon}=\frac{V_0}{R_2}\left[\begin{array}{l}\frac{\kappa_1}{R_1}\{g(t)-f(t)\}- \\ \frac{\kappa_2}{R_2}\{g(t-\tau)-f(t-\tau)\}\end{array}\right] \quad \text{[Equation 50]}$$

Similar to Equation 49, in Equation 50, the change $\omega_{2\epsilon}$ is a result of the addition (subtraction) of the fluctuation component (first term) generated so that the PLD fluctuation f(t) is changed to the PLD fluctuation g(t) in the first roller 101 and the fluctuation component (second term) generated so that the PLD fluctuation f(t) is changed to the PLD fluctuation g(t) in the second roller 102. Therefore, the renewal method when the PLD fluctuation f(t) is changed to the PLD fluctuation g(t) can also correct the errors caused by the shift of the virtual home position described in the belt driving control example 2.

When Equation 50 is modified by using Equation 51 shown below, Equation 52 is obtained. "G" in Equation 52 is the same as that in Equation 29.

$$\epsilon(t)=g(t)-f(t) \quad \text{[Equation 51]}$$

$$\omega_{2\varepsilon} = \frac{V_0\kappa_1}{R_1R_2}[\varepsilon(t) - G\varepsilon(t-\tau)] \quad \text{[Equation 52]}$$

where $\epsilon(t)$ can be obtained by using the recognition method 1, 2, or 3 based on the shift amount $\omega_{2\epsilon}$. That is, similar to the recognition method 1, the $\epsilon(t)$ is detected by shortening the distance between the first roller 101 and the second roller 102, similar to the recognition method 2, the $\epsilon(t)$ is detected by using the filter process, and similar to the recognition method 3, the $\epsilon(t)$ is detected by using the filter process by limiting the distance between rollers. When the $\epsilon(t)$ is obtained, a new PLD fluctuation f'(t) is obtained by adding the $\epsilon(t)$ to the old PLD fluctuation f(t). As shown in Equation 53, the new PLD fluctuation f'(t) is the same as the changed PLD fluctuation g(t).

$$f'(t)=f(t)+\epsilon(t)=f(t)+g(t)-f(t)=g(t) \quad \text{[Equation 53]}$$

Therefore, when the belt driving control is executed by using the new PLD fluctuation f'(t) instead of using the old PLD fluctuation f(t), proper belt driving control corresponding to the changed PLD fluctuation g(t) can be executed.

In the above description, the $\epsilon(t)$ is obtained from the $\omega_{2\epsilon}$ and the PLD fluctuation f(t) is changed to the PLD fluctuation g(t) by using the $\epsilon(t)$. However, a method in which the PLD fluctuation g(t) is directly obtained can be also used.

Next, disposing positions of the rotary encoders which detect the rotation angle velocities $\omega_1$ and $\omega_2$ of the first and second rollers 101 and 102 are described. The rotary encoders are necessary elements for executing the belt driving control.

In the belt driving control, when the rotation angle velocities of two rollers whose diameters are different from each other are detected, the belt moving velocity fluctuation caused by the PLD fluctuation of the belt 103 can be restrained. In this, strictly, that the diameters of the two rollers are different signifies as follows: in the relationship between the two rollers, the recognition sensitivity β in Equation 8 is not 0 or "G" in Equation 29 is not 1. As the disposing positions of the rotary encoders which detect the rotation angle velocity, for example, the following three disposing positions can be assumed. In a disposing position example 1 of the rotary encoders, as shown in FIG. 8, the rotary encoders are disposed in corresponding two driven rollers whose diameters are different from each other. In a disposing position example 2 of the rotary encoders, the rotary encoders are disposed in the driving roller 105 and a driven roller whose diameter is different from that of the driving roller 105. In a disposing position example 3 of the rotary encoders, the rotary encoders are disposed in the driving roller 105 and two driven rollers whose diameters are different from each other, or the rotary encoders are disposed in the driving roller 105 and two driven rollers whose diameters are different from that of the driving roller 105. In this, when the rotary encoder is disposed in the driving roller 105, two cases are included, that is, in one case, the rotary encoder is disposed at the roller axle of the driving roller 105; in the other case, the rotary encoder is disposed at the motor axle of the driving motor 106.

[Disposing Position Example 1 of Rotary Encoders]

In the disposing position example 1, as shown in FIG. 8, the rotary encoders are disposed in the corresponding driven rollers 101 and 102 whose diameters are different from each other. In this case, as described above, a feedback control function is provided so that the rotation angle velocity $\omega_1$ of the first roller 101 becomes the control target value $\omega_{ref1}$ which is determined by the controller 110. Therefore, the PLD fluctuation f(t) can be accurately obtained in a state in which transmission errors in the driving force transmission route and a slide between the driving roller 105 and the belt 103 are corrected. For example, in the state in which the driving roller 105 is controlled in feedback, the PLD fluctuation f(t) is obtained from the detected result of the rotation angle velocity $\omega_2$ of the second roller 102; with this, the highly accurate PLD fluctuation f(t) can be obtained without the transmission errors in the driving force transmission route and the sliding contact between the driving roller 105 and the belt 103.

[Disposing Position Example 2 of Rotary Encoders]

Figure 9:
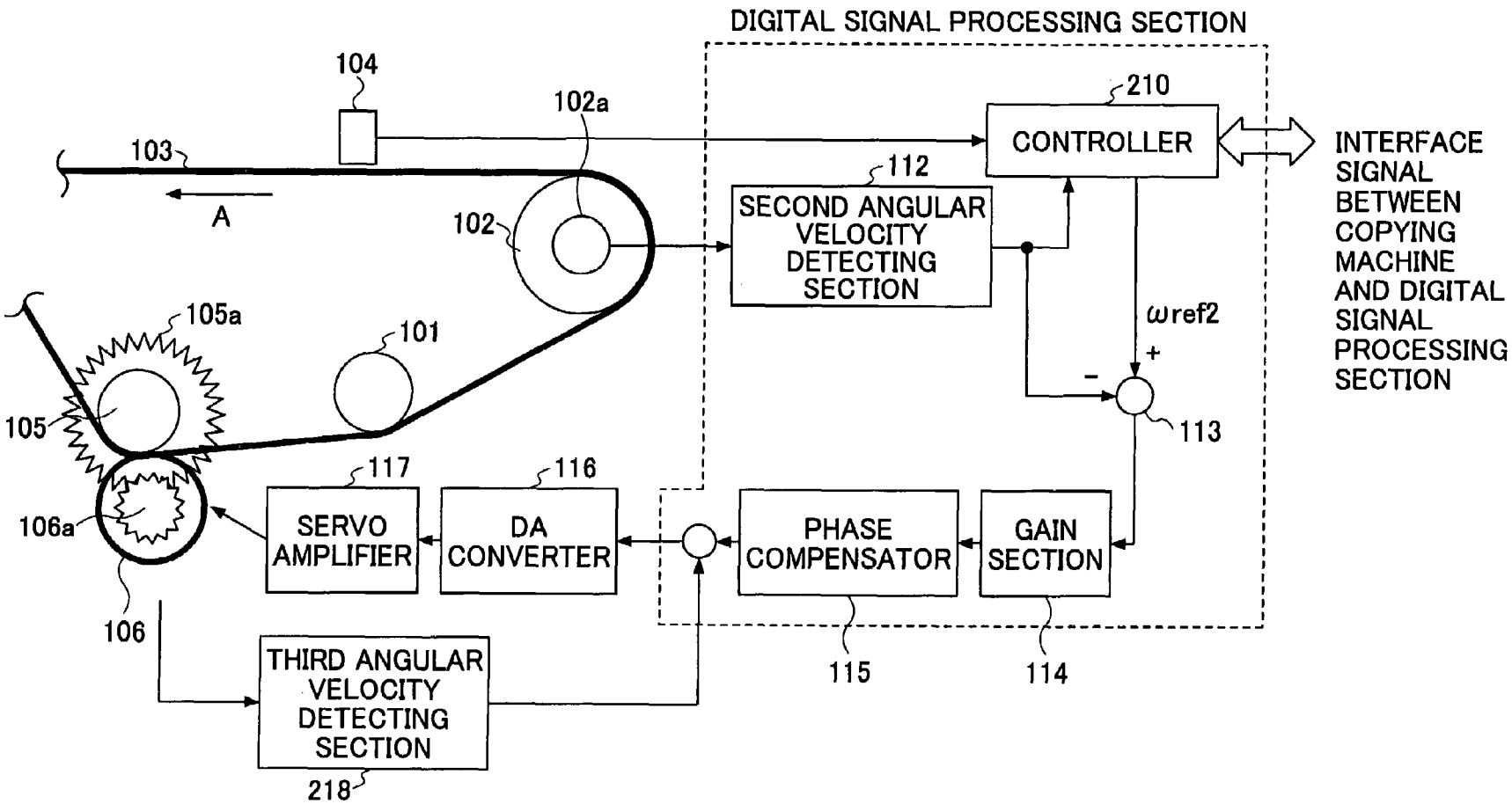
FIG. 9 is a diagram for explaining control operations in a disposing position example 2 of rotary encoders according to the embodiment of the present invention.

FIG. 9 is a diagram for explaining control operations in the disposing position example 2 of the rotary encoders. As shown in FIG. 9, in the disposing position example 2, the driving motor 106 is connected to the driving roller 105 via gears 106*a* and 105*a*. As the driving motor 106, a DC servo motor is used and a rotation angle velocity is detected by attaching a rotary encoder (not shown) to the motor axle or the driving roller axle for feedback control. A stepping motor which can control the rotation angle velocity by using an input driving pulse frequency can be used instead of using the DC servo motor. In this case, the rotation angle velocity can be controlled by the input driving pulse frequency to the stepping motor without the feedback by the rotary encoder; therefore, the rotary encoder is not needed at the motor axle or the driving roller axle. Consequently, in the disposing position example 2, the rotation angle velocity $\omega_m$ of the driving roller 105 and the rotation angle velocity $\omega_2$ of the driven roller (second roller) 102 can be detected. That is, as shown in FIG. 9, a third angular velocity detecting section 218 which detects the rotation angle velocity $\omega_m$ is disposed, and a second angular velocity detecting section 112 which detects the rotation angle velocity $\omega_2$ is disposed. In addition, the rotation angle velocity $\omega_m$ of the driving roller 105 and the rotation angle velocity of the driving motor axle have a constant relationship. Therefore, the rotation angle velocity $\omega_m$ of the driving roller 105 corresponds to the rotation angle velocity $\omega_1$ of the first roller 101 in the disposing position example 1. However, when a velocity reduction mechanism is provided, the rotation angle velocity $\omega_1$ must be obtained by considering the reduction ratio. Consequently, similar to the disposing position example 1, in the disposing position example 2, the PLD fluctuation f(t) can be obtained at high accuracy. However, in the disposing position example 2, in the rotation angle velocity $\omega_2$ of the second roller 102 which is detected at the second angular velocity detecting section 112, fluctuations caused by errors in the driving force transmission route and the sliding contact between the driving roller 105 and the belt 103 are included. Therefore, the PLD fluctuation f(t) must be obtained by removing the above fluctuations. Especially, in order not to slide the driving roller 105 on the belt 103, a friction coefficient must be increased by making the surface of the driving roller 105 rough. In the disposing position example 2, when the stepping motor is used as the driving motor 106, since the rotary encoder is not needed in the first roller 101, the number of components is reduced and the cost can be reduced.

[Disposing Position Example 3 of Rotary Encoders]

Figure 10:
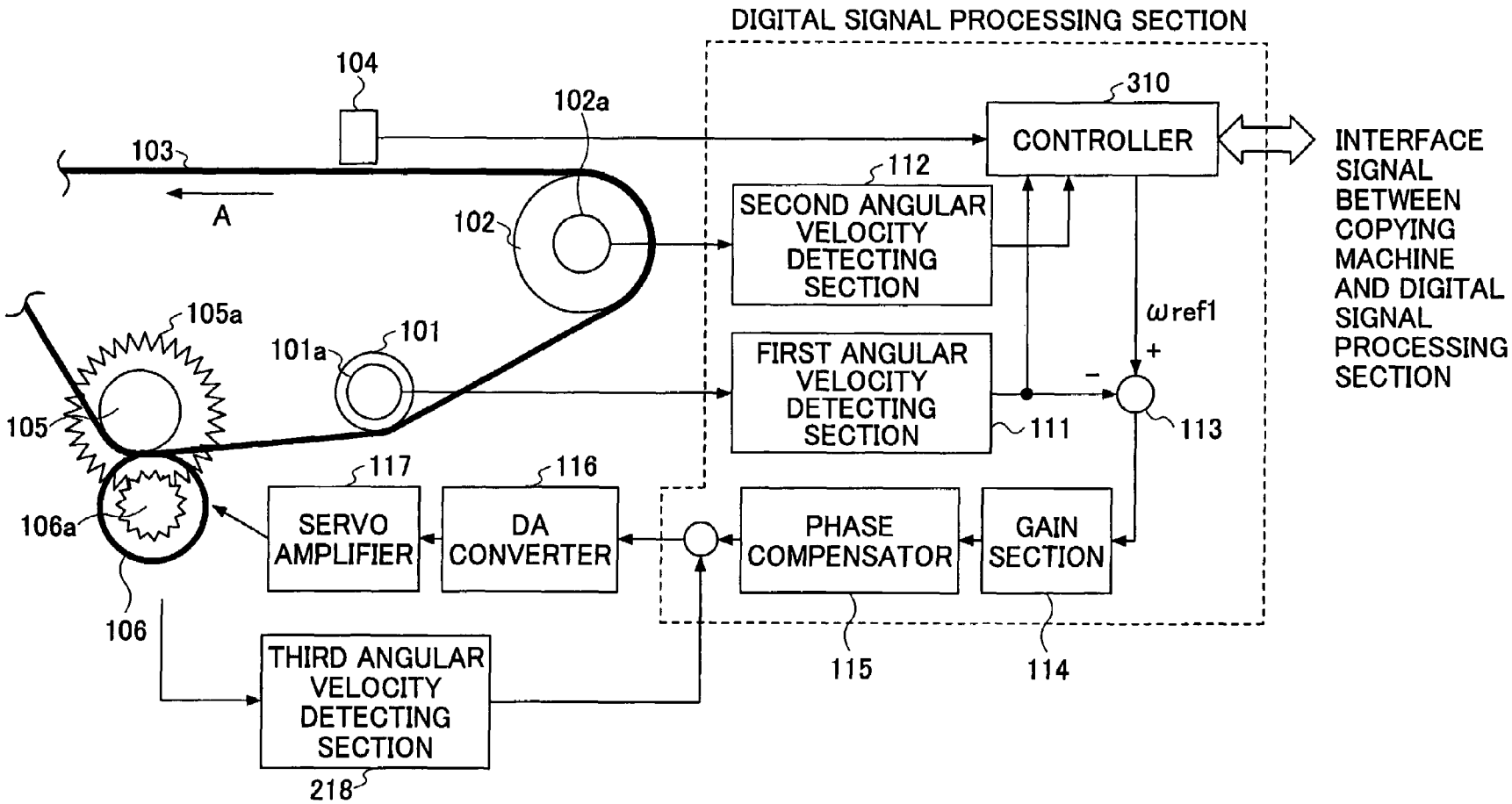
FIG. 10 is a diagram for explaining control operations in a disposing position example 3 of the rotary encoders.

FIG. 10 is a diagram for explaining control operations in the disposing position example 3 of the rotary encoders. Similar to the disposing position example 2, in the disposing position 3, as the driving motor 106, a servo motor or a stepping motor which can control the rotation angle velocity is used. In addition, in the disposing position example 3, similar to the disposing position example 1, the rotary encoders 101*a* and 102*a* are disposed in the corresponding driven rollers 101 and 102 whose diameters are different from each other, respectively. Therefore, similar to the disposing position example 1, in the disposing position example 3, the PLD fluctuation f(t) can be obtained at high accuracy. In addition, in the disposing position example 3, a minor loop structure, in which the rotation angle velocity $\omega_m$ of the driving motor axle is obtained, is used; that is, as shown in FIG. 10, similar to the disposing position example 2, the third angular velocity detecting section 218 which detects the rotation angle velocity $\omega_m$ is disposed. Therefore, a more stable control system can be realized.

In addition, the driving motor axle is rotated at a constant rotation angle velocity; that is, the driving roller 105 is driven at a constant rotation angle velocity, and the average rotation angle velocities of the first roller 101 and the second roller 102 are obtained. With this, the diameter ratio between the first roller 101 and the second roller 102 can be obtained. Consequently, even when the roller effective radiuses $R_{1\ and\ R_2}$ of the first and second rollers 101 and 102, which are used to obtain the PLD fluctuation f(t), are shifted from the references, caused by, for example, the dispersion of the diameters of the first and second rollers 101 and 102 in the manufacturing process, or the changes of the diameters in an environment change and in the passage of time, the diameter ratio can be corrected. As described above, the roller effective radius R is shown by ($r+PLD_{ave}$) and is changed by the dispersion of the roller radius "r" and the $PLD_{ave}$ of the belt. In Equation 27, the roller effective radius R is an important parameter; when the diameter ratio is obtained accurately, the PLD fluctuation can be detected at high accuracy. The ratio of the roller effective radiuses R of the first and second rollers 101 and 102 can be obtained from a rotation angle velocity ratio or a rotation angle ratio between the first and second rollers 101 and 102 by controlling the first roller 101 at a constant rotation angle velocity. This description is the same as that in the disposing position examples 1 and 2. In addition, in the disposing position example 3, the PLD fluctuation effective coefficients $\kappa_1$ and $\kappa_2$ of the first and second rollers 101 and 102 can be corrected. That is, the PLD fluctuation $f_2(t)$ is obtained by using the rotation angle velocity $\omega_d$ of the driving roller 105 and the rotation angle velocity $\omega_2$ of the second roller 102. Further, the PLD fluctuation $f_1(t)$ is obtained by using the rotation angle velocity $\omega_d$ of the driving roller 105 and the rotation angle velocity $\omega_1$ of the first roller 101. The two obtained PLD fluctuations $f_1(t)$ and $f_2(t)$ must be the same because those are of the same belt. However, even if the roller effective radiuses $R_1$ and $R_2$ of the first and second rollers 101 and 102 are normal, when the PLD fluctuation effective coefficients $\kappa_1$ and $\kappa_2$ have setting errors, the two obtained PLD fluctuations $f_1(t)$ and $f_2(t)$ may not be the same. In this case, when PLD fluctuation effective coefficient ratios $p\kappa_1=\kappa_1/\kappa_d$ and $p\kappa_2=\kappa_2/\kappa_d$ ($\kappa_d$: PLD fluctuation effective coefficient at the driving roller 105), in which the two PLD fluctuations $f_1(t)$ and $f_2(t)$ become the same, are obtained, and the ratio $\kappa_2/\kappa_1$ of the PLD fluctuation effective coefficients is corrected, the ratio $R_1/R_2$ between the roller effective radiuses $R_{1\ and\ R2}$ of the first and second rollers 101 and 102 can be obtained accurately. Therefore, it is understandable that the PLD fluctuation f(t) can be accurately recognized from Equation 27. When the roller effective radius and the PLD fluctuation effective coefficient of any one of the first roller 101 and the second roller 102 are likely to fluctuate, the above correction is effective.

Next, a method in which the ratio of the

PLD fluctuation effective coefficients κ of the first and second rollers 101 and 102 are obtained is described. As it can be easily estimated from Equation 27, the relationship between the driving roller 105 and the first roller 101 can be expressed in Equations 50 and 51. In addition, the relationship between the driving roller 105 and the second roller 102 can be expressed in Equations 52 and 53.

$$(\omega_1 - pR_1 \cdot \omega_d)\frac{R_1}{\omega_d \kappa_d} = \{f_1(t) - p\kappa_1 \cdot pR_1 f_1(t-\tau_1)\} \quad \text{[Equation 54]}$$

$$G_1 = p\kappa_1 \cdot pR_1 \quad \text{[Equation 55]}$$
$$pR_1 = \frac{R_d}{R_1}$$
$$p\kappa_1 = \frac{\kappa_1}{\kappa_d}$$

where $\omega_d$ is the rotation angle velocity of the driving roller 105, Rd is the effective radius of the driving roller 105, and $\tau_1$ is the delay time which is determined when the belt 103 passes through between the driving roller 105 and the first roller 101.

$$(\omega_2 - pR_2 \cdot \omega_d)\frac{R_2}{\omega_d \kappa_d} = \{f_2(t) - p\kappa_2 \cdot pR_2 f_2(t-\tau_2)\} \quad \text{[Equation 56]}$$

$$G_2 = p\kappa_2 \cdot pR_2 \quad \text{[Equation 57]}$$
$$pR_2 = R_d / R_2$$
$$p\kappa_2 = \kappa_2 / \kappa_d$$

where $\tau_2$ is the delay time which is determined when the belt 103 passes through between the driving roller 105 and the second roller 102.

Next, the ratios $pR_1$ and $pR_2$ of the roller effective radiuses are obtained by using the above method, and $R_2$ in the left side of Equation 56 is replaced by $R_2=(pR_1/pR_2)$. By changing the PLD fluctuation effective coefficient ratio $p\kappa_1=\kappa_1/\kappa_d$ or $p\kappa_2=\kappa_2/\kappa_d$ corresponding to one of the PLD fluctuation effective coefficients $\kappa_1$ and $\kappa_2$ which is likely to be changed, the PLD fluctuation obtained result is made to be $f_1(t)=f_2(t)$. From the obtained effective coefficient ratios, the ratio $\kappa_2/\kappa_1$ of the PLD fluctuation effective coefficients of the first roller 101 and the second roller 102 is obtained ($p\kappa_2/p\kappa_1=(\kappa_2/\kappa_d)/(\kappa_1/\kappa_d)=\kappa_2/\kappa_1$). With this, the PLD fluctuation f(t) can be recognized more accurately. When the fluctuation of the roller effective radius $R_1$ at the left side in Equation 54 is obtained as small beforehand, the PLD fluctuation can be recognized much more accurately. Or, when the fluctuation of the roller effective radius $R_2$ at the left side in Equation 56 is obtained as small beforehand, the PLD fluctuation can be recognized much more accurately.

In this, when rotation information is detected so as to obtain the ratio of the roller effective radiuses and the ratio of the PLD fluctuation effective coefficients, it is preferable to drive slowly so as to avoid sliding contact between the driving roller 105 and the belt 103.

FIRST EMBODIMENT

Next, the renewal of the PLD fluctuation f(t) according to a first embodiment of the present invention is described. In the first embodiment, the recognition method 2 of the PLD fluctuation f(t) is used. In addition, an example similar to the belt driving control example 2 is used and an example similar to the disposing position example 3 of the rotary encoders is used. That is, like in the belt driving control example 2, a mechanism which detects the home position of the belt 103 is not used, and like in the disposing position example 3, a rotary encoder is disposed at the motor axle of the driving motor 106 and the rotary encoders 101*a* and 102*a* are disposed in the corresponding first and second rollers 101 and 102 whose diameters are different from each other, respectively. In this case, a structure in which the rotary encoder is not disposed at the motor axle is possible.

Figure 11:
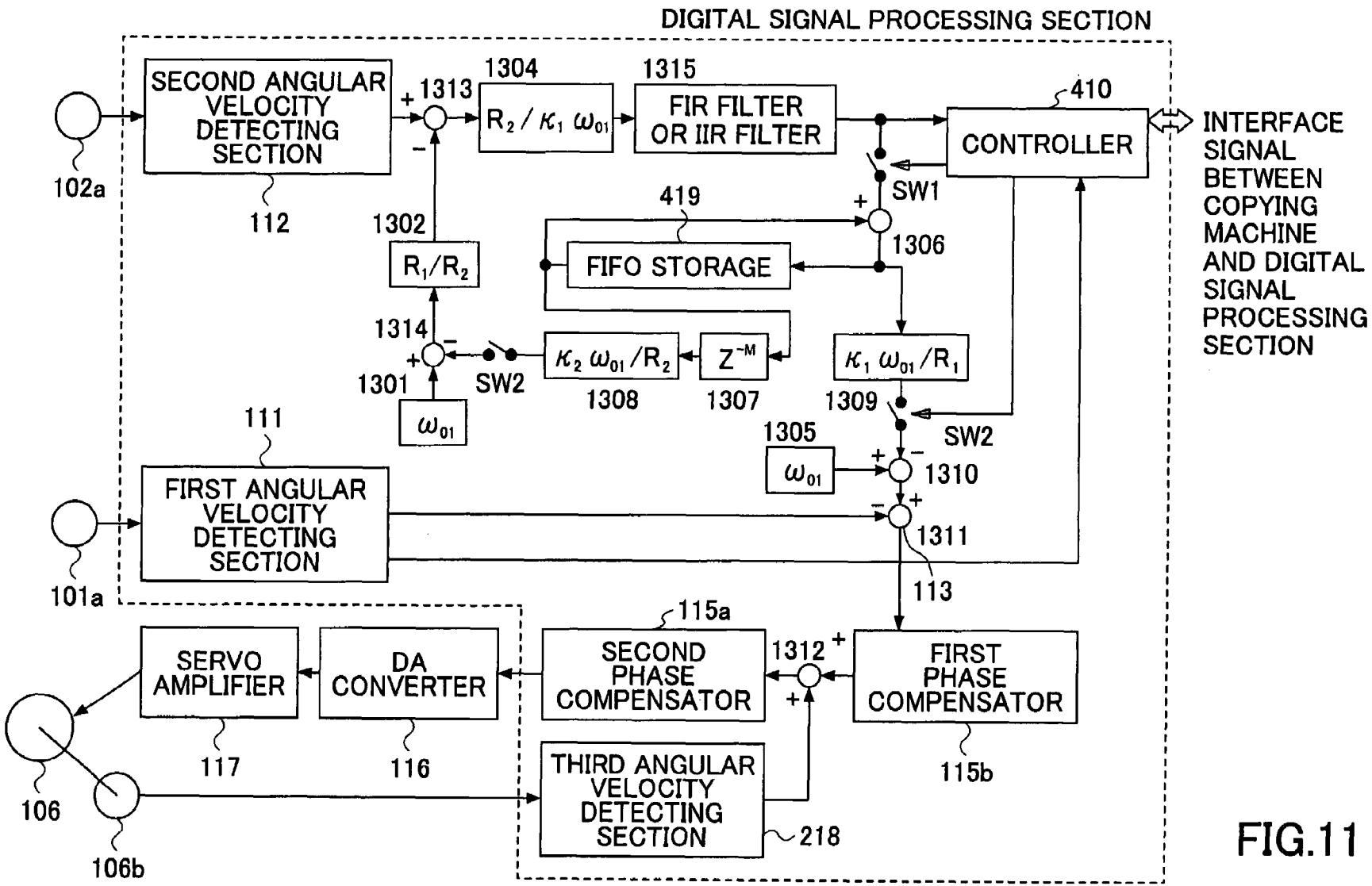
FIG. 11 is a diagram for explaining renewal of a PLD fluctuation according to a first embodiment of the present invention.

FIG. 11 is a diagram for explaining the renewal of the PLD fluctuation according to the first embodiment of the present invention. In FIG. 11, a rotary encoder 106*b* is disposed in a DC servo motor which is used as the driving motor 106. In addition, a digital signal processing section which is a control unit and is surrounded by a dashed line includes a digital circuit, a DPS, a μCPU, a RAM, a ROM, FIFO storage, and so on. The hardware structure of the control unit is not limited to the above structure, and some elements can be replaced by operations of firmware.

In the first embodiment, since the mechanism which detects the home position of the belt 103 is not included, as described in the belt driving control example 2, a phase shift occurs by shifting the virtual home position. In addition, there is a risk that the PLD fluctuation occurs due to an environment change and the passage of time. Therefore, the PLD fluctuation f(t) obtained in the past must be renewed. In the first embodiment, it can be arbitrarily determined whether the renewal of the PLD fluctuation is performed continuously or intermittently corresponding to the workload on an operations processing section such as a CPU.

In a case where the renewal of the PLD fluctuation is intermittently executed, it is monitored whether the accuracy of the PLD fluctuation f(t) is within a predetermined tolerance by confirming the fluctuation of the belt moving velocity. When the accuracy of the PLD fluctuation f(t) exceeds the predetermined tolerance, the PLD fluctuation f(t) is renewed. Specifically, as described above, it is determined whether the absolute value, the average of the absolute values, the mean-square value, or the root-mean-square value of the absolute values of the $\epsilon(t)$ in Equation 51 is within a predetermined tolerance, and when the value of the $\epsilon(t)$ exceeds the predetermined tolerance, the PLD fluctuation f(t) is renewed. It is possible to renew the PLD fluctuation periodically corresponding to the hours of operation or the amount of operations of the copying machine. After the PLD fluctuation is renewed, when the absolute value, the average of the absolute values, the mean-square value, or the root-mean-square value of the absolute values of the $\epsilon(t)$ in Equation 51 is not within the predetermined tolerance, since initial values as the premises have some errors, the errors are reported.

The first embodiment of the present invention is described in detail. First, a controller 410 turns off switches SW1 and SW2, compares the reference signal data $\omega_{01}(=V_0/R_1)$ with the rotation angle velocity $\omega_1$ of the first roller 101 detected by the first angular velocity detecting section 111, and drives the belt 103 so that the rotation angle velocity of the first roller 101 becomes a constant rotation angle velocity (the reference signal data) $\omega_{01}$. Two phase compensators 115*a* and 115*b* reduce general errors and functions to execute stable feedback control. When the rotation angle velocity $\omega_1$ of the first roller 101 becomes the constant rotation angle velocity $\omega_{01}$, the rotation angle velocity $\omega_2$ of the second roller 102 detected by the second angular velocity detecting section 112 becomes a velocity shown in Equation 58, from Equation 27.

$$\omega_2 = \frac{R_1}{R_2}\omega_{01} + \frac{\kappa_1}{R_2}\omega_{01}\{f(tn) - Gf(tn-\tau)\} \quad \text{[Equation 58]}$$

where "G" is the same as that shown in Equation 29. In addition, in the first embodiment, since digital processing is executed, instead of using the time "t", "tn" which is expressed discretely is used. Therefore, the above PLD fluctuation f(t) is replaced by the PLD fluctuation f(tn).

The PLD fluctuation f(tn) is obtained from the rotation angle velocity $\omega_2$ of the second roller 102, and data of the PLD fluctuation f(tn) in one round of the belt 103 are stored in FIFO storage 419 (belt thickness fluctuation data storage). In this process, at a state in which the switches SW1 and SW2 are turned off, fixed data $(R_1\cdot\omega_{01})/R_2$ operated on at a block 1302 are subtracted from the detected rotation angle velocity $\omega_2$ of the second roller 102 at a subtractor 1313. Data output from the subtractor 1313 are multiplied by fixed data $R_2/(\kappa_1\cdot\omega_{01})$ at a block 1304 and data output from the block 1304 are input to a FIR filter (or IIR filter) at a block 1315. That is, the data output from the block 1304 are $f(tn)-Gf(tn-\tau)$ and are input to the block 1315 (FIR filter or IIR filter). Data output from the block 1315 become data fn ($n^{th}$ time discrete PLD fluctuation data) of which a data string of the PLD fluctuation f(nt) is composed. The controller 410 monitors the rotation angle velocity $\omega_1$ of the first roller 101, and when the rotation angle velocity $\omega_1$ is a constant velocity, and after a time is passed, in which normal PLD fluctuation data fn are output from the block 1315, the controller 410 turns on the switch SW1. Since the FIR filter and the IIR filter include a delay element, at the filtering initial time the normal PLD fluctuation data fn are not output. Therefore, the above operation is executed. When the controller 410 confirms that the belt 103 moves around by counting the number of pulses output from the first rotary encoder 101*a* of the first roller 101, the controller 410 turns off the switch SW1. The data of the PLD fluctuation f(tn) output from the block 1315 (FIR filter or IIR filter) are stored in the FIFO storage 419 which can store the data fn of the PLD fluctuation f(tn) of one round of the belt 103. In the first embodiment, when the FIFO storage 419 is empty, the switch SW1 is turned on and the data of the PLD fluctuation f(tn) are stored in the FIFO storage 419.

As described above, the data of the PLD fluctuation f(tn) are stored in the FIFO storage 419 corresponding to the rotation of the belt 103. When the rotation angle velocity reference data $\omega_{ref1}$ of the first roller 101 is obtained by using the stored PLD fluctuation data corresponding to Equation 59, the belt driving control corresponding to the data of the PLD fluctuation f(tn) is executed.

$$\omega_{ref1} = \omega_{01}\{1 - \kappa_1 / R_1 f(tn)\} \quad \text{[Equation 59]}$$

Operations in the parentheses of Equation 59 are executed by a block 1309. When the two switches SW2 are turned on, the data of the rotation angle velocity reference $\omega_{ref1}$ of the first roller 101 are output from a subtractor 1310.

In addition, when the two switches SW2 are turned on, the control errors $\omega_{2\epsilon}$ shown in Equation 52 are detected. In this operation, first, the rotation angle velocity fluctuation of the second roller 102, which is predicted from the data of the PLD fluctuation f(tn) stored in the FIFO storage 419, is operated in blocks 1307 and 1308. The constant rotation angle velocity $\omega_{o1}$ in a block 1301 is added to the rotation angle velocity fluctuation of the second roller 102, and the added result is operated on in the block 1302. The operated on result is subtracted from the rotation angle velocity $\omega_2$ detected at the second angular velocity detecting section 112 in the subtractor 1313. The output from the subtractor 1313 becomes $\omega_{2\epsilon}$ shown in Equation 52 and is input to the block 1304. Then, the output from the block 1304 is input to the block 1315, and the output from the block 1315 is input to the controller 410 as the PLD fluctuation error data $\epsilon$n. When the PLD fluctuation error data $\epsilon$n exceed a predetermined value, the controller 410 turns on the switch SW1 for only a period corresponding to the one round of the belt 103 and obtains new data fn of the PLD fluctuation f(tn) and stores the new data in the FIFO storage 419, that is, the controller 410 renews the data of the PLD fluctuation f(tn). In this, when the switches SW1 and SW2 are turned on where the PLD fluctuation data before being renewed are stored in the FIFO storage 419, a revision of the PLD fluctuation data shown in Equation 53 is executed in an adder 1306 and the revised PLD fluctuation data are stored in the FIFO storage 419.

In this, when the data of the PLD fluctuation f(tn) are store in the FIFO storage 419, it is possible that the data of the PLD fluctuation f(tn) of the plural round times of the belt 103 are obtained and averaged data of the obtained data are store in the FIFO storage 419. In this case, the FIFO storage 419 also functions as a past information storing unit. In addition, similarly, it is possible that the PLD fluctuation error data En of the plural round times of the belt 103 are obtained and averaged data of the obtained data are used. In this case, errors caused by random fluctuations generated by backlash and noise of gears can be deduced.

Next, a case in which the renewal of the PLD fluctuation f(tn) is continuously executed is described. In this case, the revision of the PLD fluctuation shown in Equation 53 is always executed. That is, in FIG. 11, the switches SW1 and SW2 are turned on.

Specifically, first, when the RIFO storage 419 is empty, the controller 410 turns off the SW1, compares the reference signal data $\omega_{01}$ with the rotation angle velocity $\omega_1$ of the first roller 101 detected by the first angular velocity detecting section 111, and drives the belt 103 so that the rotation angle velocity of the first roller 101 becomes a constant rotation angle velocity (the reference signal data) $\omega_{01}$. When the output from the block 1315 (FIR filter or IIR filter) becomes stable, the controller 410 turns on the switch SW1 and stores the data of the PLD fluctuation f(tn) of the one round of the belt 103 in the FIFO storage 419. After this, when the switches SW1 and SW2 are turned on, data in which the data $\epsilon$n output from the block 1315 and the data output from the FIFO storage 419 are added are input to the FIFO storage 419. The input data are new PLD fluctuation data. The data En are PLD fluctuation error data obtained from the output of the block 1315 by the relationship shown in Equations 46 and 48. In this case, the data of the PLD fluctuation f(tn) in which the errors are corrected are stored in the block 1315 corresponding to the one round of the belt 103. When the reference data $\omega_{ref1}$ of the first roller 101 is generated corresponding to Equation 59 by using the data of the PLD fluctuation f(tn), the belt driving control corresponding to the PLD fluctuation f(tn) is executed. At this time, when the controller 410 determines that the PLD fluctuation error data $\epsilon$n exceed a predetermined value, the controller 410 informs the copying machine of the abnormal condition.

In the first embodiment, the data of the PLD fluctuation f(tn) are held in the FIFO storage 419 in which input data are shifted by a clock signal or in a memory function of the block 1307 in which input data are output by being delayed by a certain time. However, the memory can be a memory function in which addresses are controlled.

SECOND EMBODIMENT

Next, the renewal of the PLD fluctuation f(tn) according to a second embodiment of the present invention is described. In the second embodiment, the data fn of the PLD fluctuation f(tn) are not revised but newly obtained PLD fluctuation data fn are stored in the FIFO storage 419 in order. In the following example, the newly obtained PLD fluctuation data fn are stored in the FIFO storage 419 in order and the data of the PLD fluctuation f(tn) are renewed by using the data of the PLD fluctuation f(tn) of the previous one round of the belt 103.

First, the rotation angle velocity $\omega_2$ of the second roller 102 is detected, and new PLD fluctuation data gn are obtained from data in which the reference data $\omega_{ref1}$ obtained from the data of the PLD fluctuation f(tn) stored in the FIFO storage 419 are removed. That is, the rotation angle velocity $\omega_2'$ of the second roller 102 is detected by setting the virtual home position as a reference, when the belt driving control is executed based on the data of the PLD fluctuation f(tn) stored in the FIFO storage 419. Then, the reference data $\omega_{ref1}$ are multiplied by $(R_1/R_2)$ and the multiplied result is subtracted from the rotation angle velocity $\omega_2'$; then new reference data are obtained by using a signal $\omega_2''$ which is obtained from the subtracted result. The belt driving control is executed by the new reference data.

The rotation angle velocity $\omega_2'$ of the second roller 102 detected by setting the virtual home position as the reference is shown in Equation 60.

$$\omega_2' = R_1\omega_{01}/R_2[1+\kappa_1/R_1\{g(tn)-f(tn)\}-\kappa_2/R_2\{g(tn-\tau)\}] \quad \text{[Equation 60]}$$

The signal $\omega_2''$ is obtained from Equation 61.

$$\omega_2'' = \omega_2' - \frac{R_1}{R_2}\omega_{ref1} \quad \text{[Equation 61]}$$

Therefore, Equation 62 is obtained from Equation 59 and Equation 60. The "G" in Equation 62 is the same as that in Equation 29 and is a value which is less than 1 from the relationship of the roller diameter ratio between the first roller 101 and the second roller 102 in the second embodiment.

$$\omega_2'' = \frac{\kappa_1}{R_2}\omega_{01}\{g(tn)-Gg(tn-\tau)\} \quad \text{[Equation 62]}$$

The PLD fluctuation data g(tn) can be obtained from Equation 62. Specifically, for example, a data string of new PLD fluctuation data gn is obtained from the FIR filter or the IIR filter.

Figure 12:
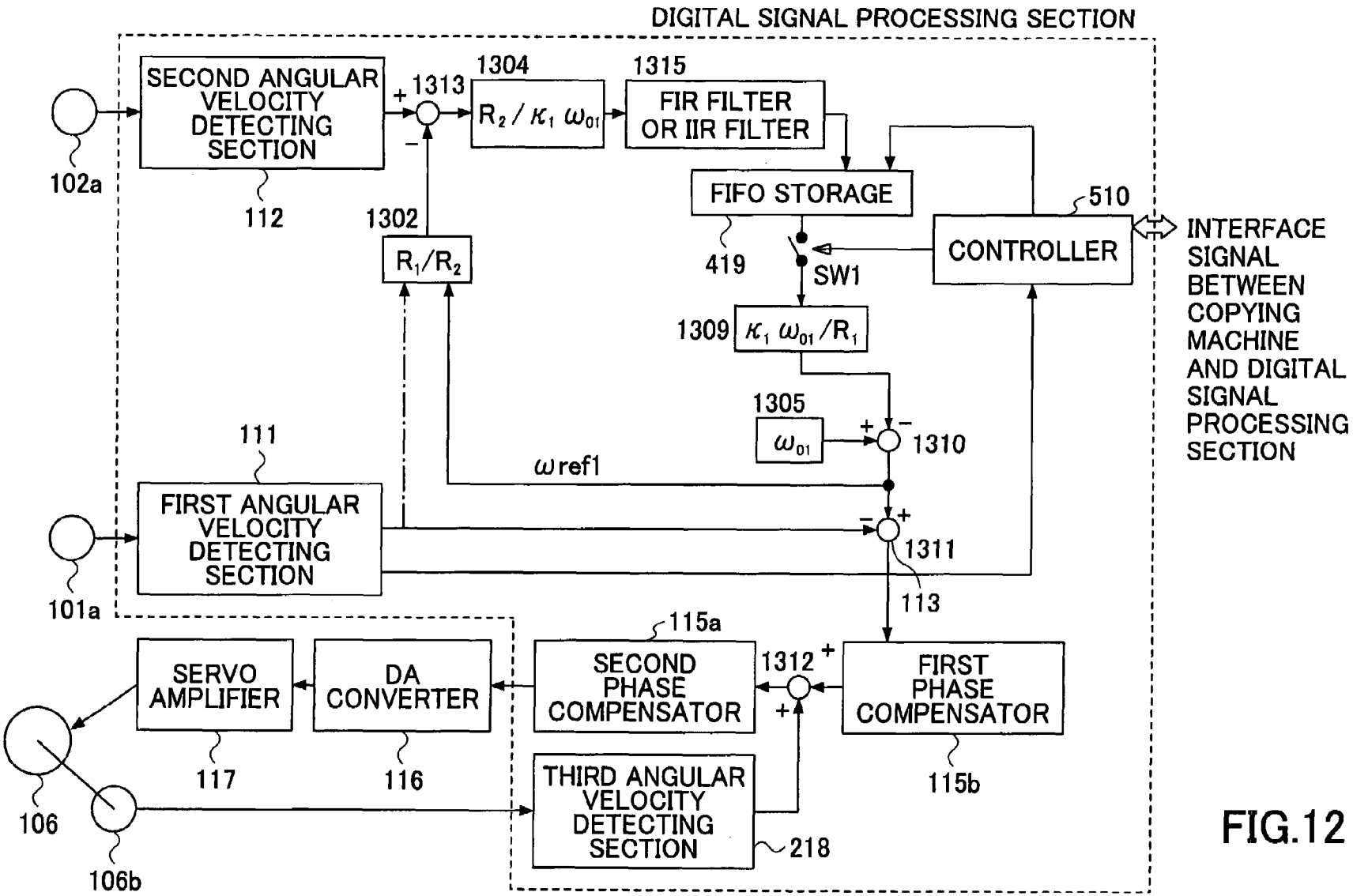
FIG. 12 is a diagram for explaining the renewal of the PLD fluctuation according to a second embodiment of the present invention.
Figure 13:
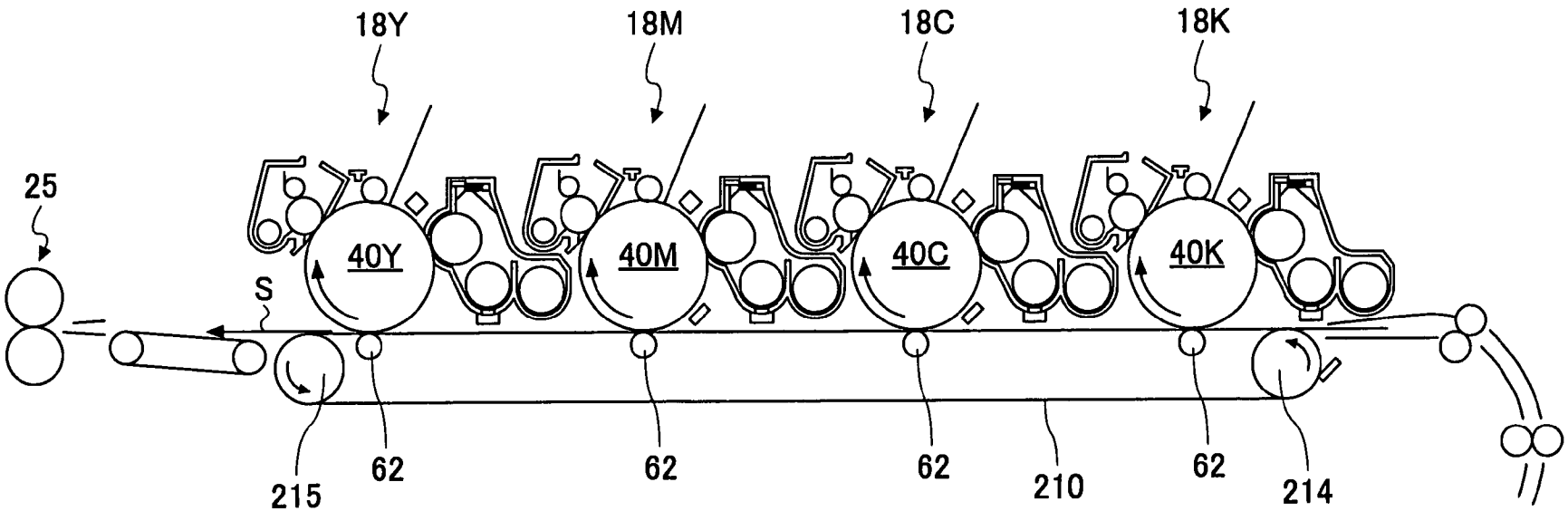
FIG. 13 is a diagram showing a part of a tandem type image forming apparatus which uses a direct image transfer system.
Figure 14:
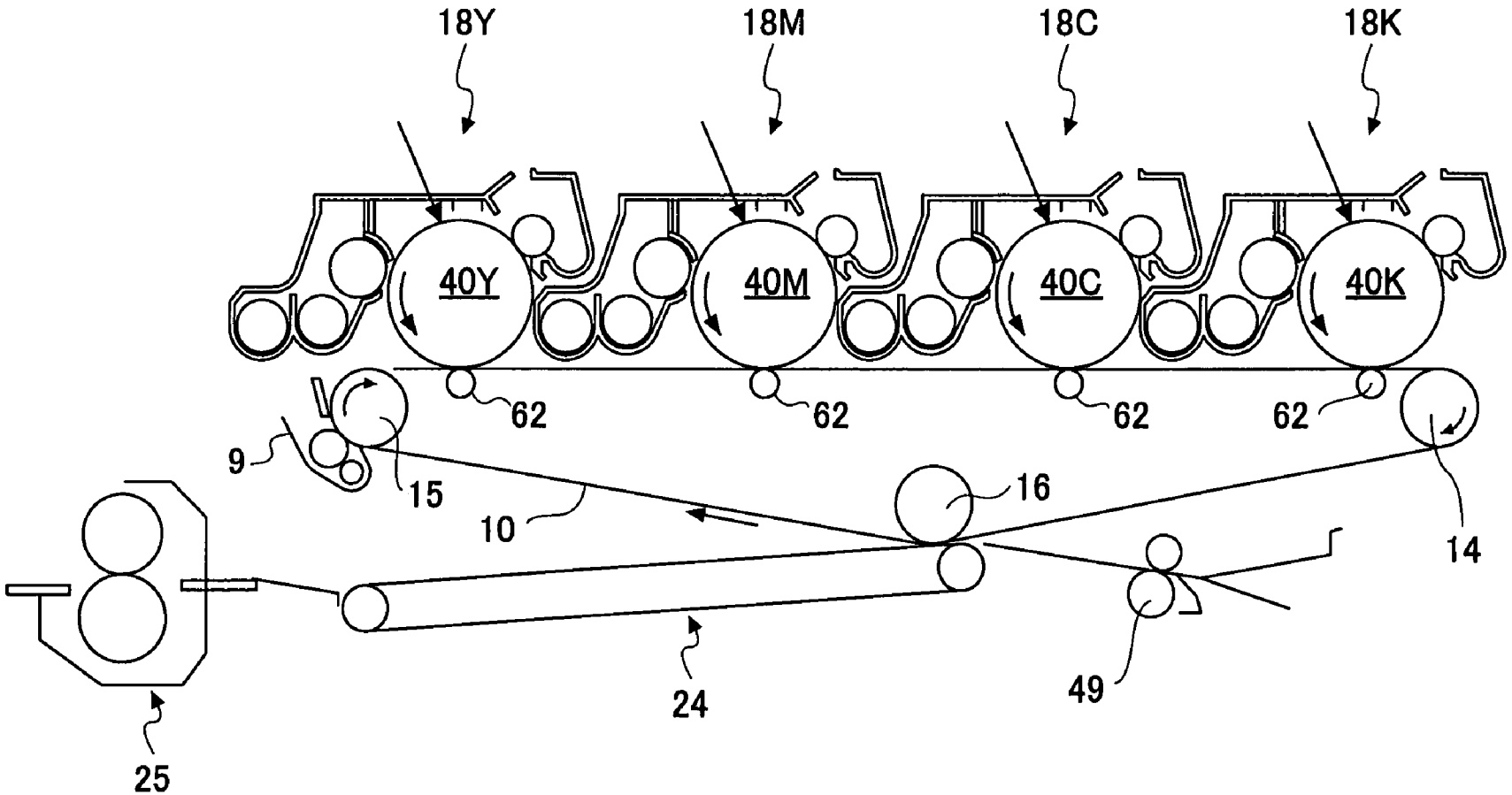
FIG. 14 is a diagram showing a part of a tandem type image forming apparatus which uses an intermediate transfer system.
Figure 15:
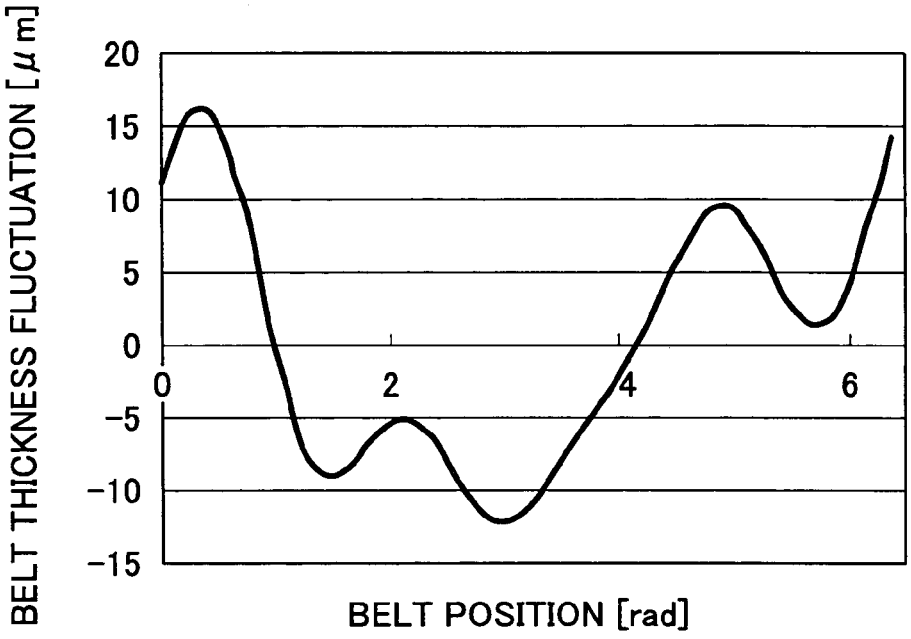
FIG. 15 is a graph showing an example of a belt thickness fluctuation in the moving direction of an intermediate transfer belt shown in FIG. 14.

FIG. 12 is a diagram for explaining the renewal of the PLD fluctuation according to the second embodiment of the present invention. In FIG. 12, similar to the first embodiment, a rotary encoder 106*b* is disposed in a DC servo motor which is used as the driving motor 106. In addition, a digital signal processing section which is surrounded by a dashed line includes a digital circuit, a DPS, a μCPU, a RAM, a ROM, FIFO storage, and so on. The hardware structure of the digital signal processing section is not limited to the above structure, and some elements can be replaced by operations of firmware.

First, a controller 510 turns off a switch SW1, compares the reference signal data $\omega_{01}(=V_0/R_1)$ with the rotation angle velocity $\omega_1$ of the first roller 101 detected by the first angular velocity detecting section 111, and drives the belt 103 so that the rotation angle velocity of the first roller 101 becomes a constant rotation angle velocity (the reference signal data) $\omega_{01}$. When the rotation angle velocity $\omega_1$ of the first roller 101 becomes the constant rotation angle velocity $\omega_{01}$, the rotation angle velocity $\omega_2$ of the second roller 102 detected by the second angular velocity detecting section 112 becomes a value shown in Equation 63.

$$\omega_2 = R_1\omega_{01}/R_2[1+\kappa_1/R_1\{f(tn)\}-\kappa_2/R_2\{f(tn-\tau)\}] \quad \text{[Equation 63]}$$

The $\omega_{01}$ output from a subtractor 1310 is multiplied by $(R_1/R_2)$ at a block 1302, and fixed data $(R_1\cdot\omega_{01})/R_2$ are input to a subtractor 1313. Data output from the subtractor 1313 are multiplied by fixed data $R_2/(\kappa_1\cdot\omega_{01})$ at a block 1304. Data output from the block 1304 are input to a block 1315 (FIR filter or IIR filter). That is, the data output from the block 1304 are f(tn)−Gf(tn−τ) and are input to the block 1315 (FIR filter or IIR filter). Data output from the block 1315 become the PLD fluctuation data of which a data string of the PLD fluctuation f(tn) is composed. The controller 510 monitors the rotation angle velocity $\omega_1$ of the first roller 101; when the rotation angle velocity $\omega_1$ is a constant velocity, and after a time in which normal PLD fluctuation data fn are output from the block 1315 is passed, the controller 510 turns on the switch SW1. Since the FIR filter and the IIR filter include a delay element at the filtering initial time, the normal PLD fluctuation data fn are not output. Therefore, the above operation is executed. When the reference data $\omega_{ref1}$ of the first roller 101 are obtained by Equation 59 by using the data of the PLD fluctuation f(tn) at the block 1309, belt driving control corresponding to the PLD fluctuation f(tn) is executed.

In the second embodiment, the FIFO storage 419 is disposed in a structure in which a time is required in operations for obtaining the data of the PLD fluctuation f(tn) and in digital signal processing including the multiplication at the block 1309. That is, the reference data $\omega_{ref1}$ are generated by the PLD fluctuation data of the previous one round of the belt 103. In addition, since the rotation angle velocity $\omega_1$ of the first roller 101 is controlled by the reference data $\omega_{ref1}$, as shown in an alternate long and short dash line in FIG. 12, a structure in which the rotation angle velocity $\omega_1$ of the first roller 101 is directly input to the block 1302 can be used.

In addition, in the second embodiment, when DC component errors caused by dispersion of the diameters of the first roller 101 and the second roller 102 in manufacturing process, a temperature change, or operation errors are included in the signal $\omega_2''$, errors occur in the FIR filtering process or the IIR filtering process. When the errors are large, a high pass filter which removes DC components of the signal $\omega_2''$ is disposed before the FIR filter or the IIR filter.

In the first and second embodiments, the recognition method 2 of the PLD fluctuation f(t) is used. However, the recognition methods 1 and 3 can be used. When the recognition method 1 is used, a multiplication block of 1/(1−G) is used instead of using the block 1315 (FIR filter or IIR filter). In the recognition method 1, in the f(tn)−Gf(tn−τ) which is the output from the block 1304, an approximation f(tn)=f(tn−τ) is used, and the data of the PLD fluctuation f(tn) are calculated as (1−G)f(tn). Therefore, the multiplication block of 1/(1−G) is used. When the recognition method 3 is used, a FIR filter of Nb stages is disposed and a multiplication block of $1/(1-G^m)$ is disposed behind the FIR filter of Nb stages, instead of using the block 1315 (FIR filter or IIR filter), in this, $m=2^{Nb}$.

In addition, in the first and second embodiments, in order to remove fluctuations in rotation cycles of the first roller 101 and the second roller 102, other cyclic fluctuations, fluctuations in a high frequency region including noise, a low pass filter can be disposed, based on the rotation angle velocity $\omega_2$ of the second roller 102 detected by the second angular velocity detecting section 112. With this, correction control of the belt moving velocity fluctuation caused by the PLD fluctuation can be stably executed at high accuracy. The low pass filter is disposed in front of the RIR filter or the IIR filter or behind the second angular velocity detecting section 112. In addition, in order to reduce random detection errors caused by backlash and noise of gears, an averaging process can be used. That is, data fn of "N" rounds of the belt 103 (N is an integer) are input to an RAM in a first-in first-out system, the data fn of "N" rounds or less are averaged, and the averaged data are used as the PLD fluctuation data. When the PLD fluctuation data are continuously renewed, the PLD fluctuation data from the previous round to at most the $N^{th}$ previous round are averaged and the reference data are generated.

In addition, as pulse phases are controlled, which pulse phases are continuously output based on the output from the first rotary encoder 101*a* disposed in the first roller 101, the reference data $\omega_{ref1}$ are converted into a pulse string and PLL control is executed. This is also possible.

MODIFIED EMBODIMENT

Next, a modified embodiment is described.

In the first and second embodiments, an electro-photographic type copying machine (image forming apparatus) is used. However, in the modified embodiment, an inkjet type image forming apparatus (inkjet recording apparatus) is used. In the modified embodiment, the same description as that in the first and second embodiments is omitted.

Figure 18:
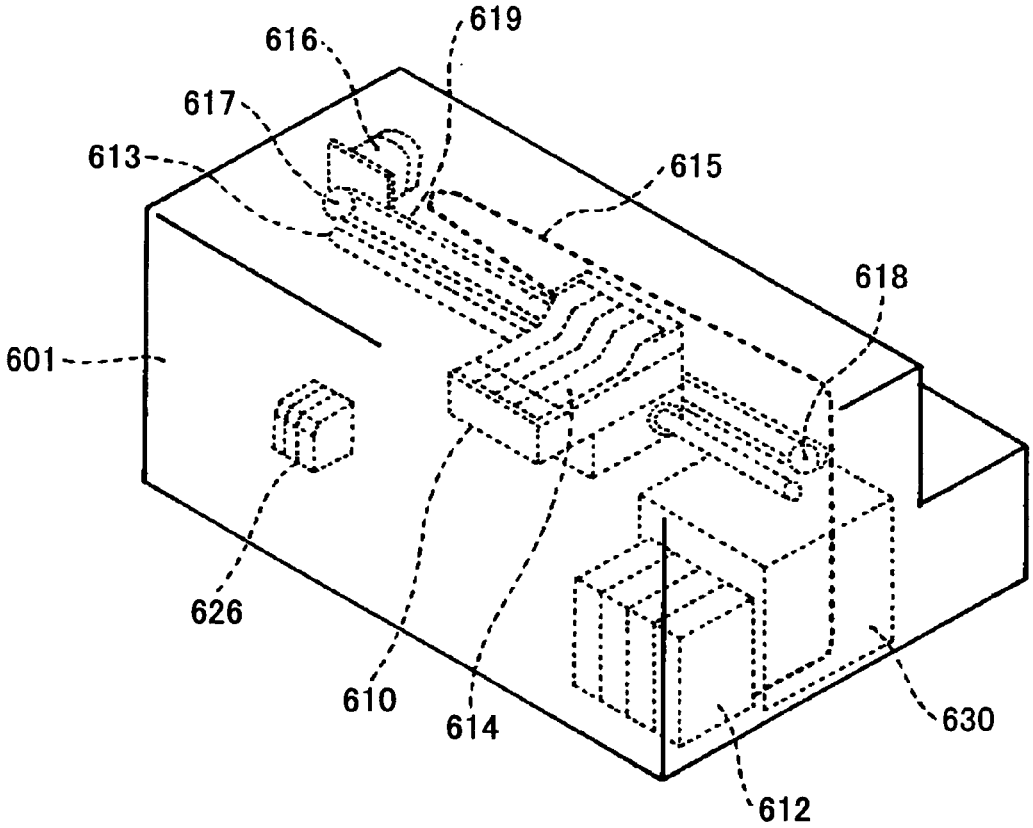
FIG. 18 is a perspective view showing an internal structure of an inkjet recording apparatus according to a modified embodiment of the present invention.
Figure 19:
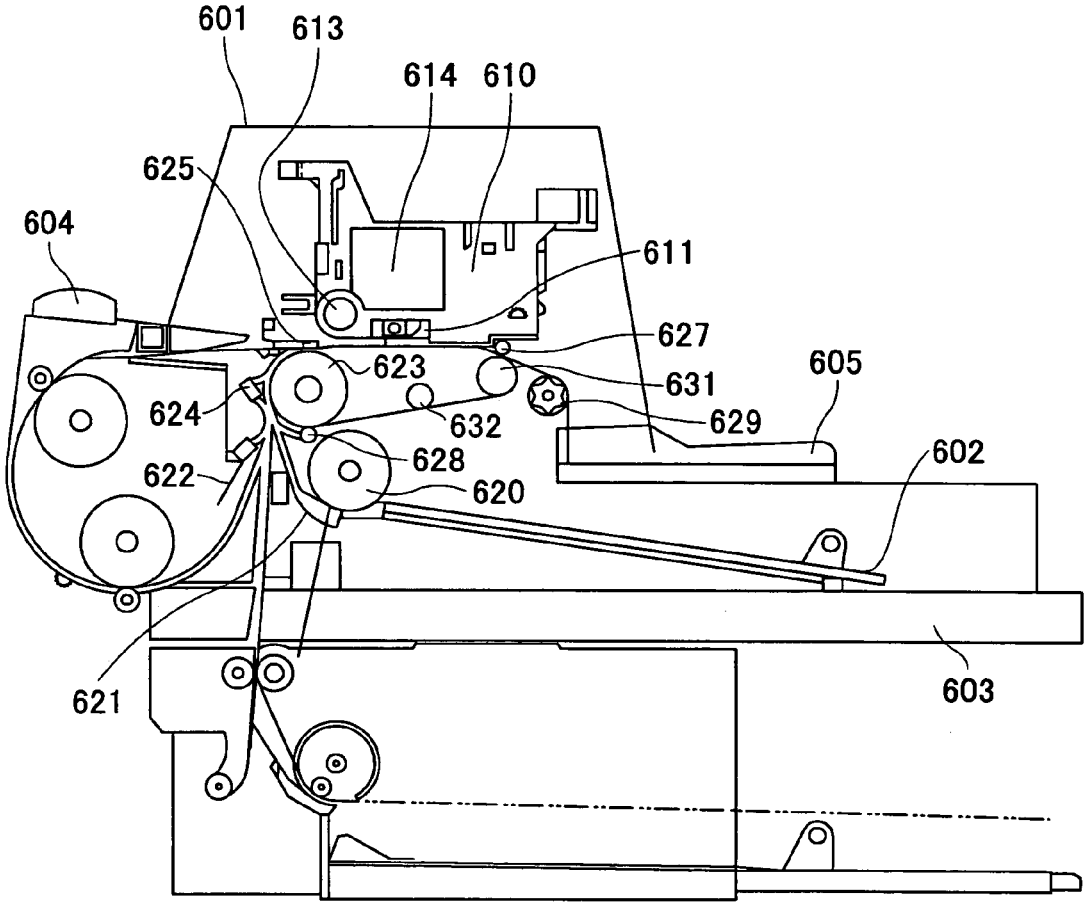
FIG. 19 is a cross-sectional view showing internal mechanisms of the inkjet recording apparatus shown in FIG. 18.

FIG. 18 is a perspective view showing an internal structure of an inkjet recording apparatus according to the modified embodiment of the present invention. FIG. 19 is a cross-sectional view showing internal mechanisms of the inkjet recording apparatus shown in FIG. 18. Referring to FIGS. 18 and 19, the inkjet recording apparatus is described. The inkjet recording apparatus includes a carriage 610 which can move in the main scanning direction in a main body 601. A recording head 611 is disposed in the carriage 610. In addition, an ink cartridge 612 which supplies ink to the recording head 611 is disposed in the main body 601. A paper feeding cassette 603 in which a recording paper 602 is stored is removably attached to the main body 601 at the bottom. In addition, a manual paper feeding tray 604 from which the recording paper 602 is manually fed is attached to the main body 601 in a manner so that the manual paper feeding tray 604 can be opened. In the inkjet recording apparatus, the recording paper 602 is fed from the paper feeding cassette 603 or the manual paper feeding tray 604, and the recording paper 602 is carried and an image is formed on the recording paper 602 by the recording head 611 in the carriage 610. The recording paper 602 on which the image is formed is output to a paper outputting tray 605.

An image forming mechanism (not shown) includes the carriage 610 and the ink cartridge 612. In the image forming mechanism, a main guide rod 613 (guide member) which is held between the right and left side plates (not shown) holds the carriage 610 slidably in the main scanning direction. The carriage 610 is held by the main guide rod 613 so that the ink droplet ejecting directions of yellow (Y) ink droplets, cyan (C) ink droplets, magenta (M) ink droplets, and black (Bk) ink droplets ejecting from the recording head 611 face in the downward direction. A sub tank 614 which supplies ink to the recording head 611 is attached to the upper part of the carriage 610. The sub tank 614 is connected to the ink cartridge 612 which is removably attached to the main body 601 via an ink supplying tube 615, and ink is supplied to the sub tank 614 from the ink cartridge 612. The back side of the carriage 610 is slidably attached to the main guide rod 613. In order to move the carriage 610 in the main scanning direction, a timing belt 619 is wound around a driving pulley 617 which is driven by a main scanning direction motor 616 and a driven pulley 618, and the timing belt 619 is attached to the carriage 610.

In the modified embodiment, as the recording head 611, plural recording heads each of which ejects different color ink droplets, or one recording head which has plural nozzles which eject different color ink droplets can be used. In addition, as the recording head 611, there are a piezoelectric type, a bubble type, and an electrostatic type. In the piezoelectric type, pressure is applied to ink from vibration plates by which liquid chamber walls (ink flowing route walls) are formed. The vibration plates are vibrated by using an electro-mechanical transforming element such as a piezoelectric element. In the bubble type, pressure is applied to ink by generating bubbles by film boiling by using a heating resistor. In the electrostatic type, pressure is applied to ink by displacing vibration plates by electrostatic force between electrodes and the vibration plates of which ink flowing route walls are formed. In the present embodiment, an electrostatic type inkjet head is used.

The inkjet recording apparatus includes a paper feeding roller 620 and a friction pad 621 which supplies the recording paper 602 by separating the recording paper 602 from the paper feeding cassette 603, a guide member 622 which guides the recording paper 602, a paper carrying roller 623 which carries the recording paper 602 by reversing the recording paper 602, a carrying roller 624 which pushes the recording paper 602 to the paper carrying roller 623, and a tip roller 625 which regulates an outputting angle of the recording paper 602 from the paper carrying roller 623. The inkjet recording apparatus carries the recording paper 602 from the paper feeding cassette 603 to a position under the recording head 611 by using the above mechanisms. The paper carrying roller 623 is rotated by a sub scanning direction motor 626 via gears (not shown).

In addition, the inkjet recording apparatus includes an electrostatic carrying belt 627 which guides the recording paper 602 carried from the paper carrying roller 623 to the position under the recording head 611 corresponding to the moving range of the carriage 610 in the main scanning direction. The electrostatic carrying belt 627 adheres the recording paper 602 on the surface of the electrostatic carrying belt 627 by being charged from a charger 628 and maintains the paper surface and the head surface in parallel. A paper outputting roller 629 which outputs the recording paper 602 to the paper outputting tray 605 is disposed at the paper carrying downstream side of the electrostatic carrying belt 627. In addition, a head maintaining and recovering mechanism 630 which maintains the recording head 611 in a normal condition and restores the recording head 611 from an abnormal condition is disposed in the main body 601. In a standby state of an image forming process, in the carriage 610, the recording head 611 is capped by a capping unit at the position of the head maintaining and recovering mechanism 630.

The belt driving control device described above can be utilized in the electrostatic carrying belt 627 and the timing belt 619. When the belt carrying amount at the paper carrying time fluctuates, since color registration errors and color density errors occur in the electrostatic carrying belt 627, highly accurate carrying control is required. Similarly, when the velocity of the carriage 610 fluctuates during the scanning, since the color registration errors and the color density errors occur due to the timing belt 619, highly accurate carrying control is required.

First, the electrostatic carrying belt 627 is described. The electrostatic carrying belt 627 is a single layer belt whose main material is polyimide (PI) and deviation exists in a thickness distribution of one round. Consequently, when the electrostatic carrying belt 627 is driven, a PLD fluctuation occurs. A rotation angle velocity or rotation angle displacement of the paper carrying roller 623 can be obtained by disposing a rotary encoder on the axle of the paper carrying roller 623 or by using a rotation angle detecting unit built in the sub scanning direction motor 626. In addition, a rotation angle velocity or rotation angle displacement of a driven roller 631 can be obtained from a rotary encoder (not shown) disposed on the axle of the driven roller 631 on which the electrostatic carrying roller 627 is held. The radius ratio between the paper carrying roller 623 and the driven roller 631 is 2:1.

Since two rotation angle velocities of the paper carrying roller 623 and the driven roller 631 are obtained, similar to the first and second embodiments, when it is defined that the rotation angle velocity of the paper carrying roller 623 is $\omega_1$ and the rotation angle velocity of the driven roller 631 is $\omega_2$, by the same operations shown in FIGS. 11 and 12, the electrostatic carrying belt 627 can be driven at a desired moving velocity and a desired moving amount.

Figure 20:
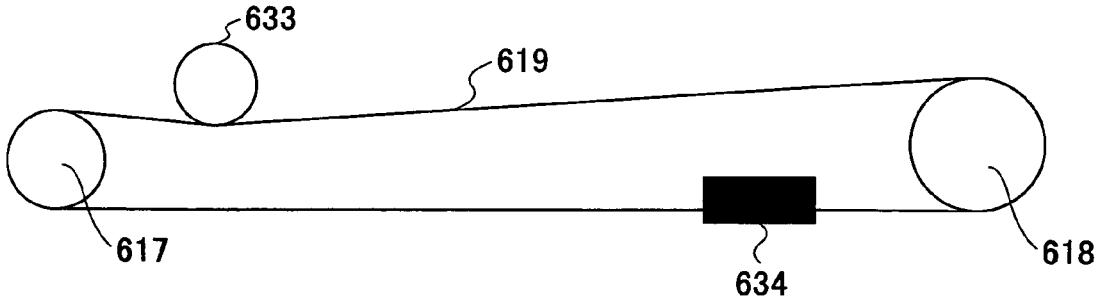
FIG. 20 is a schematic diagram showing a carriage driving mechanism in a copying machine.

Next, the timing belt 619 is described. FIG. 20 is a schematic diagram showing a carriage driving mechanism in a copying machine. The timing belt 619 is an endless belt with cogs in which the belt circumference length is about 1.2 m, the number of belt cogs is 300, the width is about 15 mm, and the material is polyurethane rubber. Further, in the timing belt 619, three wire ropes of about 0.1 mm diameter are bundled along the belt circumference direction as an anti-stretching member. The driving pulley 617 has 18 cogs and the driven pulley 618 has 27 cogs. A tension pulley 633 applies suitable tension to the timing belt 619. When the driving pulley 618 has a mechanism which applies some tension, the tension pulley 633 can be removed. However, when a roller in which a rotary encoder is disposed has a tension mechanism, rotation detecting errors may occur due to the displacement of the roller caused by the tension.

The timing belt 619 has a PLD fluctuation in one round of the belt, caused by disposition errors of the wire ropes, thickness errors of the polyurethane rubber by die errors, and so on. A rotation angle velocity or rotation angle displacement of the driving pulley 617 can be obtained by disposing a rotary encoder on the axle of the driving pulley 617 or using a rotation detecting unit built into the main scanning direction motor 616. Further, a rotation angle velocity or rotation angle displacement of the driven pulley 618 can be obtained by a rotary encoder (not shown) disposed on the axle of the driven pulley 618. The radius ratio between the driving pulley 617 and the driven pulley 618 is 2:3. Since two rotation angle velocities of the driving pulley 617 and the driven pulley 618 are obtained, similar to the first and second embodiments, when it is defined that the rotation angle velocity of the driving pulley 617 is $\omega_1$ and the rotation angle velocity of the driven pulley 618 is $\omega_2$, by the same operations shown in FIGS. 11 and 12, the timing belt 619 can be driven by a desired moving velocity and a desired moving amount.

The carriage 610 provides a holding section 634 which holds the timing belt 619. The carriage 610 can be held at an arbitrary position of the timing belt 619 by the holding section 634. The holding section 634 can be removably attached to the timing belt 619. Therefore, the carriage 610 is removable from the timing belt 619. When the PLD fluctuation is to be determined, the timing belt 619 is driven by removing the carriage 610 from the timing belt 619, and the PLD fluctuation of one round of the timing belt 619 is determined.

In addition, as a unit which detects a scanning position of the carriage 610, a linear encoder mechanism is generally used in which a highly accurate scale pattern disposed along the belt circumference direction of the timing belt 619 is read by a sensor. However, in the modified embodiment, since rotary encoders are disposed in the corresponding driving and driven pulleys 617 and 618 around which the timing belt 619 is wound, the scanning position of the carriage 610 can be detected by the outputs from the rotary encoders. Therefore, in the modified embodiment, it is not necessary to form the highly accurate scale pattern on the timing belt 619, in addition, there is an advantage in that a sensor does not need to be disposed on the carriage 610. When the scanning distance of the carriage 610 is large, the above advantage is effective.

In the first and second embodiments, the belt driving control device controls the driving of the belt 103 by controlling the rotation of the driving roller 105 (drive sustaining rotation body) from which rotation driving force is transmitted in the sustaining rollers 101, 102, and 105 (sustaining rotation bodies) around which the belt 103 is wound.

The belt driving control device includes the digital signal processing section (control unit) which controls the rotation of the driving roller 105 so that the fluctuation of the belt moving velocity V caused by the PLD fluctuation of the belt 103 in the circumference direction becomes small based on detected results of the rotation angle displacement or the rotation angle velocities of the first roller 101 and the second roller 102. In this, in the first roller 101 and the second roller 102, the roller effective radiuses are different, or the degrees to which the PLDs of parts of the belt 103 which wind around the rollers influence the belt moving velocity V and the rotation angle velocities of the rollers, are different. In the first and second embodiments, the digital signal processing section obtains information of the PLD fluctuation f(t), by setting an arbitrary position on the moving route of the belt 103 as a virtual home position, and executes the above rotation control by using the information of the PLD fluctuation f(t). In the belt driving control device, as described above, the sizes of the PLD fluctuations in the belt circumference direction, which are detected by the rotation angle velocities $\omega_1$ and $\omega_2$ of the driven rollers 101 and 102 are different, caused by the difference of the roller effective radiuses $R_1$ and $R_2$, the difference of the belt winding angles $\theta_1$ and $\theta_2$, the difference of the belt materials, and the difference of the belt layer structures. The belt driving control device, by utilizing the above differences, can specify the PLD fluctuation which influences the relationship between the belt moving velocity V and the rotation angle velocities $\omega_1$ and $\omega_2$ of the first and second rollers 101 and 102 by using the rotation angle displacement or the rotation angle velocities $\omega_1$ and $\omega_2$ of the first and second rollers 101 and 102. Even if the fluctuation is complex, the PLD fluctuation can be specified at high accuracy. Therefore, the driving of the belt 103 can be controlled at high accuracy so that the fluctuation of the belt moving velocity V becomes small.

When the belt 103 is a single layer belt whose material is uniform, the belt driving control can be executed by using a belt thickness fluctuation which has a constant relationship with the PLD fluctuation. Based on detected results of the rotation angle displacement or the rotation angle velocities of the two first and second rollers 101 and 102, the rotation control of the driving roller 105 is executed so that the fluctuation of the belt moving velocity V caused by the belt thickness direction in the belt circumference direction of the belt 103 becomes small. In this, in the first roller 101 and the second roller 102, the roller effective radiuses are different, or the degree, to which the thickness of the belt, at a part where the belt 103 winds around the first roller 101 or the second roller 102, influences the relationship between the belt moving velocity V and the rotation angle velocities $\omega_1$ or $\omega_2$ is different.

In the modified embodiment, as described in the recognition method 1, the rotation control of the driving roller 105 can be executed by using the approximated PLD fluctuation information. In the approximated PLD fluctuation information, two roller rotation fluctuation information elements, that is, the information of the PLD fluctuation f(t) and f(t−τ), which is recognized from the rotation angle displacement or the rotation angle velocities $\omega_1$ and $\omega_2$ of the first roller 101 and second roller 102 at the same time, is obtained as the same phase. That is, it is approximated that the phases of the PLD fluctuation f(t) and f(t−τ) are the same. With this, the information of the PLD fluctuation f(t) is easily obtained. When the distance between the two rollers 101 and 102 is small enough, the delay time τ becomes sufficiently small; therefore, even if the approximation f(t)=f(t−τ) is established, the information of the PLD fluctuation f(t) can be obtained at sufficiently high accuracy.

In addition, in the present embodiment, as described in the recognition method 2, data obtained based on detected results of the rotation angle displacement or the rotation angle velocities $\omega_1$ and $\omega_2$ of the first roller 101 and second roller 102 detected at the same time (left side data in Equation 27), or data based on the rotation angle displacement or the rotation angle velocity $\omega_2$ when the rotation angle velocity of the first roller 101 is maintained as the constant rotation angle velocity $\omega_{01}$, are detection information items in which the information of the PLD fluctuation f(t) and f(t−τ) are included. Therefore, the coefficient of the one of the PLD fluctuation information item is normalized as 1 based on Equation 27, the difference Gf(t−τ) between the obtained time function gf(t) and a time function f(t) which is the PLD fluctuation information item to be obtained is made small, and the rotation control of the driving roller 105 is executed by using the above result as the PLD fluctuation information item. After the above normalization, the coefficient of the other of the PLD fluctuation information item is made less than 1. In the process in which the difference Gf(t−τ) is made small, to the time function gf(t) in which the coefficient of the PLD fluctuation information item is normalized as 1, the following are given: a delay element corresponding to a time $\tau$ in which the belt 103 needs to move between the first roller 101 and the second roller 102; the degrees $\kappa_1$ and $\kappa_2$ which the PLDs of parts of the belt 103 where the first roller 101 and the second roller 102 wind the parts of the belt 103 influence the belt moving velocity V; and a gain element based on the roller effective radiuses $R_1$ and $R_2$. After this, an addition process in which the original time function gf(t) data are added is executed; then, the rotation control of the driving roller 105 is executed by using the above process result h(t) as the information of the PLD fluctuation f(t). Therefore, the information of the PLD fluctuation f(t) can be obtained at high accuracy without depending on the distance between the first and second rollers 101 and 102. Consequently, the degree of freedom in the device layout can be increased.

Especially, in the present embodiment, as described in the recognition method 2, in the above process in which the difference $Gf(t-\tau)$ is made small, a gain is given to the input time function, the input time function is added to a time function in which the phase of the input time function is delayed or led by the delay time $\tau$ which the belt 103 needs to move between the first roller 101 and the second roller 102, and the above adding process is repeated a predetermined number of times. As the gain at the $n^{th}$ adding process, the $2^{n-1}$ power of the gain G of the first adding process is used, and as the delay time $\tau$ of the $n^{th}$ adding process, the $2^{n-1}$ times of the delay time $\tau$ of the first adding process is used. The PLD fluctuation effective coefficients $\kappa_1$ and $\kappa_2$ of the above two sustaining rollers (first roller 101 and second roller 102) and the roller effective radiuses $R_1$ and $R_2$ of the above two sustaining rollers are determined so that the gain G at the first adding process obtaining from Equation 29 becomes less than 1. Since these processes can be executed by a FIR filter, stable processes can be executed.

In the process in which the difference $Gf(t-\tau)$ is made small, as shown in FIGS. 6 (*a*) and (*b*), the gain G obtained from Equation 29 is given to the input time function, the phase of the input time function is delayed or led by the moving time which the belt 103 needs to move between the first roller 101 and the second roller 102, the time function whose phase is delayed or led is fed back, and the time function is added to the input time function. Then, the added result can be used as the information of the PLD fluctuation f(t). In this case, since non-feedback type operations by the FIR filter are executed, the same operations can be executed by a small number of steps or a simple circuit structure.

In addition, as described in the recognition method 3, the first roller 101 and the second roller 102 are disposed so that the ratio of the belt carrying distance between the first roller 101 and the second roller 102 to the belt circumference length becomes 1:2Nb (Nb is an integer). Further, data obtained based on detected results of the rotation angle displacement or the rotation angle velocities $\omega_1$ and $\omega_2$ of the first roller 101 and second roller 102 detected at the same time (left side data in Equation 27), or data based on the rotation angle displacement or the rotation angle velocity $\omega_2$ when the rotation angle velocity of the first roller 101 is maintained as the constant rotation angle velocity $\omega_{01}$, are detection information in which the information of the PLD fluctuation f(t) and $f(t-\tau)$ is included. Therefore, based on Equation 27, normalization is applied so that the coefficient of one of the PLD fluctuation information items becomes 1, and the difference $Gf(t-\tau)$ between the obtained time function gf(t) and a time function f(t) which is the PLD fluctuation information item to be obtained is made small. Further, the above result is multiplied by $1/(1-G^m)$ ($m=2^{Nb}$), and the rotation control of the driving roller 105 is executed by using the multiplied result. In the above process in which the difference $Gf(t-\tau)$ is made small, a gain is applied to the input time function, the input time function is added to a time function in which the phase of the input time function is delayed or led by the delay time $\tau$ which the belt 103 needs to move between the first roller 101 and the second roller 102, and the above adding process is repeated Nb times. As the gain at the $n^{th}$ adding process, the $2^{n-1}$ power of the gain G of the first adding process is used, and as the delay time $\tau$ of the $n^{th}$ adding process, the $2^{n-1}$ times of the delay time $\tau$ of the first adding process is used. The PLD fluctuation effective coefficients $\kappa_1$ and $\kappa_2$ of the above two sustaining rollers (first roller 101 and second roller 102) and the roller effective radiuses $R_1$ and $R_2$, of the above two sustaining rollers are determined so that the gain G at the first adding process obtaining from Equation 29 becomes less than 1. Since these processes can be executed by a FIR filter, stable processes can be executed. In addition, when the recognition method 3 is compared with the recognition method 2, in the recognition method 3, the information item of the PLD fluctuation f(t) can be obtained in a short time at high accuracy.

Further, in the present embodiment, the information item of the PLD fluctuation f(t) is obtained again at predetermined timing. With this, at timing in which the PLD fluctuation of the belt 103 changes beyond the tolerance caused by the environment change and in the passage of time, the PLD fluctuation F(t) can be obtained again. As a result, even if the PLD fluctuation of the belt 103 changes, the belt driving control can be maintained at high accuracy. Especially, as described in the first embodiment, when the predetermined timing is selected as timing in which a difference between PLD fluctuation data which are predicted based on the moving position of the belt 103 and the information of the PLD fluctuation f(t) and actual PLD fluctuation data exceeds the tolerance, the belt driving control can be stably maintained at high accuracy.

In addition, in the present embodiment, as described in the second embodiment, the rotation control of the driving roller 105 can be executed while the information of the PLD fluctuation f(t) is obtained. In this case, the belt driving control can be maintained further stably at high accuracy. In addition, in this case, it is not necessary to retain the information of the PLD fluctuation f(t) of the belt one round; consequently, a memory for this is not needed.

In addition, in the present embodiment, as described above, it is possible that the FIFO storage 419 which stores the past PLD fluctuation information of at least one round of the belt 103 be disposed, and PLD fluctuation information in which the past PLD fluctuation information and newly obtained PLD fluctuation information are averaged be used as the information of the PLD fluctuation f(t). In this case, since the averaged information of the past PLD fluctuation information and the newly obtained PLD fluctuation information are used, the information of the PLD fluctuation f(t) can be obtained at higher accuracy. With this, the influence of detection errors caused by random fluctuations generated by backlash and noise of gears can be decreased.

In addition, as described above, the belt rotating device according to the embodiments of the present invention includes many sustaining rollers (including first roller 101, second roller 102, and driving roller 105), the belt 103, the driving motor 106, the rotary encoders 101*a* and 101*b*, and the first and second angular velocity detecting sections 111 and 112. The belt 103 is wound around the sustaining rollers including the first and second rollers 101 and 102 and the driving roller 105. The driving motor 106 rotates the driving roller 105. In the first roller 101 and the second roller 102, the roller radii are different from each other, or the degrees to which the PLDs of parts of the belt 103 wound around the two rollers influence the relationship between the belt moving velocity V and the rotation angle velocities $\omega_1$ or $\omega_2$ are different from each other. The first angular velocity detecting section 111 detects the rotation angle velocity $\omega_1$ of the first roller 101 from information of the first rotary encoder 101*a*, and the second angular velocity detecting section 112 detects the rotation angle velocity $\omega_2$ of the second roller 102 from information of the second rotary encoder 102*a*. The belt rotating device uses the belt driving controller which controls driving the belt 103 by controlling the rotation of the driving roller 105 to which rotation driving force is transmitted from the driving motor 106. With this, as described above, a belt rotating device which executes the driving control of the belt 103 at high accuracy can be realized.

In addition, in the disposing position example 1 of the rotary encoders, the two rollers 101 and 102 are driven rollers which are rotated by the movement of the belt 103. In this case, when the PLD fluctuation f(t) is obtained, fluctuation components (sliding contact between the driving roller 105 and the belt 103 and so on) which become recognition error factors do not have influence. Therefore, the PLD fluctuation can be obtained at higher accuracy.

Especially, as described in the disposing position example 3 of the rotary encoders, when the rotation angle displacement or the rotation angle velocity $\omega_m$ of the driving motor 106 is detected and a feedback control unit is used, which control unit controls so that the detected rotation angle displacement or the detected rotation angle velocity $\omega_m$ becomes target rotation angle displacement or a target rotation angle velocity, a more stable belt driving controller can be designed. In addition, the PLD fluctuation effective coefficients $\kappa_1$ and $\kappa_2$ of the driven rollers 101 and 102 can be corrected so that the PLD fluctuation f(t) can be obtained at higher accuracy.

In addition, as described in the disposing position example 2 of the rotary encoders, in order to obtain the information of the PLD fluctuation f(t), as one of the rollers from which the rotation angle displacement or the rotation angle velocities are obtained, the driving roller 105 is selected. In this case, a detecting unit which detects the rotation angle displacement or the rotation angle velocity $\omega_m$ of the driving motor 106 is used, or as the driving motor 106, a motor which uses target rotation angle displacement or a target rotation angle velocity is used. When as the driving motor 106, for example, a pulse motor is used, only one rotary encoder is required, and cost can be reduced. That is, since one of the rotation angle displacement or the rotation angle velocity for obtaining the information of the PLD fluctuation f(t) is the rotation angle displacement or the rotation angle velocity of the driving roller 105 which can be ensured as a constant, the information of the PLD fluctuation f(t) can be obtained from only the rotation angle displacement or the rotation angle velocity $\omega_2$ of the other roller.

In addition, as described in the disposing position example 1 of the rotary encoders, in order to obtain the reference belt moving position of the belt 103, the mark detecting sensor 104 which detects the home position mark 103*a* showing the reference position on the belt 103 is disposed. The relationship between the belt moving position corresponding to the obtained PLD fluctuation information f(t) and the actual belt moving position is obtained at detecting timing of the mark detecting sensor 104, and the rotation control of the driving roller 105 is executed. With this, since the reference position on the belt for one round can be determined, the obtained PLD fluctuation information f(t) can be used in the belt driving control where the obtained PLD fluctuation information f(t) matches the PLD fluctuation of the belt 103. That is, the belt driving control can be suitably executed.

In addition, as described in the belt driving control example 2, the relationship between the belt moving position corresponding to the obtained PLD fluctuation information f(t) and the actual belt moving position is obtained from an average time, which average time is obtained beforehand as a time which the belt 103 needs to move one round or the belt circumference length which is obtained beforehand, and the rotation control of the driving roller 105 is executed. With this, without disposing the home position mark 103*a* on the belt 103 and the mark detecting sensor 104, the reference position (virtual home position) in one round of the belt can be determined. Therefore, the cost can be lowered.

In addition, as described in the recognition method 1 of the PLD fluctuation, the distance between the first roller 101 and the second roller 102 (belt circumference direction distance) is set so that the tolerance $X_{err}$ of each frequency component generated by the approximation $f(t)=f(t-\tau)$ is within the predetermined total position shift error $X_{errT}$. With this, even if the approximation $f(t)=f(t-\tau)$ is used, the information of the PLD fluctuation f(t) can be obtained at sufficiently high accuracy.

In addition, when the belt 103 is a seam belt which has a seam at least at one position in the belt circumference direction, the seam may be thicker than the other parts and the stretch of the seam may be different from that of the other parts caused by changing the property of the material. In this case, even if the thickness of the seam is the same as that of the other parts, the PLD of the seam becomes largely different from that of the other parts. However, according to the belt driving controller in the embodiments of the present invention, even in a belt which has a large PLD fluctuation, the PLD fluctuation can be specified at high accuracy. Therefore, in such a seam belt, the belt driving control can be executed at high accuracy by restraining the belt velocity fluctuation generated suddenly when the seam winds around the driving roller 105.

Further, when the belt 103 is a plural-layer belt which has plural layers in the belt thickness direction, even if the thickness is uniform, the belt velocity fluctuation may occur by the PLD fluctuation caused by the layer structure. However, according to the belt driving controller in the embodiments of the present invention, as described above, since the PLD fluctuation is specified and the belt driving control is executed based on the specified PLD fluctuation, the belt driving control can be executed at high accuracy in the plural-layer belt.

In addition, as described in the modified embodiment of the present invention, of the plural sustaining rollers, the driving pulley 617 and the driven pulley 618 have plural cogs in the rotating direction and the timing belt 619 has plural cogs to engage with the above cogs so that the PLD fluctuation occurs in the timing belt 619 and the belt velocity fluctuation is generated. That is, the PLD fluctuation of the belt occurs caused by not only the shape or the structure of the belt but also the driving mechanism of the belt, and the belt velocity fluctuates when the PLD fluctuation occurs. Therefore, not only in the intermediate transfer belt 10 which is driven by the friction with the surfaces of the sustaining rollers but also in a belt having cogs such as the timing belt 619 in the modified embodiment, the belt moving velocity fluctuates caused by the PLD fluctuation. As described in the modified embodiment, in this kind of belt, the PLD fluctuation is specified and the driving control of the belt can be executed at high accuracy based on the specified PLD fluctuation.

In the above description, the rotation angle displacement can be used. That is, the rotation angle displacement is obtained by integrating the rotation angle velocities, and the relationship between the PLD fluctuation f(t) and the rotation angle displacement of the roller can be similarly obtained. Specifically, a rotation angle displacement fluctuation is obtained by removing an average increment (gradient components of the rotation angle displacement) from the detected rotation angle displacement, and the PLD fluctuation f(t) is obtained from the rotation angle displacement fluctuation by using the recognition method 1, 2, or 3.

Further, in the embodiments, in a case where the belt 103 moves inversely, when it is considered that the belt 103 is moving, it is enough that the delay time $\tau$ is replaced by $Tb-\tau$ (Tb: belt one round time). At this time, $2(Tb-\tau)=2Tb-2\tau \rightarrow Tb-2\tau$ is set, and in a case of $N(Tb-\tau)$ (N is an integer), $N(Tb-\tau) \rightarrow Tb-N\tau$ is set. That is, when the PLD fluctuation f(t) is obtained by using the FIR filter or the IIR filter described in the recognition method 2, the delay time process becomes large when $N(Tb-\tau)$ is used; however, actually, almost the same result can be obtained by using $Tb-N\tau$.

In addition, in the embodiments of the present invention, the driving control of the intermediate transfer belt in the tandem type image forming apparatus is mainly described. However, as described above, the embodiments of the present invention can be utilized in the driving control of a belt (paper carrying belt, photoconductor belt, fixing belt, and so on) which is used in an image forming apparatus using an electrophotographic technology, an inkjet technology, and a printing technology. That is, the embodiments of the present invention can be utilized in an apparatus which requires high accuracy in the belt driving control. Further, the apparatus is not limited to the image forming apparatus, when the apparatus needs high accurate control of belt driving, the embodiments of the present invention can be utilized in the apparatus.

Further, the present invention is not limited to the specifically disclosed embodiments, and variations and modifications may be made without departing from the scope of the present invention.

The present invention is based on Japanese Priority Patent Application No. 2005-157976, filed on May 30, 2005, and Japanese Priority Patent Application No. 2005-338736, filed on Nov. 24, 2005, with the Japanese Patent Office, the entire contents of which are hereby incorporated by reference.

What is claimed is:

1. A belt driving controller, which executes driving control of a belt that is wound around a plurality of sustaining rotation bodies including a driven sustaining rotation body that is rotated together with a movement of the belt and a driving sustaining rotation body that transmits driving force to the belt, comprising:

a control unit, which executes the driving control of the belt so that a moving velocity fluctuation of the belt caused by a PLD (pitch line distance) fluctuation in the belt circumference direction becomes small, based on rotation information of rotation angle displacement or rotation angle velocities in two of the sustaining rotation bodies in the plural sustaining rotation bodies, in which two sustaining rotation bodies the diameters thereof are different from each other and/or the degrees to which the PLDs of parts of the belt which wind around the two sustaining rotation bodies influence the belt moving velocity and the rotation angle velocities of the two sustaining rotation bodies are different from each other, wherein the control unit executes the driving control of the belt, by using a process result in which one of two rotation fluctuation information items whose phases are different included in the rotation information of the two sustaining rotation bodies is processed to be small, and wherein the two sustaining rotation bodies are disposed so that a ratio of a belt moving route length between the two sustaining rotation bodies to a belt total circumference length becomes 1 to 2Nb (Nb is an integer), and in the process, an adding process is applied to the two rotation fluctuation information items whose phases are different included in the rotation information of the two sustaining rotation bodies, and in the adding process, rotation fluctuation information to which a delay time which is a time that the belt needs to pass through a distance between the two sustaining rotation bodies on a belt moving route is given and also to which a gain is given based on the degrees of the two sustaining rotation bodies are added to the rotation fluctuation information, and the adding process is repeated by Nb times, and in the adding process, as the gain at an nth adding process, where n represents an integer between 1 and Nb, the 2n−1 power of the gain G of the first adding process is used, and as the delay time of the nth adding process, the 2n−1 times of the delay time of the first adding process is used.

2. A belt driving controller, which executes driving control of a belt that is wound around a plurality of sustaining rotation bodies including a driven sustaining rotation body that is rotated together with a movement of the belt and a driving sustaining rotation body that transmits driving force to the belt, comprising:

a control unit, which executes the driving control of the belt so that a moving velocity fluctuation of the belt caused by a belt thickness fluctuation in the belt circumference direction becomes small, based on rotation information of rotation angle displacement or rotation angle velocities in two of the sustaining rotation bodies in the plural sustaining rotation bodies, in which two sustaining rotation bodies the diameters thereof are different from each other and/or the degrees to which the belt thicknesses of parts of the belt which wind around the two sustaining rotation bodies influence the belt moving velocity and the rotation angle velocities of the two sustaining rotation bodies are different from each other, wherein the control unit executes the driving control of the belt, by using a process result in which one of two rotation fluctuation information items whose phases are different included in the rotation information of the two sustaining rotation bodies is processed to be small, and wherein the two sustaining rotation bodies are disposed so that a ratio of a belt moving route length between the two sustaining rotation bodies to a belt total circumference length becomes 1 to 2Nb (Nb is an integer), and in the process, an adding process is applied to the two rotation fluctuation information items whose phases are different included in the rotation information of the two sustaining rotation bodies, and in the adding process, rotation fluctuation information to which a delay time which is a time that the belt needs to pass through a distance between the two sustaining rotation bodies on a belt moving route is given and also to which a gain is given based on the degrees of the two sustaining rotation bodies are added to the rotation fluctuation information, and the adding process is repeated by Nb times, and in the adding process, as the gain at an nth adding process, where n represents an integer between 1 and Nb, the 2n−1 power of the gain G of the first adding process is used, and as the delay time of the nth adding process, the 2n−1 times of the delay time of the first adding process is used.

3. A belt driving controller, which executes driving control of a belt that is wound around a plurality of sustaining rotation bodies including a driven sustaining rotation body that is rotated together with a movement of the belt and a driving sustaining rotation body that transmits driving force to the belt, comprising:

a control unit, which executes the driving control of the belt so that a moving velocity fluctuation of the belt caused by a PLD (pitch line distance) fluctuation in the belt circumference direction becomes small, based on rotation information of rotation angle displacement or rotation angle velocities in two of the sustaining rotation bodies in the plural sustaining rotation bodies, in which two sustaining rotation bodies the diameters thereof are different from each other and/or the degrees to which the PLDs of parts of the belt which wind around the two sustaining rotation bodies influence the belt moving velocity and the rotation angle velocities of the two sustaining rotation bodies are different from each other, wherein the control unit executes the driving control of the belt, by using a process result in which one of two rotation fluctuation information items whose phases are different included in the rotation information of the two sustaining rotation bodies is processed to be small, and wherein the two sustaining rotation bodies are disposed so that a ratio of a belt moving route length between the two sustaining rotation bodies to a belt total circumference length becomes 1 to 2Nb+1 (Nb is an integer), and in the process, an adding process is applied to the two rotation fluctuation information, and in the adding process, rotation fluctuation information to which a delay time which is a time that the belt needs to pass through a distance between the two sustaining rotation bodies on a belt moving route is given and also to which a gain is given based on the degrees of the two sustaining rotation bodies are added to the rotation fluctuation information, and the adding process is repeated from the first time to the (2Nb+1) time, and in the adding process, as the gain at an nth adding process, where n represents an integer between 1 and (2Nb+1), the (n−1) power of the gain G of the first adding process is used, and as the delay time of the nth adding process, the (n−1) times of the delay time of the first adding process is used.

4. A belt driving controller, which executes driving control of a belt that is wound around a plurality of sustaining rotation bodies including a driven sustaining rotation body that is rotated together with a movement of the belt and a driving sustaining rotation body that transmits driving force to the belt, comprising:

a control unit, which executes the driving control of the belt so that a moving velocity fluctuation of the belt caused by a belt thickness fluctuation in the belt circumference direction becomes small, based on rotation information of rotation angle displacement or rotation angle velocities in two of the sustaining rotation bodies in the plural sustaining rotation bodies, in which two sustaining rotation bodies the diameters thereof are different from each other and/or the degrees to which the belt thicknesses of parts of the belt which wind around the two sustaining rotation bodies influence the belt moving velocity and the rotation angle velocities of the two sustaining rotation bodies are different from each other, wherein the control unit executes the driving control of the belt, by using a process result in which one of two rotation fluctuation information items whose phases are different included in the rotation information of the two sustaining rotation bodies is processed to be small, and wherein the two sustaining rotation bodies are disposed so that a ratio of a belt moving route length between the two sustaining rotation bodies to a belt total circumference length becomes 1 to 2Nb+1 (Nb is an integer), and in the process, an adding process is applied to the two rotation fluctuation information, and in the adding process, rotation fluctuation information to which a delay time which is a time that the belt needs to pass through a distance between the two sustaining rotation bodies on a belt moving route is given and also to which a gain is given based on the degrees of the two sustaining rotation bodies are added to the rotation fluctuation information, and the adding process is repeated from the first time to the (2Nb+1) time, and in the adding process, as the gain at an nth adding process, where n represents an integer between 1 and (2Nb+1), the (n−1) power of the gain G of the first adding process is used, and as the delay time of the nth adding process, the (n−1) times of the delay time of the first adding process is used.

* * * * *